US008959739B1

(12) United States Patent
Goettl et al.

(10) Patent No.: US 8,959,739 B1
(45) Date of Patent: Feb. 24, 2015

(54) POOL CLEANING SYSTEM WITH INCREMENTAL PARTIAL ROTATING HEAD AND AIMING TOOL

(71) Applicant: GSG Holdings, Inc., Chandler, AZ (US)

(72) Inventors: John M. Goettl, Phoenix, AZ (US); Steve Sharp, Phoenix, AZ (US)

(73) Assignee: GSG Holding, Inc., Chandler, AZ (US)

( * ) Notice: Subject to any disclaimer, the term of this patent is extended or adjusted under 35 U.S.C. 154(b) by 0 days.

(21) Appl. No.: 14/078,191

(22) Filed: Nov. 12, 2013

Related U.S. Application Data

(63) Continuation-in-part of application No. 14/029,654, filed on Sep. 17, 2013.

(51) Int. Cl.
*B23Q 17/00* (2006.01)
*E04H 4/00* (2006.01)
*B25B 13/48* (2006.01)

(52) U.S. Cl.
CPC ..... *B25B 13/48* (2013.01)
USPC ..... 29/407.04; 4/490

(58) Field of Classification Search
USPC ..... 29/407.04, 407.01, 91.05, 91.06, 81.08, 29/81.01; 4/490, 492, 488; 239/490, 239/200–206, 208, 282; 134/24, 34, 36, 134/111, 167 R, 169 R
See application file for complete search history.

(56) References Cited

U.S. PATENT DOCUMENTS 935,201 A 9/1909 Hallauer
1,821,579 A 9/1931 Rader
1,964,269 A 6/1934 Munz
2,209,961 A 8/1940 De Lacy-Mulhall
2,214,852 A 9/1940 De Lacy-Mulhall
2,537,904 A 1/1951 McAllister
3,045,829 A 7/1962 Rule et al.
3,059,243 A 10/1962 Ross
3,237,866 A 3/1966 Lovell
3,245,420 A 4/1966 Cherney
3,247,968 A 4/1966 Miller
3,247,969 A 4/1966 Miller
3,408,006 A 10/1968 Stanwood
3,449,772 A 6/1969 Werner
3,486,623 A 12/1969 Bosico
3,506,489 A 4/1970 Baker
3,515,351 A 6/1970 Costa
3,521,304 A 7/1970 Ghiz
3,615,013 A 10/1971 Reece
3,675,252 A 7/1972 Ghiz
3,688,907 A 9/1972 Oravec
3,712,470 A 1/1973 Gansloser
3,765,608 A 10/1973 Lockwood
3,769,993 A 11/1973 Schaeffer
(Continued)

*Primary Examiner* — John C Hong
(74) *Attorney, Agent, or Firm* — Booth Udall Fuller, PLC

(57) ABSTRACT

An alignment kit for aiming a variable rotating pool cleaning nozzle assembly in a pool is disclosed. The alignment kit includes an aiming tool and a locking tool. The aiming tool includes a tray that includes a plurality of aiming reference figures, a cleaning arc indicator coupled to the tray, and a base rotatably coupled to the tray. The cleaning arc indicator includes an adjustable visual area representing a cleaning arc of a variably rotating pool cleaning nozzle assembly. The cleaning arc indicator may include a first ring and a second ring interleaved together and the adjustable visual area may include an area of the second ring not covered by the first ring. The base includes an aiming reference marker adjacent the tray and one or more indexing lugs. The locking tool includes a plurality of aiming symbols and one or more locking lugs.

20 Claims, 34 Drawing Sheets

(56) References Cited

U.S. PATENT DOCUMENTS

| | | | |
|---|---|---|---|
| 3,955,764 | A | 5/1976 | Phaup |
| 4,114,206 | A | 9/1978 | Franc |
| 4,188,673 | A | 2/1980 | Carter |
| 4,193,870 | A | 3/1980 | Goodin |
| 4,195,371 | A | 4/1980 | Goodin |
| 4,200,230 | A | 4/1980 | Gould |
| 4,202,499 | A | 5/1980 | Mathews |
| 4,212,088 | A | 7/1980 | Goettl et al. |
| 4,271,541 | A | 6/1981 | Mathews |
| 4,276,163 | A | 6/1981 | Gordon |
| 4,322,860 | A | 4/1982 | Gould |
| 4,330,412 | A | 5/1982 | Frederick |
| 4,347,979 | A | 9/1982 | Mathews |
| 4,371,994 | A | 2/1983 | Mathews |
| 4,391,005 | A | 7/1983 | Goettl |
| 4,462,546 | A | 7/1984 | Pitman |
| 4,466,142 | A | 8/1984 | Gould |
| 4,471,908 | A | 9/1984 | Hunter |
| 4,486,907 | A | 12/1984 | Carter |
| 4,503,573 | A | 3/1985 | Handzel |
| 4,520,514 | A | 6/1985 | Johnson |
| 4,568,024 | A | 2/1986 | Hunter |
| 4,592,379 | A | 6/1986 | Goettl |
| 4,640,784 | A | 2/1987 | Cant |
| 4,832,838 | A | 5/1989 | Stone |
| 4,907,610 | A | 3/1990 | Meincke |
| 4,939,797 | A | 7/1990 | Goettl |
| 5,048,758 | A | 9/1991 | Jackerson |
| 5,107,872 | A | 4/1992 | Meincke |
| 5,135,579 | A | 8/1992 | Goettl |
| 5,251,343 | A | 10/1993 | Goettl |
| 5,265,631 | A | 11/1993 | Goettl |
| 5,333,788 | A | 8/1994 | Hadar |
| 5,826,797 | A | 10/1998 | Kah, III |
| 6,029,907 | A | 2/2000 | McKenzie |
| 6,085,995 | A | 7/2000 | Kah, Jr. et al. |
| 6,182,909 | B1 | 2/2001 | Kah, Jr. et al. |
| 6,237,862 | B1 | 5/2001 | Kah, III et al. |
| 6,301,723 | B1 | 10/2001 | Goettl |
| 6,367,098 | B1 | 4/2002 | Barnes |
| 6,393,629 | B1 | 5/2002 | Barnes et al. |
| 6,419,840 | B1 | 7/2002 | Meincke |
| 6,438,766 | B1 | 8/2002 | Arnau et al. |
| 7,819,338 | B1 * | 10/2010 | Goettl ..... 239/205 |
| 8,056,155 | B1 * | 11/2011 | Goettl ..... 4/490 |
| 2004/0194201 | A1 | 10/2004 | Goettl |

* cited by examiner

POOL CLEANING SYSTEM WITH INCREMENTAL PARTIAL ROTATING HEAD AND AIMING TOOL

CROSS REFERENCE TO RELATED APPLICATIONS

This application is a continuation-in-part application of the early U.S. Utility Application to Goettl entitled "Pool Cleaning System with Incremental Partial Rotating Head," application Ser. No. 14/029,654, filed Sep. 17, 2013, the disclosure of which is hereby incorporated entirely herein by reference.

BACKGROUND

1. Technical Field

Aspects of this document relate generally to cleaning nozzles for swimming pools and pool cleaning systems.

2. Background Art

Pool cleaning systems are used in swimming pools to remove dirt and debris from the water in the swimming pool. Various methods for removing debris from the pool include the use of "whips" extending from various location on the side walls or nozzles in the side walls or floor surface to stir up debris for pumping to the pool filter. Conventional cleaning nozzles for swimming pools utilize water pressure generated by a pool pump to direct a stream of water across a surface of the pool to entrain and move contaminants from the surface toward a drain. Many conventional cleaning nozzles "pop up" from a surface of a pool as the heads, normally level with the surface, are extended under the influence of water pressure from the pump. When the water pressure from the pump ends, the heads retract downward until level with the surface, conventionally in response to bias from a spring element contained within the cleaning nozzle.

SUMMARY

According to a first aspect, an aiming tool for a variable rotating pool cleaning nozzle assembly comprises a tray, a cleaning arc indicator, and a base. The tray comprises a plurality of aiming reference figures. The cleaning arc indicator is coupled to the tray and comprises an adjustable visual area representing a cleaning arc of a variable rotating pool cleaning nozzle assembly. The base is rotatably coupled to the tray and comprises an aiming reference marker adjacent the tray and one or more indexing lugs positioned to fit between and engage with body installation lugs of a body mounted within a pool structure and corresponding to the variable rotating pool cleaning nozzle assembly to removably and positionally couple the base to the body. The aiming reference marker aligns with one of the plurality of aiming reference figures to establish a relative rotational orientation of the body when the tray is rotated to align the cleaning arc indicator with a selected sweep pattern.

Various implementations and embodiments of an aiming tool comprise one or more of the following. The cleaning arc indicator may comprise a first ring and a second ring interleaved together and the adjustable visual area may comprise an area of the second ring not covered by the first ring, the first ring being rotatable relative to the second ring to increase or decrease the adjustable visual area. A start boss protruding from the second ring, one or more minimum rotation bosses protruding from the second ring and positioned to prevent the first ring from covering the second ring between the one or more minimum rotation bosses and the start boss, and a finger boss protruding from the first ring. The start boss may be positioned between a stop boss and a retainer boss on the tray to positionally couple the second ring to the tray, and the adjustable visual area may be adjustable between approximately 23 degrees and 338 degrees. A channel in the tray formed between an inner wall and an outer wall of the tray, wherein the cleaning arc indicator is seated within the channel, a pole adapter coupled to the tray opposite the base, a friction ring positioned between and in direct contact with the tray, and a plurality of sweep pattern indicators on the tray positioned to indicate a radial degree of the adjustable visible area. The one or more indexing lugs may comprise a first lug and a second lug smaller than the first lug, the first lug being positioned to interface with a minor body installation lug on the body and the second lug being positioned to interface with only major body installation lugs on the body when the base is inserted into the body. A locking tool comprising a plurality of aiming symbols, wherein aligning a nozzle direction indicator on a nozzle head of the variable rotating pool cleaning nozzle assembly with one of the plurality of aiming symbols based upon the relative rotational position of the body aligns variable rotating pool cleaning nozzle assembly with the selected sweep pattern, and one or more locking lugs positioned to align and engage with one or more aiming tool ports on a cap ring of the variable rotating pool cleaning nozzle assembly, wherein rotating the locking tool in a first direction when the one or more locking lugs are engaged with the one or more aiming tool ports aligns the nozzle direction indicator within one of the plurality of aiming symbols and rotating the locking tool in a second direction when the one or more locking lugs are engaged with the one or more aiming tool ports locks the variable rotating pool cleaning nozzle assembly in the selected sweep pattern. The one or more locking lugs may comprise one or more minor locking lugs and one or more major locking lugs, the one or more minor locking lugs being positioned to align and engage with one or more minor aiming tool ports on the cap ring and the one or more major locking lugs being positioned to align and engage with one or more major aiming tool ports on the cap ring.

According to another aspect, a method of aiming a variable rotating pool cleaning nozzle assembly comprises determining, with an aiming tool, a relative rotation orientation of a body corresponding to a variable rotating pool cleaning nozzle assembly mounted in pool structure. The method typically also comprises inserting the variable rotating pool cleaning nozzle assembly into the body mounted in the interior finish of the pool. The method typically also includes engaging a locking tool with a cap ring of the variable rotating pool cleaning nozzle assembly. The method typically also includes aligning a nozzle of the variable rotating pool cleaning nozzle assembly with a selected sweep pattern in the pool. The method typically also includes locking, with the locking tool, the variable rotating pool cleaning nozzle assembly to the body mounted in the pool structure.

Various implementations and embodiments of the method may comprise one or more of the following. Determining the relative rotation orientation of the body may comprise aligning one or more indexing lugs between body installation lugs of the body, inserting a base of the aiming tool into the body, and rotating a tray of the aiming tool removably coupled to the base to align an adjustable visual area visible on the tray with the selected sweep pattern in the pool. Determining the rotation orientation of the body may further comprise determining which one aiming reference figure of a plurality of aiming reference figures on the tray that an aiming reference marker on the base aligns. Adjusting the adjustable visual area by sliding a first ring of the cleaning arc indicator interleaved with a second ring to uncover more or less of the second ring, the adjustable visual area comprising the uncovered portion of the second ring. Rotating the tray of the aiming tool removably coupled to the base to align the adjustable visual area visible on the tray with the selected sweep pattern in the pool may comprise rotating the tray of the aiming tool to align a start boss extending from the second ring with a first edge of the sweep pattern. Sliding the first ring of the cleaning arc indicator may comprise sliding the first ring of the cleaning arc indicator to align terminating end of the first ring with a second edge of the sweep pattern. Aligning the nozzle of the variable rotating pool cleaning nozzle assembly may comprise aligning a nozzle direction indicator with one of a plurality of aiming symbols on the locking tool by rotating a stem of the variable rotating pool cleaning nozzle assembly until the nozzle direction indicator is aligned with the one of the plurality of aiming symbols after rotating the locking tool in a first direction while engaged with the cap ring of the variable rotating pool cleaning assembly, the one of the plurality of aiming symbols corresponding to the one aiming reference figure of the plurality of aiming reference figures. Locking, with the locking tool, the variable rotating pool cleaning nozzle assembly may comprise rotating the locking toll in a second direction while engaged with the cap ring of the variable rotating pool cleaning nozzle assembly. Rotating the tray of the aiming tool removably coupled to the base may comprise rotating the tray of the aiming tool with a pole removably coupled to the tray.

According to another aspect, an alignment kit for aiming a variable rotating pool cleaning nozzle assembly in a pool comprises an aiming tool and a locking tool. The aiming tool comprises a tray comprising a plurality of aiming reference figures, a cleaning arc indicator coupled to the tray and comprising an adjustable visual area representing a cleaning arc of a variably rotating pool cleaning nozzle assembly, and a base rotatably coupled to the tray and comprising an aiming reference marker adjacent the tray and one or more indexing lugs. The locking tool comprises a plurality of aiming symbols and one or more locking lugs.

Various implementations and embodiments of the alignment kit may comprise one or more of the following. The cleaning arc indicator may comprise a first ring and a second ring interleaved together and the adjustable visual area comprises an area of the second ring not covered by the first ring, the first ring being rotatable relative to the second ring to increase or decrease the adjustable visual area and the adjustable visual area being adjustable between approximately 23 degrees and 338 degrees. A start boss protruding from the second ring and positioned between a stop boss and a retainer boss on the tray to positionally couple the second ring to the tray. One or more minimum rotation bosses protruding from the second ring and positioned to prevent the first ring from covering the second ring between the one or more minimum rotation bosses and the start boss. A finger boss protruding from the first ring. A channel in the tray formed between an inner wall and an outer wall of the tray, wherein the cleaning arc indicator is seated within the channel. A pole adapter coupled to the tray opposite the base. A friction ring positioned between and in direct contact with the tray and the base. A plurality of sweep pattern indicators on the tray positioned to indicate a radial degree of the adjustable visible area. The one or more indexing lugs may comprise a first lug and a second lug smaller than the first lug.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DESCRIPTION

This disclosure, its aspects and implementations, are not limited to the specific components or assembly procedures disclosed herein. Many additional components and assembly procedures known in the art consistent with the intended nozzle assembly and/or assembly procedures for a nozzle assembly will become apparent for use with particular implementations from this disclosure. Accordingly, for example, although particular implementations are disclosed, such implementations and implementing components may comprise any shape, size, style, type, model, version, measurement, concentration, material, quantity, and/or the like as is known in the art for such nozzle assemblies and implementing components, consistent with the intended operation.

Structure.

Figure 9:
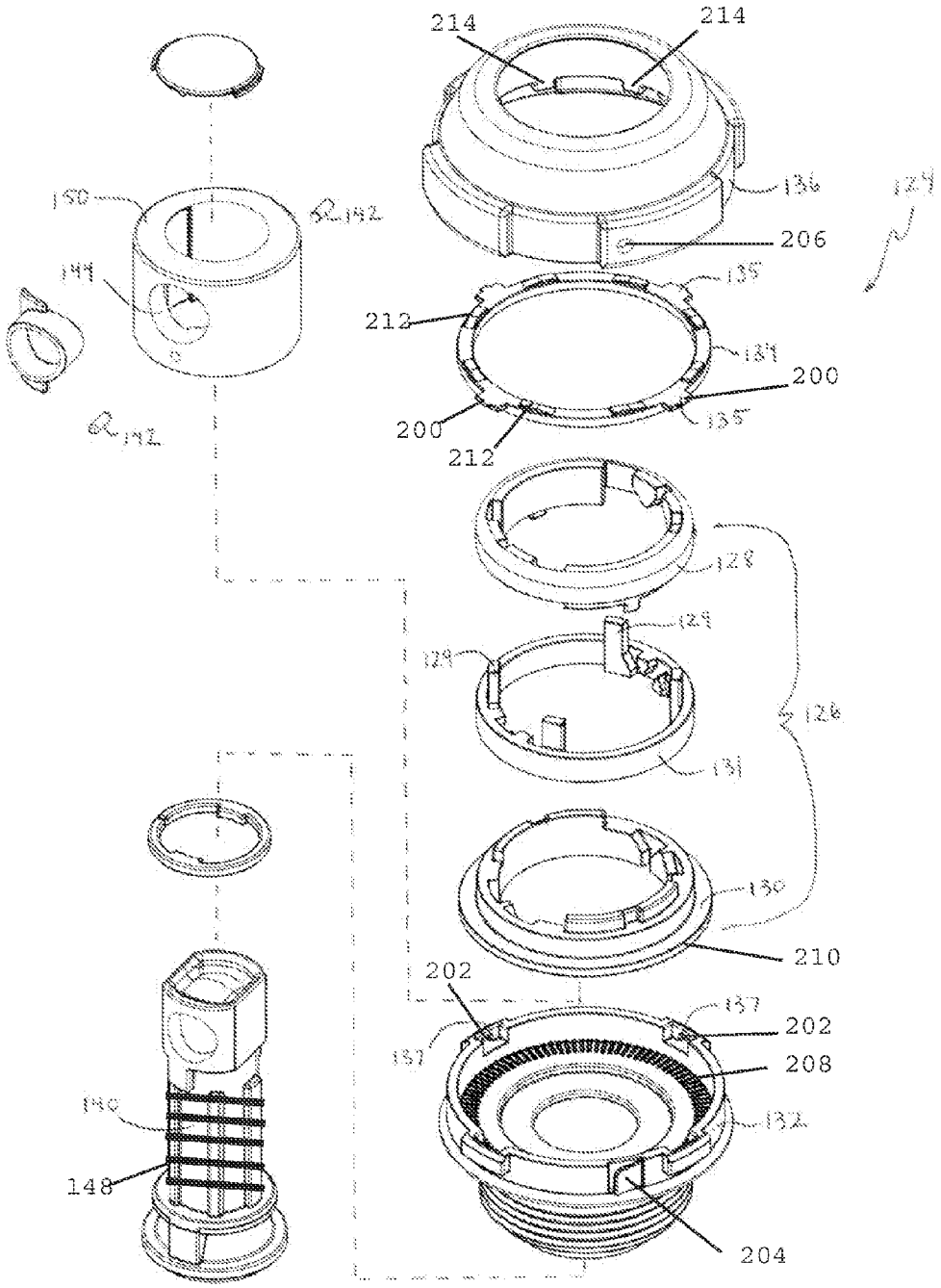
FIG. 9 is an exploded view of an implementation of a nozzle assembly.

Referring to FIG. 9, an exploded view of an implementation of a cleaning head assembly (alternatively called a nozzle assembly) 124 is illustrated. The cleaning head assembly 124 may include a cam assembly (alternatively called a cam ring) 126. As illustrated, in particular implementations the cam assembly 126 may include an upper section 128, a slidable section 131 (alternatively called a cam reverser), and a lower section 130. The slidable section 131 may include at least one shifter 129 that extends from the slidable section into the upper section 128. The cam assembly 126 may couple into a housing (alternatively called a body) 132. When coupled into the housing 132, a locking ring 134 may be coupled over the lower section 130 and includes lugs 135 that engage within locking features 137 in the housing 132. In particular implementations, the upper section 128 and lower section 130 of the cam assembly 126 may be fixedly coupled together through, by non-limiting example, a sonic weld, heat staking, adhesive or other method of fixedly coupling two plastic parts together. While the upper section 128 and lower section 130 are fixedly coupled together, the slidable section 131 remains slidably engaged between them and is free to move rotatably with respect to the upper and lower sections 128, 130, respectively.

The tips of the lugs 135, of the particular implementation shown in FIG. 9, are configured with prongs 200 that fit into the recesses 202 of the locking features 137 in the housing 132. Placement of the locking ring 134 over the cam assembly 126 in the lower section 130 holds the cam assembly 126 in place through mating of the prongs 200 with the recesses 202. In many cases, the strength of the engagement of the prongs 200 into the recesses 202 is strong enough that the up and down nozzle action in the cam assembly 126 so that the nozzle 140 may be tested without the cap ring 136 added. This allows an installer to rotationally adjust the cam assembly 126 in relation to the lower section 130 prior to locking all of the components in place with the cap ring 136. By rotationally adjusting the cam assembly 126 in relation to the lower section 130, the directional orientation of the nozzle 140 may be set regardless of the original orientation of the in-wall fitting for the nozzle assembly. In other words, even though the in-wall fitting for the nozzle assembly yields an unknown radial direction for the final nozzle housing, an installer can adjust the direction of the nozzle during installation to any orientation needed.

A cap ring 136 may be coupled over the cam assembly 126 against the locking ring 134. Use of the cap ring 136 may allow, in particular implementations, for the lower and upper sections 130, 128 of the cam assembly 126 to be rendered substantially immobile in relation to the housing 132 during operation of the cleaning head assembly 124 while leaving the slidable section 131 capable of rotational sliding motion. The cap ring 136 may be loosened or removed by pressing a locking arm 204 coupled to the housing 132 which is engaged with the cap ring 136 inwardly through an opening 206 in the cap ring 136 until the locking arm 204 disengages from the cap ring 136. The locking arm 204 is biased to a position that engages the cap ring 136. For example, the locking arm 204 may be formed of a flexible material that self-biases the locking arm 204. As another example, the locking arm 204 may be formed as a lever with a spring, or through other structures known in the art for manufacturing a biased arm.

As illustrated in FIG. 9, the ability of the cap ring 136 to render the lower and upper sections 128, 130 of the cam assembly 126 substantially immobile is aided, in particular implementations, by a plurality of ridges 208 distributed along the surface of the housing 132 that couple with the lower section 130 of the cam assembly 126. As illustrated, the lower section 130 includes a plurality of grooves 210 that couple with the plurality of ridges 208 of the housing 132 under compressive force created by the rotation of the cap ring 136. In particular implementations, the compressive force generated by the rotation of the cap ring 136 may be increased through a plurality of ramp members 212 extending from the locking ring 134 that engage with projections 214 of the cap ring 136 while it is rotated. As the cap ring 136 is rotated, the force on the locking ring 134 increases as the projections 214 engage with the ramp members 212, pressing the locking ring 134 against the lower section 130 of the cam assembly 126. As the force against the lower section 130 increases, the plurality of grooves 210 begin to increasingly engage with the plurality of ridges 208, thereby increasingly restricting the rotational motion of the lower section 130 until it is rendered substantially immobile. In particular implementations, once the cap ring 136 has been rotated sufficiently to render the lower section 130 immobile, the locking arm 204 may engage with the cap ring 136 to resist any unintentional loosening of the cleaning head assembly 124 thereby maintaining the positional relationship between the cam assembly 126 and the housing 132.

Figure 10:
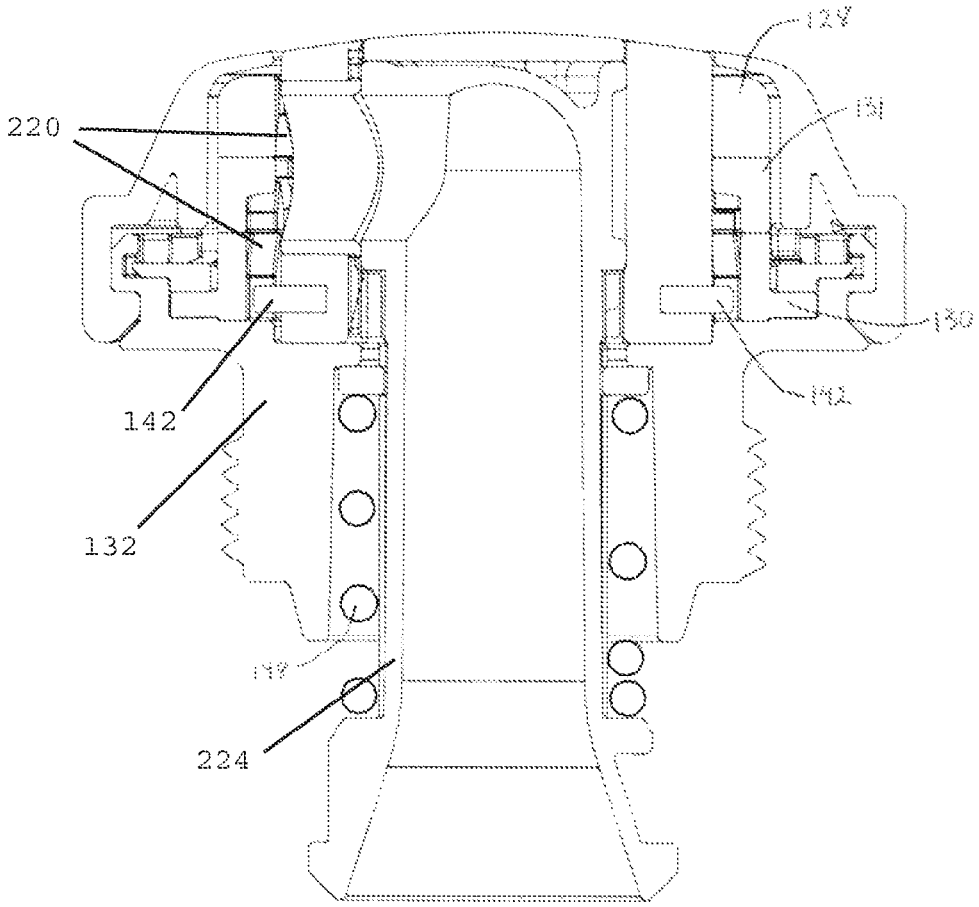
FIG. 10 is a cross-sectional view of an assembled nozzle assembly along sectional line A in FIG. 9.
Figure 15:
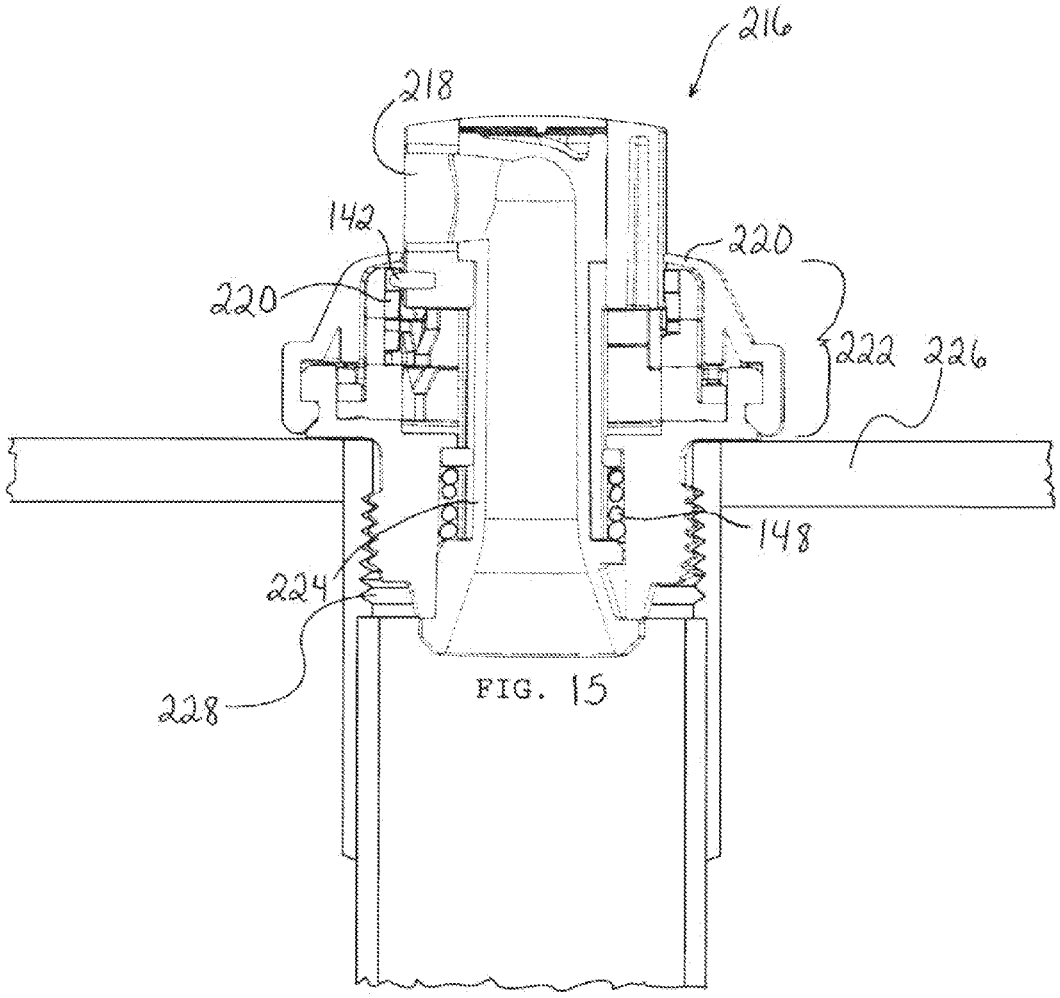
FIG. 15 is a cross-sectional view of an assembled nozzle assembly similar to that of FIG. 10, but in an extended position.

As illustrated in FIG. 9, implementations of a cleaning head assembly 124 may include a stem (sleeve) 140 that extends through the housing 132 and the cam assembly 126. In the particular implementation illustrated in FIG. 9, the stem 140 comprises at least one pin 142 that extends from a side of a head 150 (nozzle housing) that couples over the top of the stem 140. In other implementations, the at least one pin 142 may couple to other components associated with the stem 140 so that in either case (whether extending from the side of the head 150 or from some other component associated with the stem 140 or from the stem directly), the at least one pin 142 can be said to extend from the stem 140. In particular implementations of a stem 140, two or more pins 142 may be included, and the relation between the direction the pin 142 extends from the side of the stem 140 relative to the outlet 144 may range from about parallel to about perpendicular, depending upon system requirements. The pin 142 for these implementations engages with the cam assembly 124 within the upper section 128, the slidable section 131, and the lower section 130, as illustrated in FIG. 10. In particular implementations, the pin 142 may contact the edges of a plurality of saw teeth 146 within the cam assembly 126. The stem 140 may further include a spring element (coil spring) 148 (shown on FIG. 10) configured to provide bias force against the stem 140 when it is extended from the housing 132. FIG. 15 illustrates the cleaning head assembly 216 in an extended position, where the outlet 218 is raised above an upper surface of the cap ring 220 and the pin 142 is engaged against a surface of the saw teeth 220 in the upper section 6 of the cam assembly 222. In the extended position, the stem 224 is raised by water pressure force against the bias of the spring element 148. FIG. 15 also illustrates a swimming pool wall 226 with a threaded fitting 228 mounted in the wall. The cleaning head assembly 216 threadedly mates with the threaded fitting 228 in this implementation. Other coupling types are known four coupling a cleaning head assembly to a wall fitting and may equivalently be used in place of the threaded fitting shown here.

Figure 1:
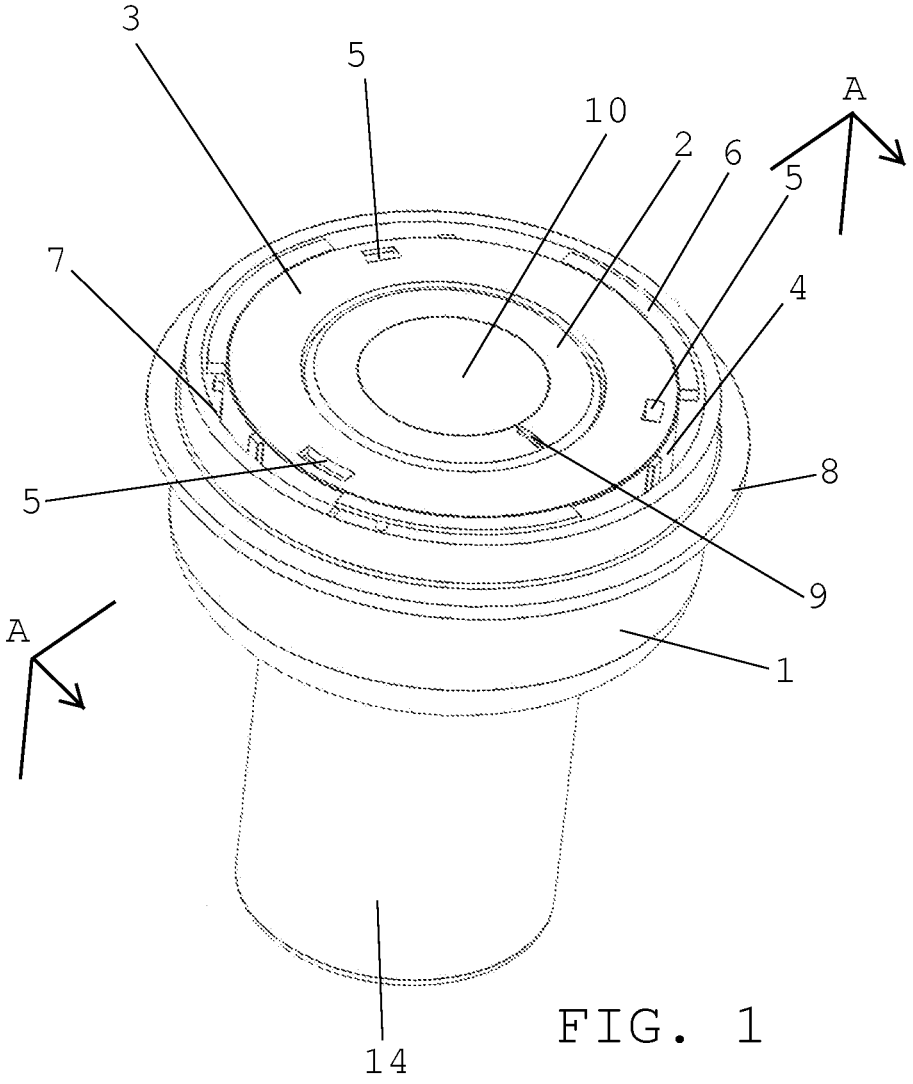
FIG. 1 is perspective view of a pool cleaning head assembly.
Figure 34:
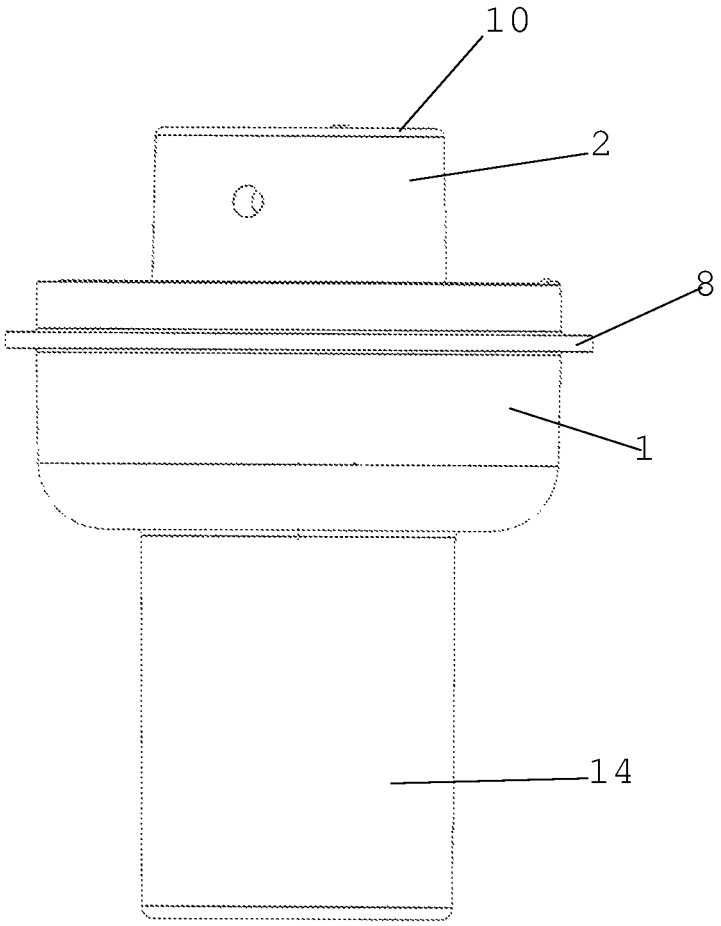
FIG. 34 is a side view of a pool cleaning head assembly in an extended position.

FIGS. 1-8 and 34 depict another embodiment of a cleaning head assembly. According to various aspects, the cleaning head assembly may comprise a variable rotating cleaning head assembly. In particular, FIG. 1 depicts a perspective view of a cleaning head assembly with the nozzle head 2 in a in a retracted position, and FIG. 34 depicts a side view of a cleaning head assembly with the nozzle head 2 in an extended, operating position. In the retracted position, the upper surface of the cleaning head assembly is substantially flush with the adjacent swimming pool surface 17 (see FIG. 2), or at least with a surface of a housing for the cleaning head assembly. In some embodiments, the cleaning head assembly comprises a body 1 comprising a hollow cylinder 14 for coupling to the interior of a plumbing pipe 57 (see FIG. 2) periodically supplying water under pressure to the cleaning head assembly. The body 1 typically further comprises a diametrically enlarged section coupled to the cylinder 14. A cap ring 3 may also be provided to finish flush with top of the body 1, a top of a retainer 4, a top of the nozzle head 2 when the nozzle head 2 is retracted, and/or the swimming pool surface 17.

In one or more embodiments, the cleaning head assembly comprises a nozzle removal flange 6 that is either coupled to or integral with the retainer 4 (also referred to as a housing or a cam housing). The nozzle removal flange is configured to provide coupling of a removal tool (not shown) in the typical manner. The cap ring 3 may further comprise one or more aiming tool ports 5 that are configured to receive a ring removal tool for operation of the cap ring 3. A nozzle removal tool recess 7 is also formed between the retainer 4 and the body 1 in one or more embodiments. The nozzle removal tool recesses are sized or otherwise configured to a receive nozzle removal tool in the conventional manner such that the retainer 4, stem 11, cam assembly 18 and nozzle head 2 are removable from the body embedded into the pool surface 17. Various embodiments of the nozzle head 2 further comprise a plate 10 coupled to the top of the nozzle head 2 and/or a nozzle direction indicator 9 that points the direction of water flow out of the nozzle head 2.

Figure 2:
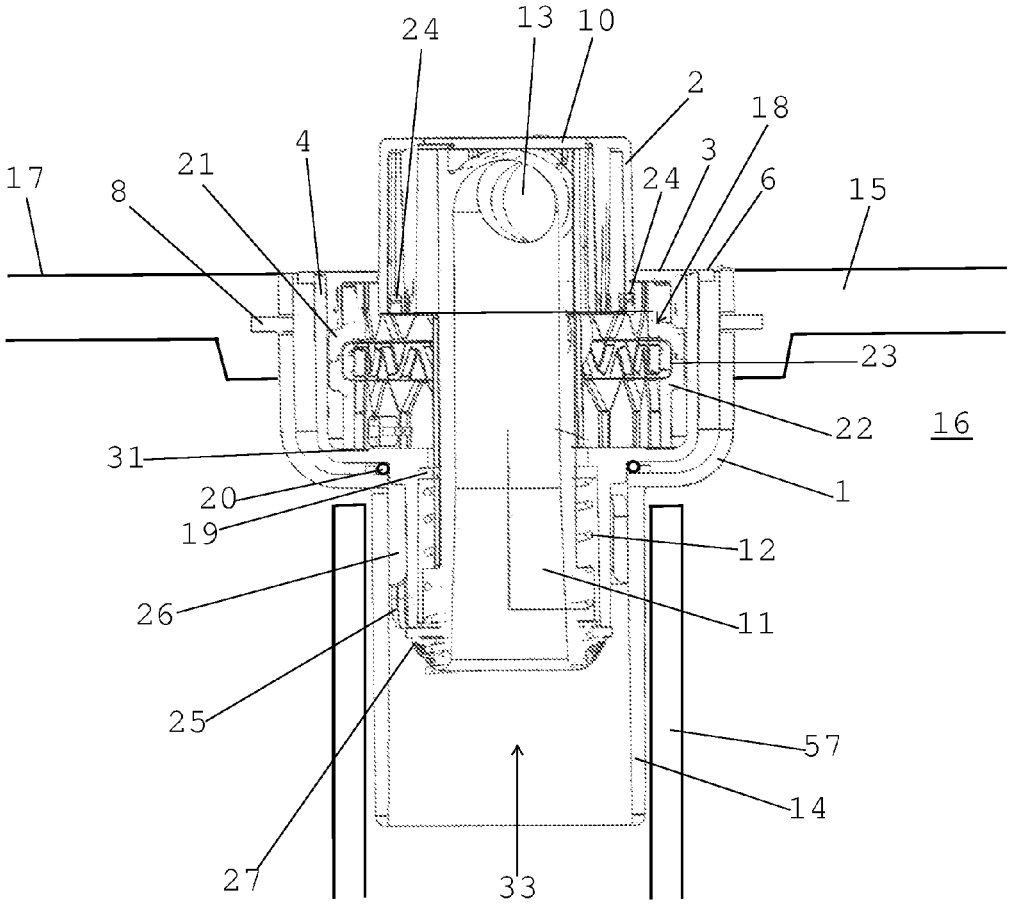
FIG. 2 is a cross-sectional view of the cleaning head assembly of FIG. 1 along line A-A with the pool cleaning head assembly being embedded in a pool surface.

With specific reference to FIG. 2, a cross-sectional view along lines A-A of the embodiment of FIG. 1 is depicted, with the nozzle head 2 in an extended position. The body 1 is configured to sealably fit in plumbing pipe 57 in the usual manner. More particularly, the cylinder 14 of the body 1 typically couples within or without the plumbing pipe 57 as is understood in the art. The body 1 is typically further configured to embed in a pool structure 16 and interior finish 15 in the conventional manner. However, while installation in a typical concrete pool is shown in FIG. 2, it is also contemplated that the body 1 could be and is adapted to be installed in any type of pool structure such as but not limited fiberglass, vinyl, steel and the like. As shown in FIG. 2, the retainer 4 typically finishes flush with interior pool surface 17 and the top of the body 1. Particular embodiments of the body 1 further comprise a plaster ring 8 that provides a water seal when the interior finish 15 is applied in the conventional manner. Furthermore, the stem 11 comprises a stop ledge 27 in one or more embodiments, the stop ledge 27 being configured to contact a lower end of the retainer 4 when the nozzle head 2 is in the raised position to limit upward movement of the stem 11 and seal a pressurized fluid flow 33 from escaping. This forces the substantially all of the fluid flow 33 through the nozzle orifice 13. The nozzle head 2 and the stem 11 are typically positionally coupled such that when one rotates, the other rotates simultaneously as the same rate and in the same direction.

The plate 10 of the nozzle head 2 is shown in FIG. 2 trapped between the top of the stem 11 and the nozzle head 2. In one or more embodiments, the cap ring 3 is removeably coupled to retainer 4 and indexed to a selected relational position. FIG. 2 also depicts a cross section view of a cam assembly 18, which shall be described in greater detail with relation to FIGS. 3-7. The cam assembly comprises an upper section 21, a lower section 22 and a slidable section 23 (also referred to as a reverser). The cap ring 3 guides the nozzle head 2 and locks the cam assembly 18 in a user-selected aimed position.

Particular embodiments of a cleaning head assembly comprise a nozzle removal flange 6 extending from the retainer 4. The nozzle removal flange 6 may be coupled to or integral with the retainer 4 and is configured to engage a nozzle removal tool in the conventional manner. The body may further comprise body installation lugs 26 in order to interface or engage with retainer installation lugs 25 for installation of the pool cleaning head assembly. Body installation lugs 26 and retainer installation lugs 25 may be indexably positioned in a desired location so the pool cleaning head assembly can be installed in only one rotatable position within the body 1, ensuring the previously set aim direction is preserved when the pool cleaning head assembly is removed and replaced for service or inspection.

One or more embodiments of a cleaning head assembly further comprise a thrust washer 19 that is slideably engaged with stem 11 and the retainer 4. The thrust washer resists wind-up of spring 12 and reduces friction between the spring 12 and the retainer 4. At least one but typically two cam pins 24 are disposed in or about the nozzle head 2 to engage the cam assembly 18. The spring 12 serves to bias the stem 11 and nozzle head 2 downwardly to a retracted position in the absence of the pressurized flow 33. In this way, the one or more pins 24 will engage the cam assembly 18 to rotate the nozzle head 2 and the stem 11 upon each pressurization and depressurization of pressurized fluid flow 33. A ring seal 20 serves to seal pressurized fluid flow 33 and add tension in the interface of body installation lugs 26 and retainer installation lugs 25.

In one or more embodiments of a cleaning head assembly, the lower section 22 of the cam assembly 18 comprises a serrated bottom 31. The serrated bottom 31 of the lower section 22 is typically configured to engage with a serrated portion of the retainer 4. Engagement between the serrated bottom 31 and the retainer 4 helps prevent undesired rotation of the cam assembly 18.

Figure 3:
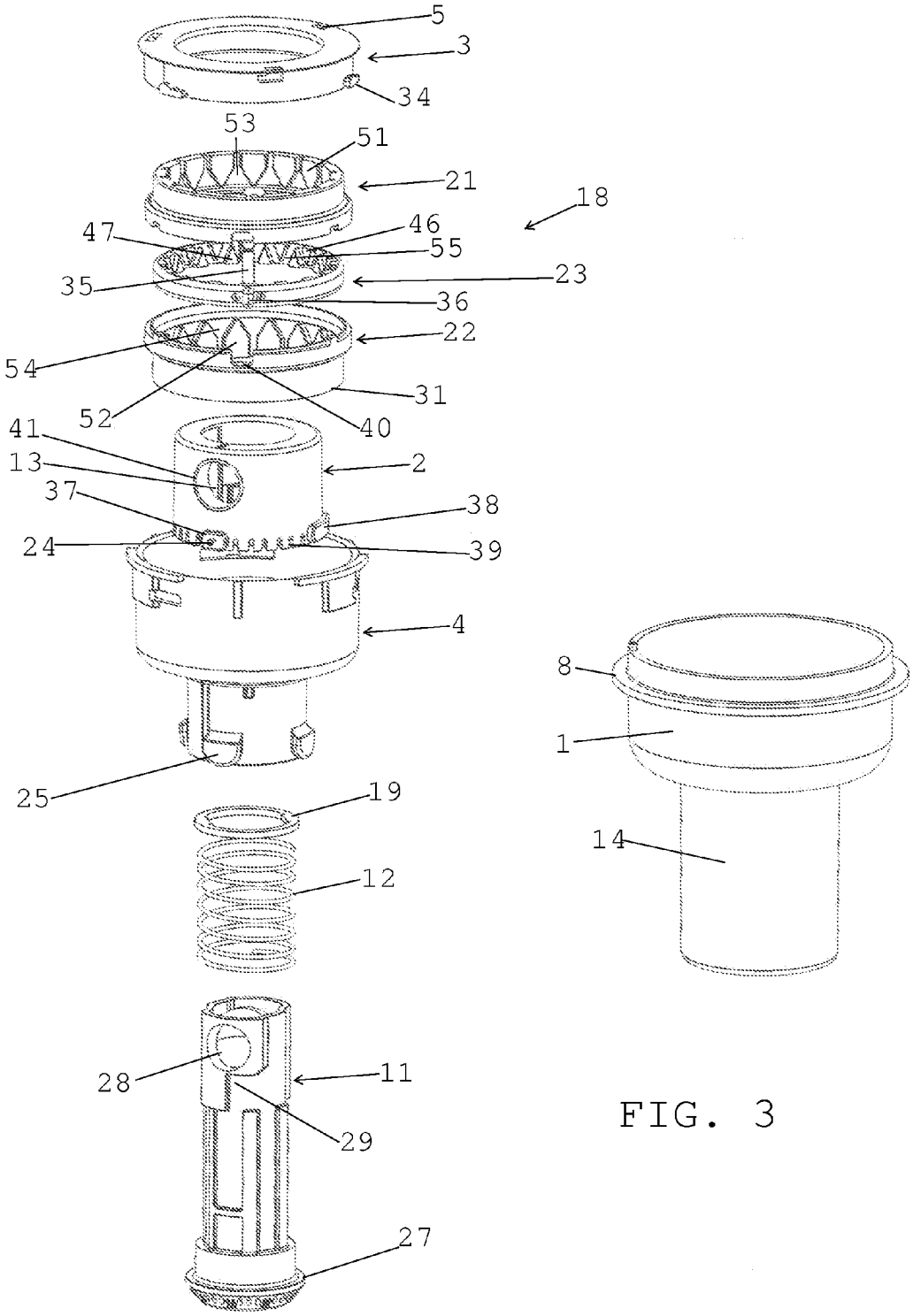
FIG. 3 is an exploded perspective view of a pool cleaning head assembly.

With particular reference to FIG. 3, an exploded perspective view of a cleaning head assembly is provided. As depicted, the cam ring 3 comprises one or more aim lugs extending therefrom and one or more aiming tool ports 5. The stem 11 may comprise any nozzle locking lug 29 as depicted or otherwise previously known in the art. The stem 11 typically further comprises a stem outlet 28 that aligns with the nozzle orifice 13 the stem is positionally coupled to the nozzle head 2, allowing water to flow through the stem 11, the stem outlet 28, and the nozzle orifice 13.

The cam assembly 18 depicted in FIG. 3 comprises an upper section 21 (also referred to as an upper cam), a lower section 22 (also referred as a lower cam), and a slidable section 23 (also referred to as a reverser). In one or more embodiments, the upper section 21 comprises a plurality of saw tooth members 51 that typically narrow downward. A pin guide 53 separates adjacent saw tooth members 51. Each pin guide 53 typically narrows upward. The saw tooth members 51 and pin guides 53 typically surround an inner portion of the upper section 21.

In one or more embodiments, the lower section 21 likewise also comprises a plurality of saw tooth members 52 that typically narrow upward. A pin guide 54 separates adjacent saw tooth members 52. Each pin guide 54 typically narrows downward. The saw tooth members 52 and pin guides 54 typically surround an inner portion of the lower section 22.

In one or more embodiments, the slidable section 23 comprises a plurality of saw tooth members 46, 47. In particular, saw tooth members of the slidable section 23 may comprise alternating upper saw tooth members 46 that narrow downward and lower saw tooth members 47 that narrow upward. The alternating saw tooth members 46, 47 of the slidable section 23 are each separated by a pin guide 55. The saw tooth members and pin guides 55 typically surround an inner portion of the slidable section 23.

Particular embodiments of the slidable section 23 further comprise a reverser arm 35 and reverser stop lug 36. The reverser arm 35 is shaped or otherwise configured to engage with a first or primary reversing tab 37 and a second or secondary reversing tab 38. The reverser arm may either removably coupled, fixedly coupled, or integral with the slidable section 23. More particularly, the reverser arm 35 may extend either upward or downward from the slidable section 23. In a particular embodiment, reverser arm 35 extends from an inner portion of the slidable section 23, and the reverser stop lug 36 extends from an outer portion of the slidable section 23.

In alternative embodiments, only a primary reversing tab 37 is required. For example, the primary reversing tab 37 may be configured such that opposing ends of the primary reversing tab 37 contacts the reverser arm 35 at different times to shift the slidable section 23 from the first extent to the second extent. More particularly, a primary end of the primary reversing tab 37 may contact the reverser 35 to shift the slidable section 23 from the first extent to the second extent. Upon changing directions, a second side of the primary reversing tab 37 will contact the reverser 35 and shift the slidable section 23 from the second extent to the first extent. In such embodiments, the primary reversing tab 37 may be elongated to a length that will produce the desired cleaning arc. More particularly, the primary reversing tab 37 may be adjustable in length to accommodate the desired cleaning arc.

In one or more embodiments, the upper section 21 and the lower section 22 are configured to coupled together with the slidable section 23 at least partially positioned between the upper section 21 and the lower section 22. The upper section 21 and lower section 22 may comprise one or more tab and/or tab receivers that are aligned with one another such that the upper section 21 and lower section 22 are positionally coupled to one another (see FIG. 8). According to one aspect, each of the upper section 21 and the lower section 22 comprise a reverser stop recess 40. When the upper section 21 and the lower section 22 are coupled together, the reverser stop recesses 40 are aligned to form an opening extending through the coupled upper section 21 and lower section 22.

Figure 8:
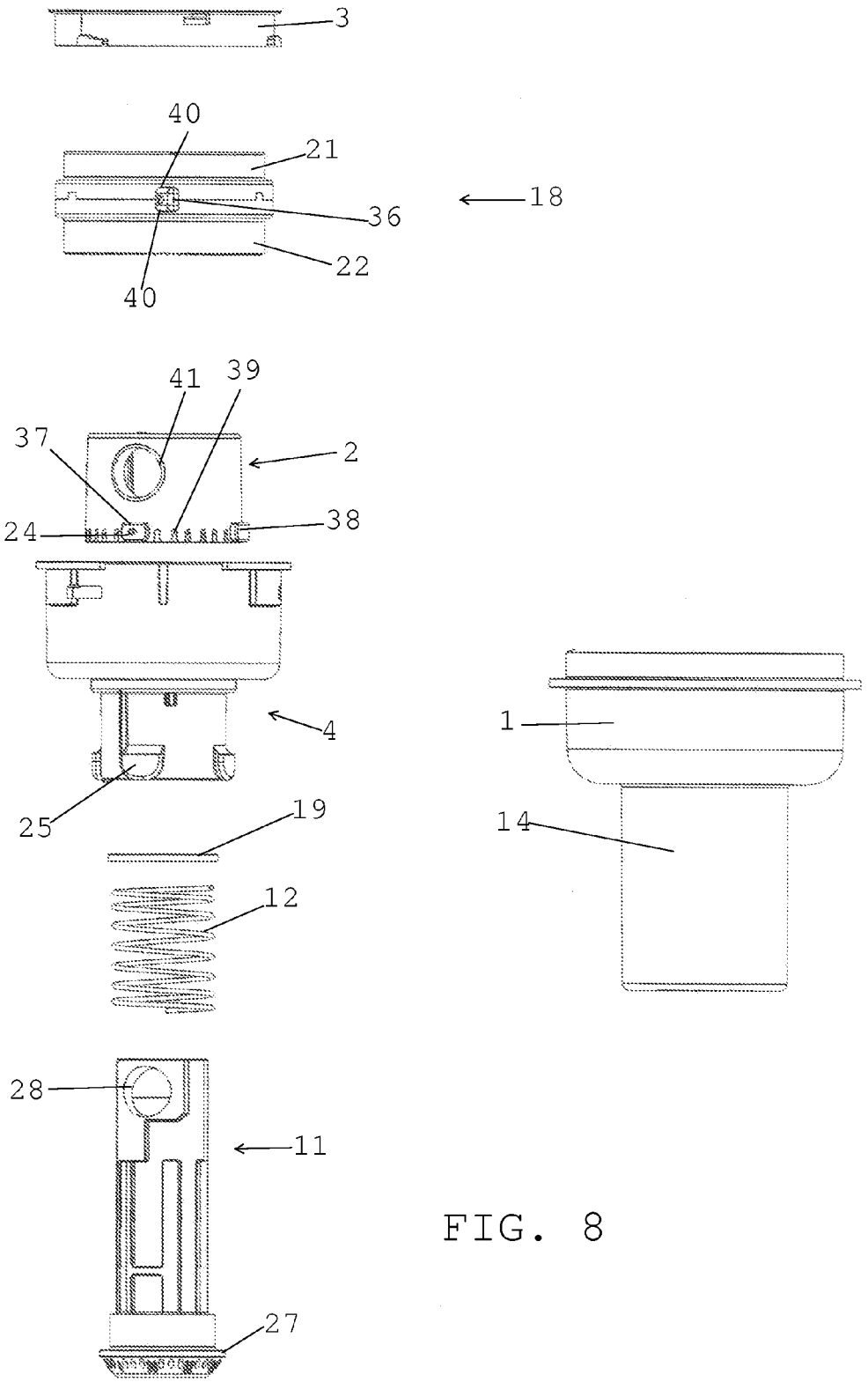
FIG. 8 depicts an exploded side view of a pool cleaning head assembly.

The slidable section 23 is configured to position within and/or between the upper section 21 and the lower section 22 in one or more embodiments when the upper section 21 and the lower section 22 are coupled together. When positioned between the coupled upper section 21 and lower section 22, the slidable section 23 is slidable or rotatable between a first extent and a second extent. Particular embodiments of the slidable section 23 comprise a reverser stop lug 36. The reverser stop lug 36 extends through the aligned reverser stop recesses 40, which act as limits to the rotational travel of the reverser arm 35 and consequently reverser 23. Specifically, the aligned reverser stop recesses 40 engage the reverser stop lug 36 to limit extent of rotation. FIG. 8 depicts the upper section 21 coupled to the lower section 22, with the reverser stop lug 36 extending through the aligned reverser stop recesses 40.

As referenced above, one or more embodiments of the nozzle head 2 comprise a primary reversing tab 37 and a secondary reversing tab 38 coupled thereto. The primary reversing tab 37 may be either fixedly or permanently coupled to the nozzle head 2 or, alternatively removably coupled to the nozzle head 2. A pin 24 typically extends from or through the primary reversing tab 37. In particular embodiments, the pin 24 anchors the reversing tab 37, 38 to the nozzle head 2. The secondary reversing tab 38 may either be fixedly or removably coupled to the nozzle head 2 and may likewise comprising a pin 24 extending therefrom or therethrough. The secondary reversing tab 38 is typically removably coupled to the nozzle head 2 and its positioning determines the extent or degrees of the cleaning arc of nozzle head 2. In one or more embodiments, the nozzle head 2 comprises tab slots 39 that engage pins on the reversing tabs 37 and/or 38 to change extent or direction of rotation. More particularly, the either the primary reversing tab 37 or the secondary reversing tab 38 may removably couple to the nozzle head 2 through engagement with one or more of the tab slots 39. Although not shown in FIG. 3, the primary reversing tab 37 and/or the secondary reversing tab 38 may comprise one or more inwardly extending pins or tabs that removably couple within the tab slots 39.

In one or more embodiments, a thrust washer 19 and a washer spring 12 slip over the stem 11. Lugs on a thrust washer 19 may engage a recess on the stem 11 in the conventional manner, slip into the lower portion of the retainer 4, and lock into the nozzle head 2 in the conventional manner. A removable nozzle insert 41 may be used to modify the nozzle diameter in the conventional manner.

With specific reference to FIGS. 4-7, a diagrammatic view of the cam assembly 18 of FIG. 3 is depicted to show operation of nozzle head 2 rotation and direction reversal in detail. It is understood that pins 24 extend outwardly and radially from the nozzle head 2 enough to interface and react with the saw tooth members 46, 47, 51, 52 and move through pin guides 53, 54, 55. In the particular embodiment diagrammed, the reverser arm 35 is coupled to an upper saw tooth member 46 of the slidable section. Thus, the reverser arm 35 is position to react or engage with the primary reversing tab 37 and the second reversing tab 38. In a particular embodiment, the reverser arm 35 is shaped and sized to move the slidable section 23 only when the one or more pins 24 is not interacting with the saw tooth members 46, 47 or pin guides 55 of the slider section.

As previously referenced, the primary reversing tab 37 is either fixedly or removably coupled to the nozzled head 2. Positioning of the primary reverser tab 37 defines a first extent of rotation of the slidable section 23 and thus rotation of the nozzle head 2. Positioning of the secondary reversing tab 38 defines a second extent of rotation of the slidable section 23 and thus rotation of the nozzle head 2. The reverser arm 35 interacts with the primary reversing tab 37 and the secondary reversing tab 38 to move the slidable section 23 and ultimately change the direction of rotation of the nozzle head 2.

Figure 4:
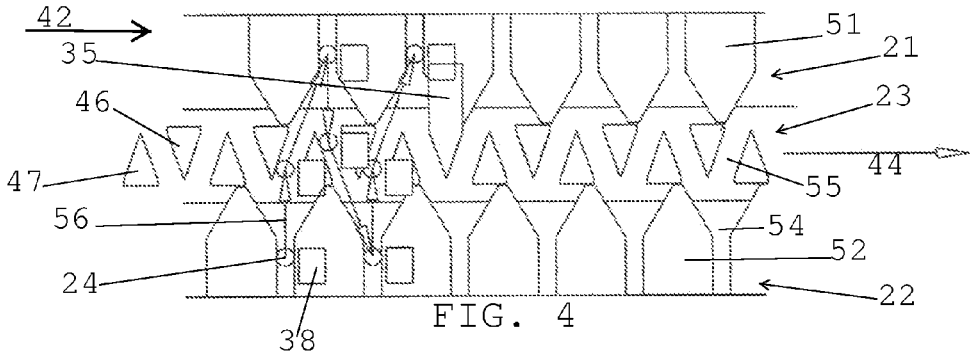
FIG. 4 diagrams a first travel path of a pin through a cam assembly of a pool cleaning head assembly.

FIG. 4 diagrams rotation of a nozzle head 2 in a first direction 42 as the pin 24 and the secondary reversing tab 38 approaches the reverser arm 35. As diagrammed, the pin 24 follows pin path 56, drawing the secondary reversing tab 38 closer to the reverser arm. Intermittent water pressure 33 through the stem 11 raises and rotates the nozzle head 2. As the pin 24 follows the pin path 56 upwards, the pin 24 interacts with an upper saw tooth member 46 that slightly rotates the nozzle head 2 by redirecting the path of the pin 24. Similarly, when water pressure through the stem 11 has ended, the springs 12 bias the stem 11 and nozzle head downward to a retracted position. As the nozzle head 2 retracts, the pin 24 interacts with a lower saw tooth member 47 that slightly rotates the nozzle head 2 by redirecting the path of the pin 24. This process is repeated until the secondary reversing tab 38 contacts the reverser arm 35. When the secondary reversing tab 38 contacts the reverser arm 35, the slidable section 23 is shifted in the same direction 44 as rotation of the nozzle head 2 in the first direction 42, thus sliding the slidable section 23 from the first extent to the second extent.

Figure 5:
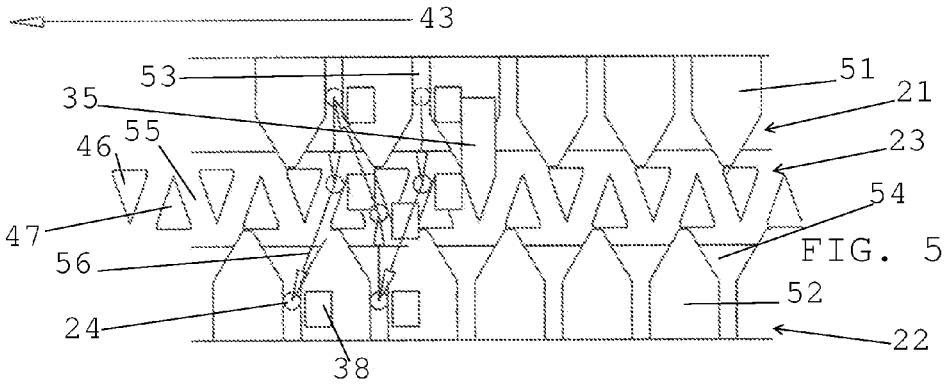
FIG. 5 diagrams a second travel path of a pin through a cam assembly of the cleaning head assembly.

FIG. 5 diagrams the slidable section 23 after having slid to from the first extent to the second extent. Rotation of the slidable section 23 alters the pin path 56 such that rotation of the nozzle head 2 is reversed from the first direction 42 to a second direction 43. Similar to the description presented in relation to FIG. 4, intermittent water pressure through the stem 11 results in the pin 24 following guide 56, only now the pin 24 travels in an opposite direction due to the shift of the slidable section 23 from the first extent to the second extent. As the pin 24 follows pin path 56, the nozzle head 2 rotates in the second direction 43. In FIG. 5, neither the primary reversing tab 37 nor the secondary reversing tab 38 contacts the reverser arm 35, and thus the slidable section 23 does not shift. Rotation of the nozzle head 2 continues in the second direction 43 until the slidable section 23 is again shifted.

Figure 6:
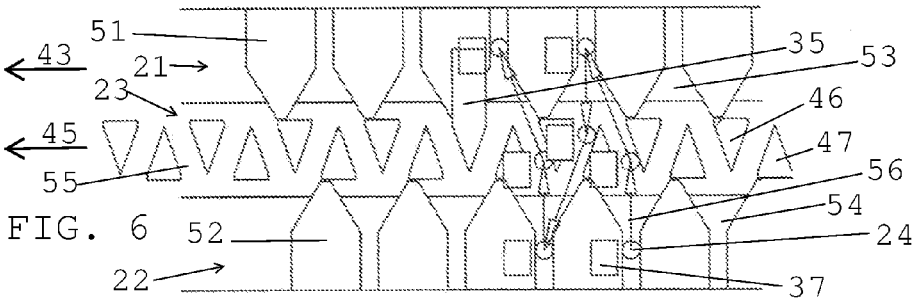
FIG. 6 diagrams a third travel path of a pin through a cam assembly of a cleaning pool cleaning head assembly.

FIG. 6 diagrams rotation of a nozzle head 2 in the second direction 43 as the pin 24 and the primary reversing tab 37 approaches the reverser arm 35. As diagrammed, the pin 24 follows pin path 56, drawing the primary reversing tab 37 closer to the reverser arm 35. Intermittent water pressure 33 through the stem 11 raises and rotates the nozzle head 2. As the pin 24 follows the pin path 56 upwards, the pin 24 interacts with an upper saw tooth member 46 that slightly rotates the nozzle head 2 by redirecting the path of the pin 24. Similarly, when water pressure through the stem 11 has ended, the springs 12 bias the stem 11 and nozzle head downward to a retracted position. As the nozzle head 2 retracts, the pin 24 interacts with a lower saw tooth member 47 that slightly rotates the nozzle head 2 by redirecting the path of the pin 24. This process is repeated until the primary reversing tab 37 contacts the reverser arm 35. When the primary reversing tab 37 contacts the reverser arm 35, the slidable section 23 is shifted in the same direction 45 as rotation of the nozzle head 2 in the second direction 43, thus sliding the slidable section 23 from the second extent to the first extent.

Figure 7:
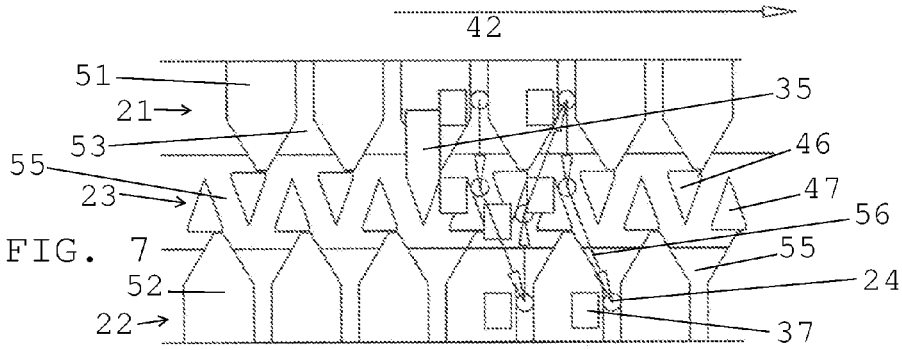
FIG. 7 diagrams a fourth travel path of a pin through a cam assembly of a pool cleaning head assembly.

FIG. 7 diagrams the slidable section 23 after having slid to from the second extent to the first extent. As previously described, rotation of the slidable section 23 alters the pin path 56 such that rotation of the nozzle head 2 is reversed from the second direction 43 back to the first direction 42. Similar to the description presented above, intermittent water pressure through the stem 11 results in the pin 24 following guide 56, only now the pin 24 travels in an opposite direction due to the shift of the slidable section 23 from the first extent to the second extent. As the pin 24 follows pin path 56, the nozzle head 2 rotates in the second direction 42. In FIG. 7, neither the primary reversing tab 37 nor the secondary reversing tab 38 contacts the reverser arm 35, and thus the slidable section 23 does not shift. Rotation of the nozzle head 2 continues in the first direction 42 until the slidable section 23 is again shifted.

As has been demonstrated by the diagrams of FIGS. 4-7, embodiments of the pool cleaning head assembly described herein establish a cleaning arc for the cleaning head assembly. That is, the nozzle orifice 13 of the nozzle head rotates a certain value of degrees between shifting of the slidable section 23 from the first extend to the second extent. As briefly referenced above, positioning of the primary reversing tab 37 and secondary reversing tab 38 determines when the slidable section is shifted, and thus indicates the degree of the cleaning arc of the cleaning head assembly. In embodiments wherein at least one of the primary reversing tab 37 and the secondary reversing tab 38 are removably coupled to the nozzle head 2, the degree of the cleaning arc is adjustable by movement of either of the reversing tabs 37, 38 to a desired position. In a particular embodiment, the cleaning arc is adjustable between approximately 23 and 360 degrees.

As shall be described in greater detail below, embodiments of the pool cleaning head assembly disclosed herein are advantageous to those previously known in the because proper positioning of the pool head assembly ensures that debris is constantly being moved toward the drain of the pool. Providing a pool cleaning head assembly comprising an adjustable cleaning arc provides additional advantages to previous cleaning head assemblies because a user is now able to adapt the pool cleaning head assembly for the particularities of individual pools.

In one or more embodiments, an aiming tool is used to direct the cleaning pattern. The aiming tool may be configured to pick up on a keying feature in the body 1 embedded in the pool surface 17. In a particular embodiment, the aiming tool comprises a visual arc that is adjustable to the pre-determined or desired cleaning arc for that particular cleaning head assembly location. The arc may then be adjusted and the tool is inserted into the key body. The tool may then be rotated until the arc is at the desired orientation, and the tool is removed from the body 1. In particular embodiments, an indicator on the tool lines up with a number. This number corresponds with a number on the tool used to lock the nozzle cover down. The nozzle cover may be loosened and the cleaning head assembly may be turned until an indicator on the top of the cleaning head assembly lines up with the number from the aiming tool. This puts the cleaning head assembly at the beginning side of the cleaning arc. The cleaning head assembly may then be installed into the body 1 in the pool.

Figure 41:
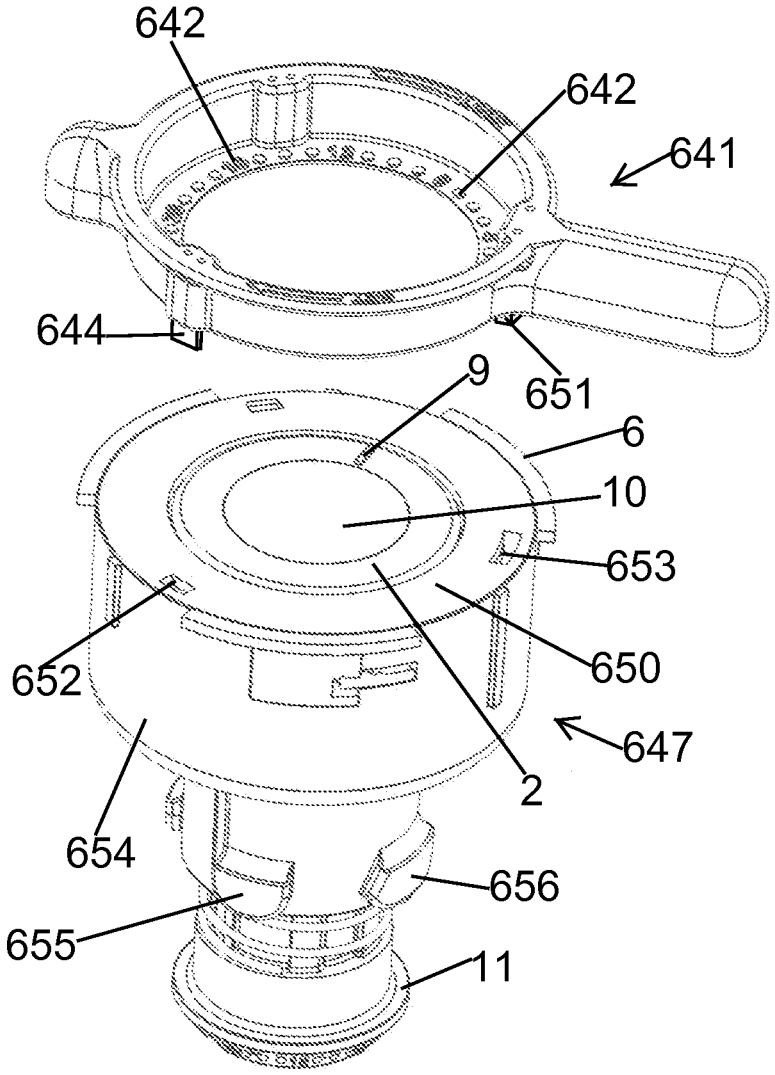
FIG. 41 is a perspective view of a locking tool and a variable rotating cleaning nozzle assembly disengaged from one another.
Figure 42:
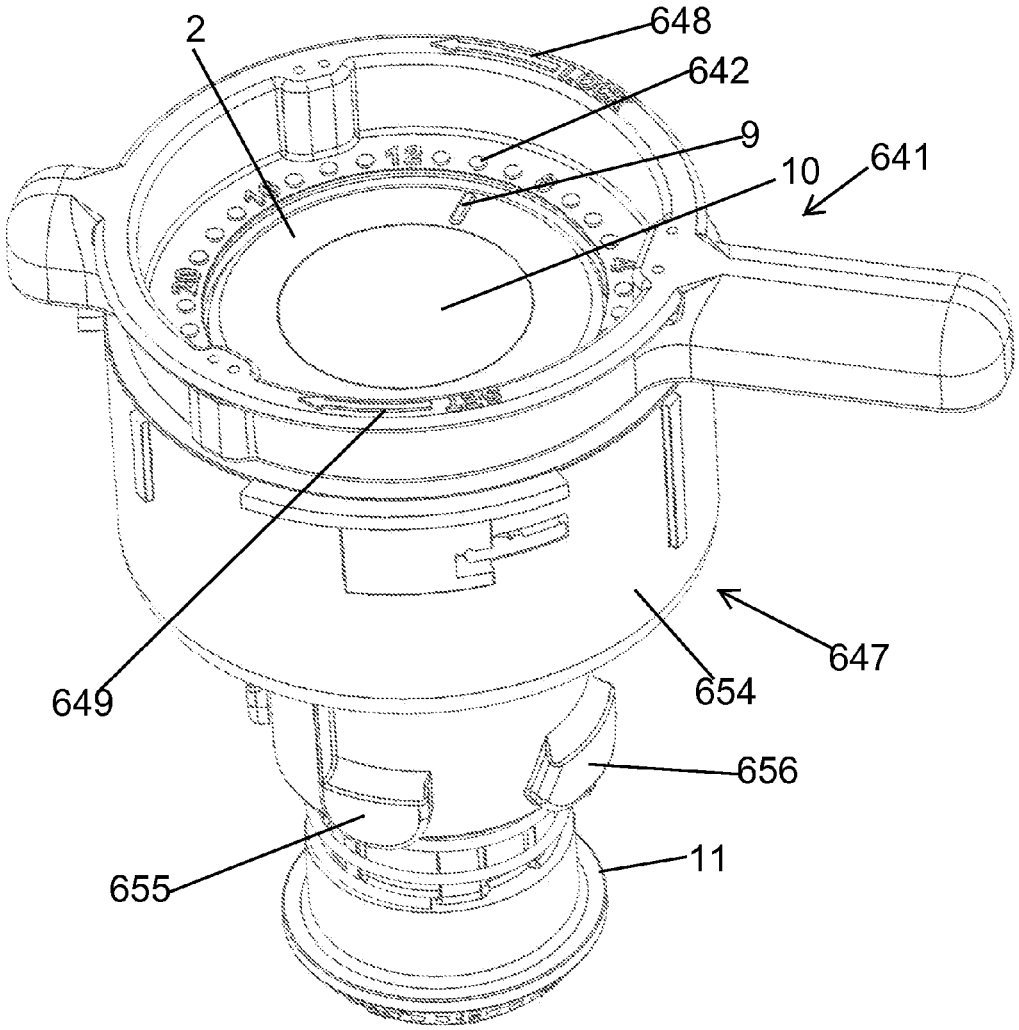
FIG. 42 is a perspective view of a locking tool and variable rotating cleaning nozzle assembly engaged with one another.

FIGS. 35-40 depict various views of one particular, non-limiting embodiment of an aiming tool 600 and FIGS. 41-42 depict various views of one particular, non-limiting embodiment of a locking tool 641. The aiming tool 600 and locking tool 641 may be sold together in a kit or separately and independently from one another. In describing the aiming tool 600 and locking tool 641, reference is made to a variable rotating cleaning nozzle assembly 647. It is contemplated that the variable rotating cleaning nozzle assembly 647 may comprise any cleaning head assembly, nozzle assembly, and the like disclosed in this document or otherwise known in the art, though the aiming tool is useful for those cleaning nozzle assemblies with a directional component to their operation.

Figure 36:
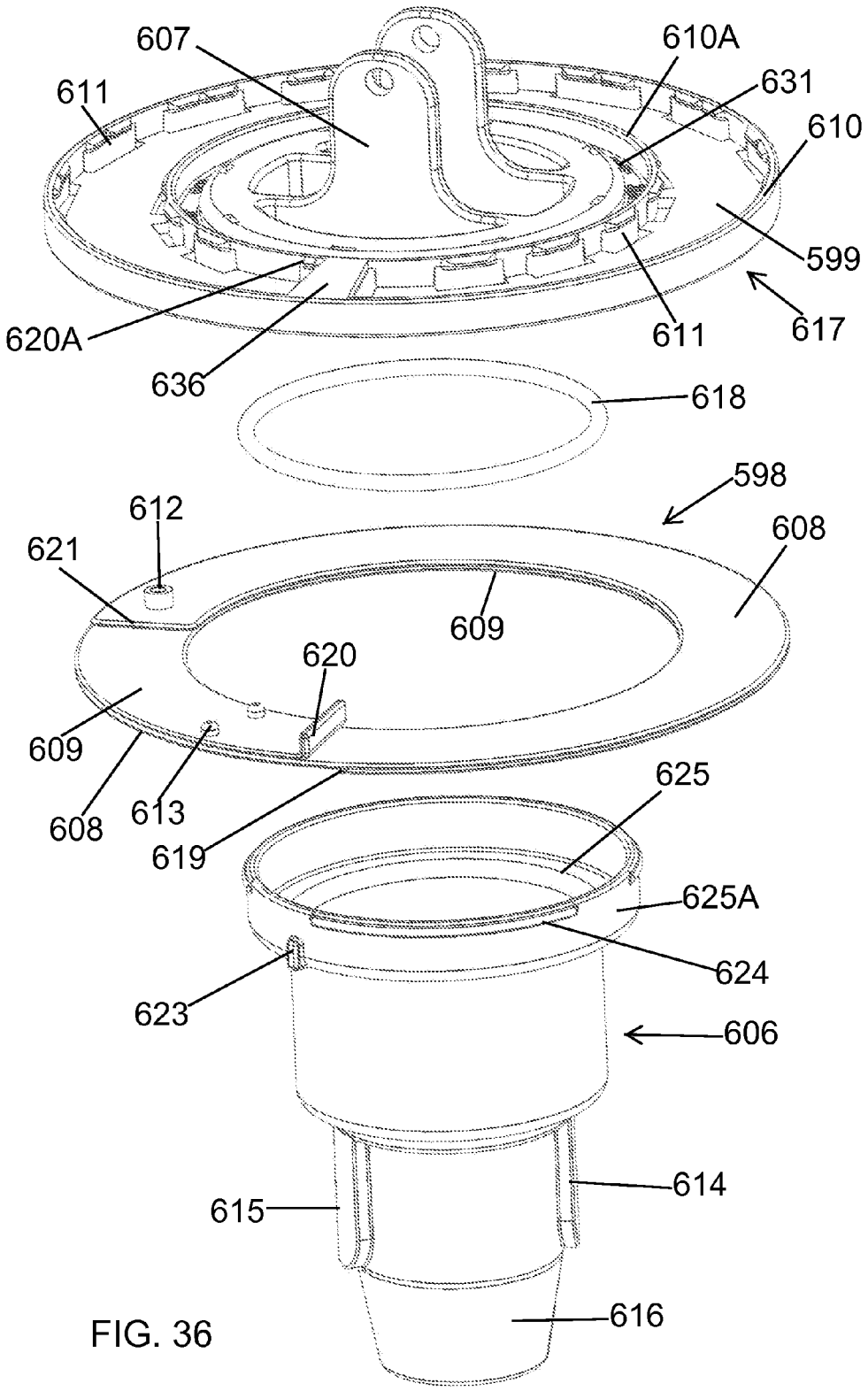
FIG. 36 is an exploded perspective view of the aiming tool of FIG. 35.
Figure 37:
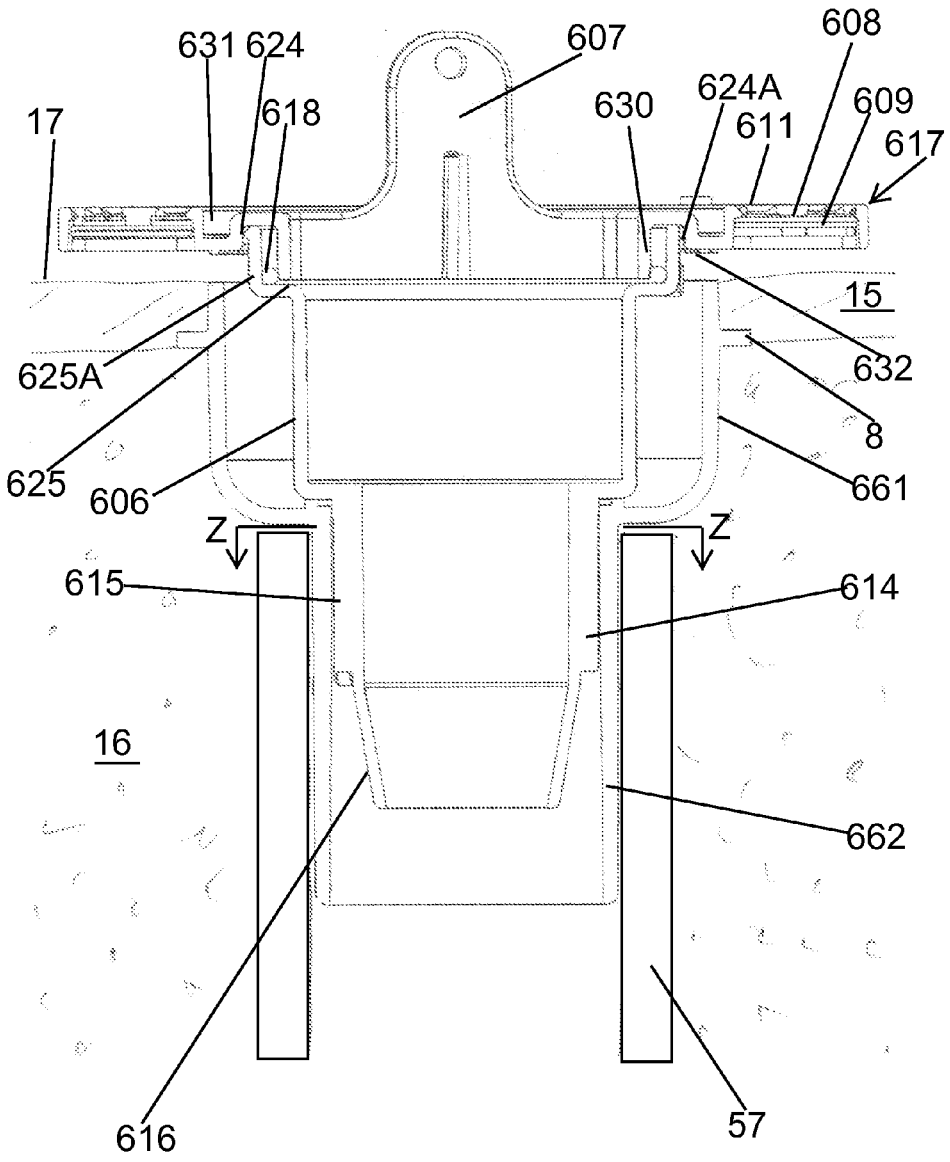
FIG. 37 is a cross-sectional view of the aiming tool of FIG. 35 taken along line Y-Y.
Figure 38:
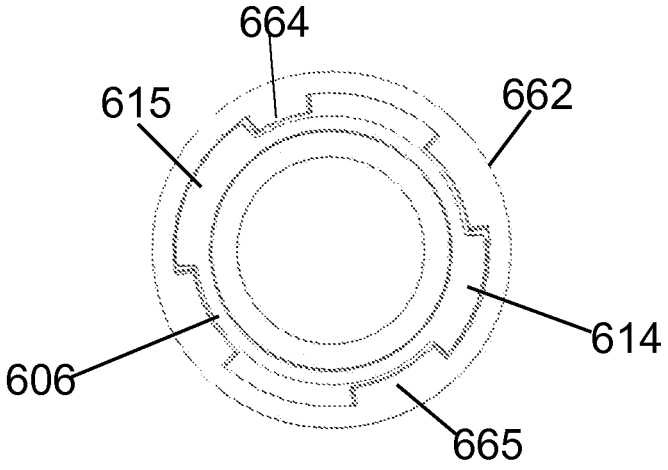
FIG. 38 is a cross-sectional view of a portion of the aiming tool of FIG. 37 taken along line Z-Z.

Various embodiments of the aiming tool 600 and variable rotating cleaning nozzle assembly 647 are uniquely adapted for use with a body 661. Unless otherwise specified, the body 661 is typically configured similar to the body 1 described elsewhere in this document. FIG. 36 depicts a cross-sectional side view of a non-limiting embodiment of a body 661, and FIG. 37 depicts a cross-sectional top view of a non-limiting embodiment of a hollow cylinder 662 of a body 661 and a portion of the base 606 of the aiming tool 600. In one or more embodiments, the hollow cylinder 662 of the body 661 comprises a plurality of body installation lugs. The body installation lugs may be configured similar to the body installation lugs 26 described elsewhere in this document. In particular embodiments, the plurality of body installation lugs comprise one or more major body installation lugs 665 and one or more minor body installation lugs 664. In the particular embodiment of a body 661 depicted in FIG. 38, the body 661 comprises three major body installation lugs 665 and one minor body installation lug 664. The combination of a plurality of major body installation lugs 665 and at least one minor body installation lug 664 allows an individual to determine the relative rotation orientation of the body 661 in the pool structure 16, particularly when used in combination with an aiming tool 600 comprising one or more major indexing lugs 615 and one or more minor indexing lugs 614.

Figure 35:
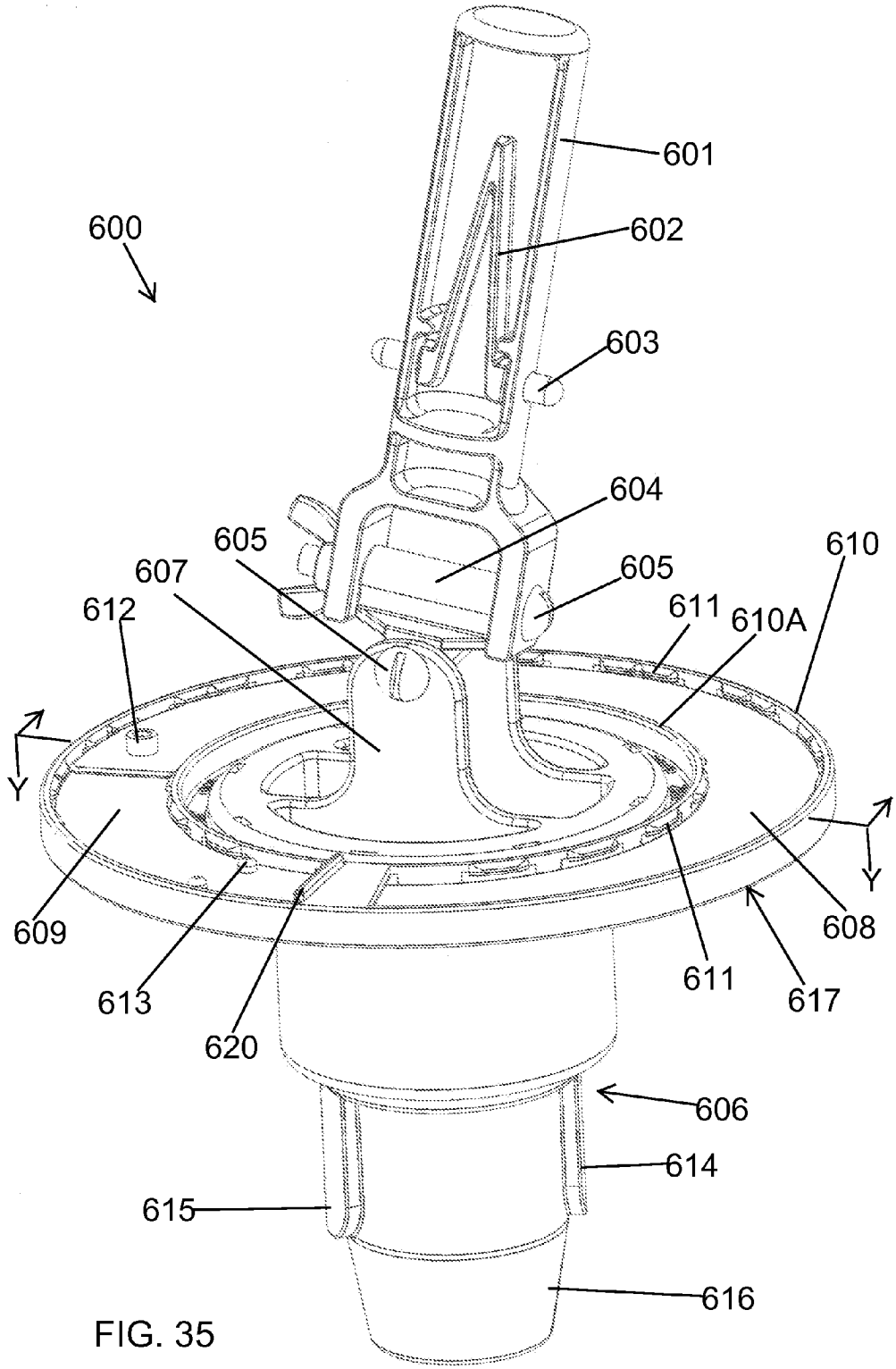
FIG. 35 is a perspective view of an aiming tool.

FIG. 35 depicts a perspective view of a non-limiting embodiment of an aiming tool 600, and FIG. 36 depicts an exploded view of the non-limiting embodiment of the aiming tool 600 of FIG. 35. One or more embodiments of an aiming tool comprise a base 606, a tray 617 rotatably coupled to the base 606, and a cleaning arc indicator 598 coupled to the tray 617. The base 606 of the aiming tool 600 is typically sized and configured to fit within a body 661 embedded in an pool structure 16 (shown in FIG. 37), the body 661 corresponding to the variable rotating cleaning nozzle assembly 647. FIG. 37 depicts a cross-sectional view taken along line Y-Y of FIG. 35 of an aiming tool 600 positioned within a body 661, the body 661 being mounted with a pool structure 16 and coupled to a plumbing pipe 57.

In one or more embodiments, the base 606 comprises a narrow portion sized to fit within the hollow cylinder 662 of the body 661. Typically, one or more indexing lugs 614, 615 extend outward from the base 606 at the narrow portion. The one or more indexing lugs 614, 615 are sized to fit between body installation lugs 664, 665 of the body 661, as shown in the cross-sectional figure of FIG. 38. In a particular non-limiting embodiment, the one or more indexing lugs 614, 615 comprise at least two indexing lugs 614, 615. The at least two indexing lugs 614, 615 comprise a first or major indexing lug 615 and a second or minor indexing lug 614 according to one aspect. The major indexing lug 615 is sized larger than the minor indexing lug 614 in some embodiments. Thus, the distance between the body installation lugs 664, 665 of the body 661 may differ to allow the major indexing lug 615 to fit within the hollow cylinder 14 in only one orientation. For example, in the non-limiting embodiment shown in FIG. 38, the major indexing lug 615 interfaces with the minor body installation lug 664, while the minor indexing lug 614 does not interface with the minor body installation lug 664. Interfacing of the indexing lugs 614, 615 and the body installation lugs 664, 665 when the base 606 is inserted into the body 661 establishes the relative rotational orientation of the body 661 as mounted in the pool structure 16 because the base 606 can only be full inserted into the hollow cylinder 662 of the body 661 in one orientation due to the combination of the major and minor body installation lugs 615, 614 and indexing lugs 665, 664.

The base 606 further comprises an aiming reference marker 632 (FIG. 37). The aiming reference marker 632 may comprise any protrusion, symbol, or other designation observable on the base 606 when the base 606 is coupled to the tray 617. In a particular non-limiting embodiment, the aiming reference marker 632 comprises a protrusion at an upper end of the base 606. In combination with the aiming reference figures 632 of the tray 617, the aiming reference marker 623 allows a user to establish the relative rotational orientation of the body 661 mounted in the pool structure 16 for subsequent application to the to locking tool 641 and variable rotating cleaning nozzle assembly 647.

The base 606 further comprises a tapered lower end 16 in one or more embodiments to ease the insertion of the base 606 into the body 661. An upper end of the base 606 is rotatably coupled to the tray 617, typically at a second or lower side of the tray 617. In a particular embodiment, base 606 is rotatably coupled, whether removably or fixedly, to the tray 617 with snap-by coupling between a lower base retainer ledge 624 and an upper barrel ledge 624A (shown in FIG. 37). The base 606 typically further comprises an outer friction ledge 625A adjacent the upper end of the base 606 and a lip 625 adjacent the outer friction ledge 625A.

The aiming tool 600 typically comprises a tray 617 rotatably coupled to a base 606. The tray 617 may comprise any shape or configuration that allows for rotation of the tray 617 relative to the base 606 and coupling of the cleaning arc indicator 598 to the tray 617. In a particular embodiment, the tray 617 is substantially circular in shape, having a channel 599 formed between an outer rim 610 and an inner rim 610A of the tray 617. In a non-limiting embodiment, the tray 617 comprises one or more ring retainer bosses 611 that couple the cleaning arc indicator 598 to the tray 617. The one or more ring retainer bosses may be spaced along the inner diameter of the outer rim 610 and/or the outer diameter of the inner rim 610A. The one or more ring retainer bosses are configured to coupling, whether removable or fixed, of the cleaning arc indicator 598 to the tray 617.

One or more embodiments of a tray 617 further comprise at least one retainer boss 620A and a stop boss 620. The at least one retainer boss 620A and stop boss 620 are positioned to positionally couple the cleaning arc indicator 598 to the tray 617. More specifically, the at least retainer boss 620A and stop boss 620 are positioned to prevent any significant or substantial movement of at least a portion of the cleaning arc indicator 598 when the cleaning arc indicator 598 is coupled to the tray 617. In a particular non-limiting embodiment, the at least one retainer boss 620A comprises two retainer bosses 620A positioned on opposing sides of the channel 599, while the stop boss 620 comprises a cross member extending across the channel 599 between the outer rim 610 and inner rim 610A of the tray. In one or more embodiments, the tray 617 may comprise an aperture adjacent the stop boss 620.

One or more embodiments of a tray 617 further comprise an inner friction ledge 630. The inner friction ledge 630 is typically positioned to contact a friction ring 618, such as but not limited to an O-ring, disposed between the inner friction ledge 630 and the outer friction ledge 625A of the base 606. The friction ring 618 is depicted in the exploded view of FIG. 36 and the cross sectional view of FIG. 37. Frictional engagement and contact between the friction ring 618 and the inner friction ledge 630 and the outer friction ledge 625A inhibits the tray 617 from freely rotating about the base 606 unless acted upon by manual forces. For example, the tray 617 typically does not rotate under the ambient forces of gravity or environmental forces of wind or water flow due to the frictional engagement of the friction ring 618 and the inner friction ledge 630 and the outer friction ledge 625A. However, the friction ring 618 allows for easy rotation of the tray 617 relative to the base 606 by manual operation such by hand or with a pool pole coupled to the tray 617.

One or more embodiments of a tray 617 further comprise one or more sweep pattern indicators 631 positioned around the tray 617. In a particular embodiment, the sweep pattern indicators 631 are positioned on a first or upper side of the tray 617. The pattern figures 631 may comprise any figures, numerals, or other indicators that allow a user to determine the approximate radial degree of an adjustable visible area 609 on the cleaning arc indicator 598. In one particular non-limiting embodiment, the sweep pattern indicators 631 comprise a plurality of radial degree figures. The sweep pattern indicators 631 may be placed substantially equal distance from one another beginning at 0 degrees and ending at 359 degrees. The 0 degree sweep pattern marker 631 is typically aligned with between the at least one retainer boss 620A and the stop box 620. In a particular non-limiting embodiment, the sweep pattern indicators 631 comprise radial degree markers for 0, 23, 45, 68, 90, 113, 158, 180, 203, 225, 248, 270, 293, 315, and 338 degrees.

FIG. 8 depicts a lower perspective view of a tray 617 rotatably coupled to a base 606. One or more embodiments of a tray 617 further comprise one or more aiming reference figures 632 positioned around the tray 617. In a particular non-limiting embodiment, a plurality of aiming reference figures 632 are positioned on a second or lower side of the tray 617. The one or more aiming reference figures 632 may comprise any symbol, letter, number, or other figure. In the non-limiting embodiment shown in FIG. 8, the aiming reference figures 632 comprise numbers, spaced equally apart, from 1 to 32. When the base 606 is inserted into the body 661, the tray 617 is rotated to align the adjustable visual area of the cleaning arc indicator 598 with the selected sweep pattern. Rotating the tray 617 to align the adjustable visual area of the cleaning arc indicator 598 with the selected sweep pattern also aligns the aiming reference marker 623 of the base 606 with one of the plurality of aiming reference figures 632. This establishes a relative rotational orientation of the body 661 that may subsequently be applied to the variable rotating pool cleaning nozzle assembly 647 with the locking tool 641.

A cleaning arc indicator 598 is typically coupled to or integral with the tray 617. The cleaning arc indicator 598 comprises an adjustable visual area representing a cleaning arc of a variable rotating pool cleaning nozzle assembly 647 to be mounted in the body 661. More specifically, the adjustable visual area is adjustable to match the cleaning arc of the variable rotating pool cleaning nozzle assembly 647. For example, the variable rotating pool cleaning nozzle assembly 647 may be set to have a cleaning arc of approximately 45 degrees. The adjustable visual area of the cleaning arc indicator may be adjusted to display approximately a 45 radial degrees area on the cleaning arc indicator 598. As shall be described in greater detail below, this allows a user to align the adjustable visual area and ultimately the cleaning arc of the variable rotating pool cleaning nozzle assembly 647 with selected sweep pattern in a pool.

In a particular non-limiting embodiment, the cleaning arc indicator 598 comprises a first or movable ring 608 and a second or static ring 609 interleaved together. More specifically, the first ring 608 and second ring 609 may be interleaved together in a single spiral relationship. The exploded view of FIG. 36 depicts the interleaving relationship of the first ring 608 and the second ring 609. The first ring 608 is typically rotable or movable in relation to the second ring 609 when the cleaning arc indicator 598 is coupled to the tray 617, while the second ring 609 is typically static in relation to the 617 when the cleaning arc indicator 598 is coupled thereto. As the first ring 608 rotates relative to the static second ring 609, more or less of the second ring 609 is covered by the first ring 608. The adjustable visual area of the cleaning arc indicator 598, then, comprises the area of the second ring 609 not covered by the first ring 608.

In one or more embodiments, the cleaning arc indicator 598 comprises a start boss 620, typically protruding from one end of the second ring 609. As described above, the start boss 620 may be positioned between the retainer boss 620A and the stop boss 620 to positionally couple the second ring 609 to the tray 617. The positional coupling of the second ring 620 to the tray 617 substantially prevents significant movement or rotation of the second ring 609 relative to the tray 617. The cleaning arc indicator 598 may further comprise one or more minimum rotation bosses 613 protruding from the second ring 609. The one or more minimum rotation bosses 613 are positioned to prevent the first ring 608 from covering the second ring 609 between the one or more minimum rotation bosses 613 and the start boss 620. The area of the second ring 609 between the one or more minimum rotation bosses 613 and the start boss 620 represents the minimum cleaning arc of the variable rotating pool cleaning nozzle assembly 647, typically approximately 23 degrees. The cleaning arc indicator 598 further comprises a finger boss 612 protruding from the first ring 608. The finger boss 608 facilitates manual rotation of the first ring 608 in order to increase or decrease the area of second ring 609 covered by the first ring 608. In one or more embodiments, the first ring 608 and second ring 609 are different colors. In such an embodiment, the tray 617 may comprise the same color as the first ring 608. Contrasting colors of the first ring 608 and second ring 609 allow for greater visibility of the uncovered second ring area when under water.

Figure 39A:
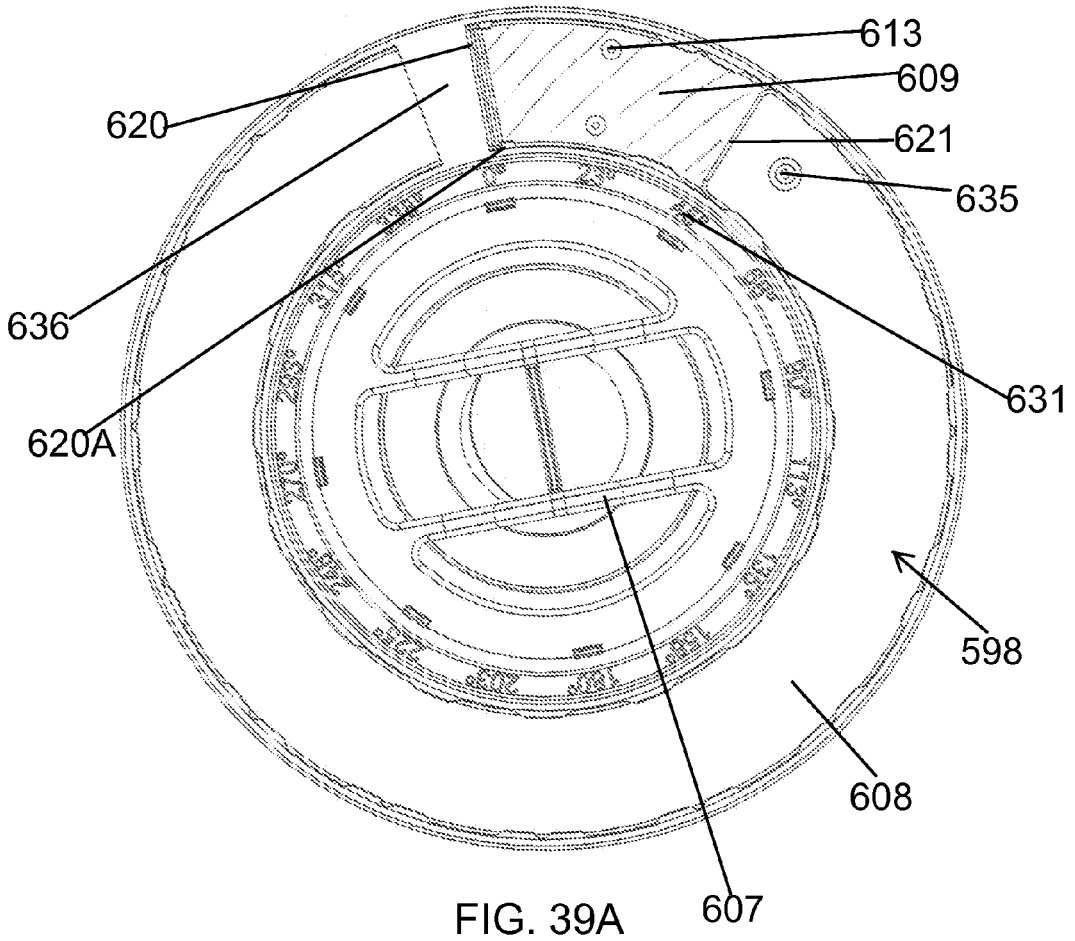
FIGS. 39A-D are top views of an aiming tool with the adjustable visual area of the cleaning arc at various degrees of exposure indicating different sweep patterns.

FIGS. 39A-D depicts a top view of the cleaning arc indicator 598 coupled to the tray 617 and at various cleaning arc degrees. The adjustable visual area is typically adjustable between 23 and 338 degrees, which equals the potential variations of a non-limiting embodiment of a variable rotating pool cleaning nozzle assembly 647. In FIG. 39A, the cleaning arc indicator 598 is set to a 45 degree cleaning arc by rotating the first ring 608 until approximately 45 degrees of the second ring 609 is uncovered. Thus, the terminating or first end 621 of the first ring 608 is aligned with 45 degree sweep pattern indicator 631. Such positioning would likely be utilized to align a variable rotating pool cleaning nozzle assembly 647 exemplified as 444 in FIG. 30. The sweep pattern indicators 631 provide an approximate measurement of the degree of uncovered second ring 608, or the degree of the cleaning arc.

Figure 39B:
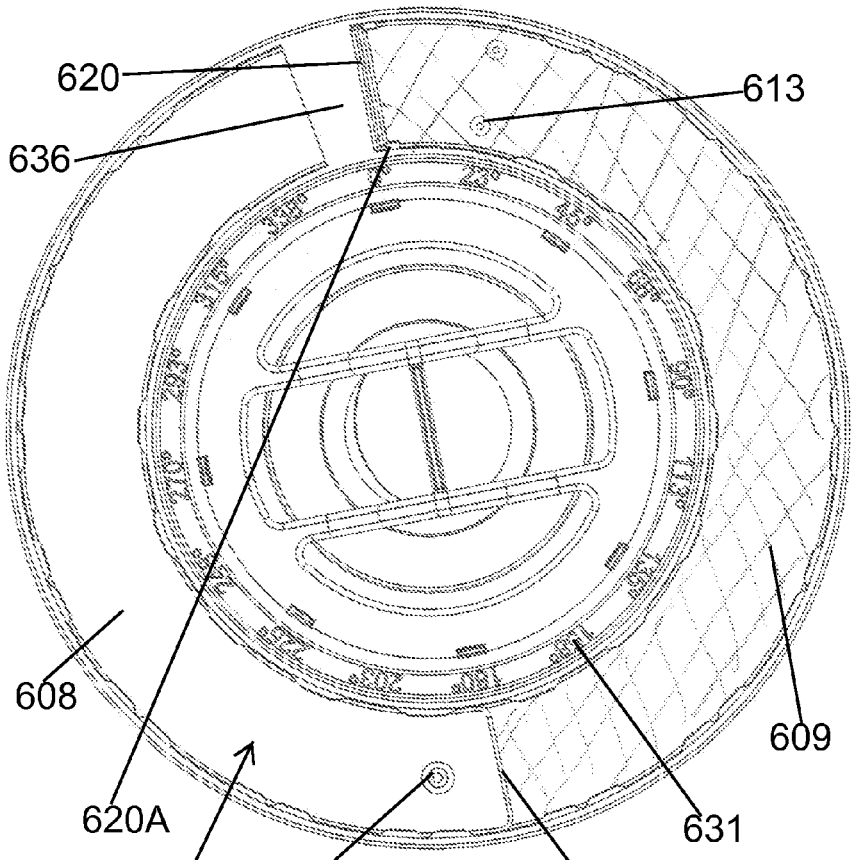

In FIG. 39B, the cleaning arc indicator 598 is set to a 180 degree cleaning arc by rotating the first ring 608 until the first end 621 of the first ring 608 is aligned with the 180 degree sweep pattern indicator 631. Such positioning would likely be utilized to align a variable rotating pool cleaning nozzle assembly 647 exemplified as 386 in FIG. 25, 398 in FIG. 26, 418 in FIG. 27, 424 in FIG. 28, 436 in FIG. 29, 448 in FIG. 30, and 468 in FIG. 31.

Figure 39C:
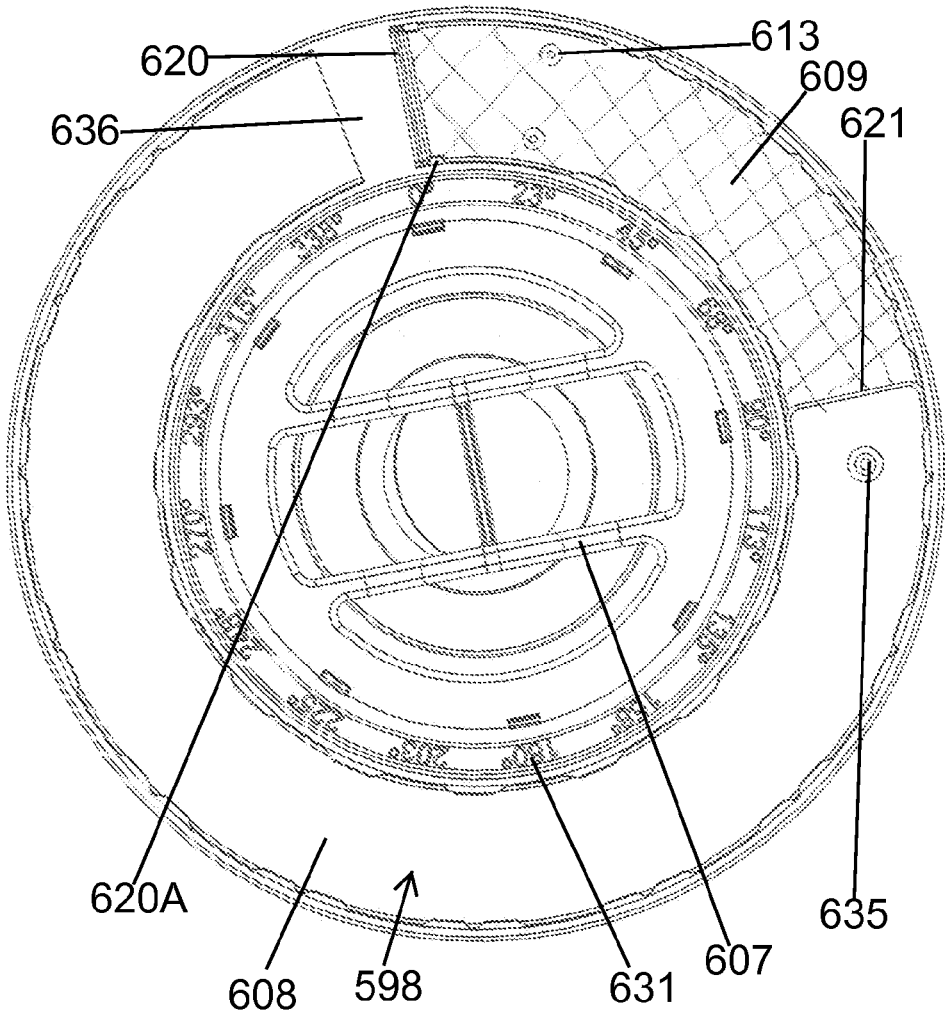

In FIG. 39C, the cleaning arc indicator 598 is set to a 90 degree cleaning arc by rotating the first ring 608 until the first end 621 of the first ring 608 is aligned with the 90 degree sweep pattern indicator 631. Such positioning would likely be utilized to align a variable rotating pool cleaning nozzle assembly 647 exemplified as 426 in FIG. 28.

Figure 39D:
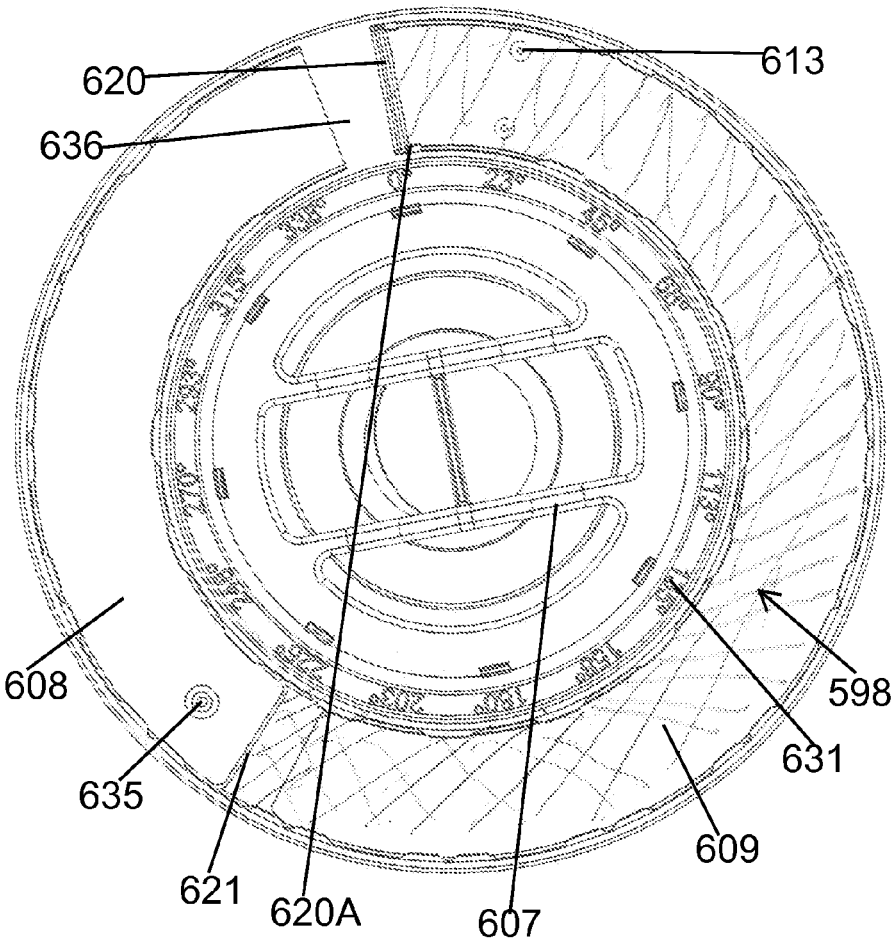
Figure 40:
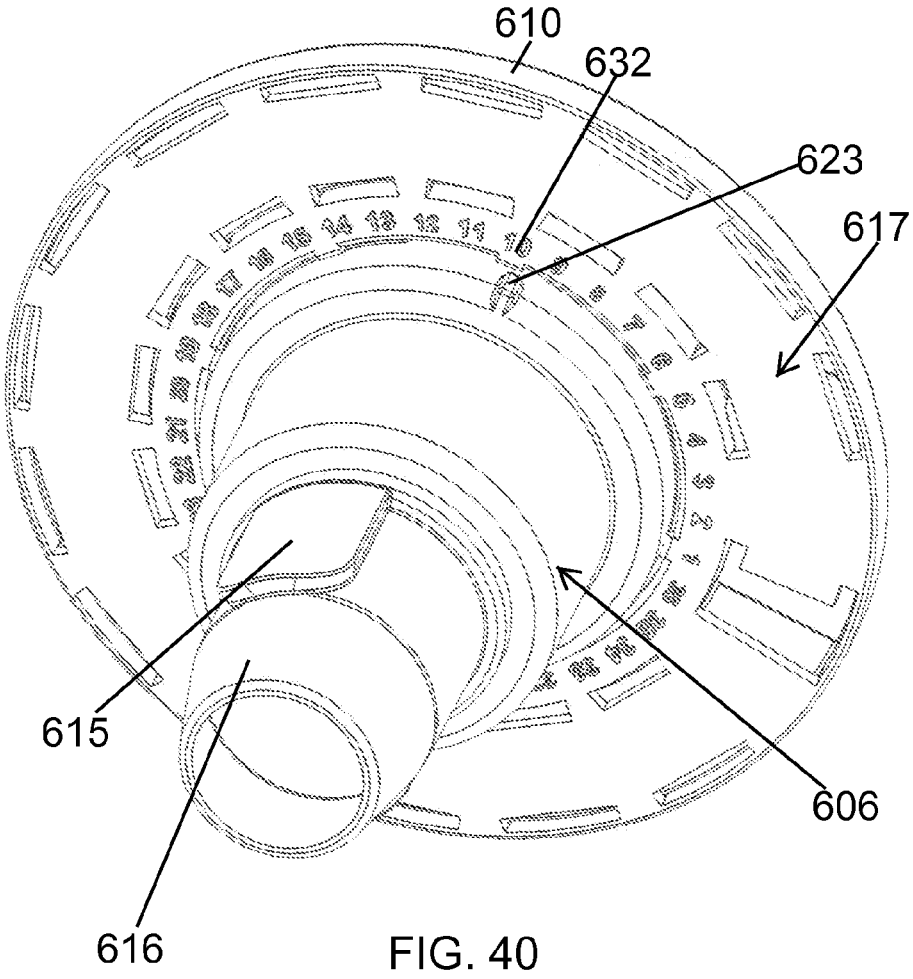
FIG. 40 is a bottom perspective view of an aiming tool.

In FIG. 39D, the cleaning arc indicator 598 is set to a 225 degree cleaning arc by rotating the first ring 608 until the first end 621 of the first ring 608 is aligned with the 225 degree sweep pattern indicator 631. Such positioning would likely be utilized to align a variable rotating pool cleaning nozzle assembly 647 exemplified as 449 in FIG. 30.

Once the base 606 has been inserted into the body 661, the tray 617 may be rotated to align the adjustable visual area with the selected sweep pattern in the pool. The selected sweep pattern is typically dependent upon the configuration of the pool. FIGS. 25-31 depict various pool layouts and describe the different sweet pattern necessary for each configuration. The sweep pattern is the effective area covered by the cleaning arc of the variable rotating pool cleaning nozzle assembly 647. Once the adjustable visual area of the cleaning arc indicator 598 is aligned with the selected sweep pattern, the aiming tool 600 may be withdrawn and the relative rotational orientation of the body 661 in the pool structure 16 is determined by which one of the plurality of aiming reference figures 632 the aiming reference marker 623 is aligned. This relative rotational orientation of the body 661 may be subsequently applied to the variable rotating pool cleaning nozzle assembly 647 with the locking tool 641.

Although not required in all embodiments, one or more embodiments of an aiming tool 600 comprise a pole adapter 601 coupled to the tray 617. The pole adapter 601 may comprise any pole adapter 601 known in the art that allows coupling of a pool service pole known in the art to the aiming tool 600. In a particular, non-limiting embodiment, the pole adapter 601 comprises an elongated body sized to fit within a pool service pole. The pole adapter 601 typically further comprises a spring lock 602, one or more lock pins 603, a universal joint 604, and universal pivot and tension screws 605. In one or more embodiments, the pivot and tension screws 605 of the pole adapter 601 couple to one or more clevis members 607 on the aiming tool 600. In other embodiments, the pole adapter 601 may be coupled to the aiming tool 600 through any coupling mechanism previously known in the art. The pole adapter 601 allows a user to operating the aiming tool 600 in hand or at the depths of a pool attached to the end of a standard pool service pole. For purposes of clarity, the pole adapter 601 is not shown in FIGS. 36-40.

A locking tool 641 for aligning a variable rotating pool cleaning nozzle assembly 647 with a selected sweep pattern and locking the variable rotating pool cleaning nozzle assembly 647 to the body 661 is also contemplated as part of this disclosure. The locking tool 641 may be used in combination with the aiming tool 600 or independent of the aiming tool 600. FIG. 41 depicts a non-limiting example of an aiming tool 641 and a variable rotating pool cleaning nozzle assembly 647 before engagement. FIG. 42 depicts a non-limiting example of an aiming tool 641 engaged with a variable rotating pool cleaning nozzle assembly 647.

While a particular non-limiting embodiment of a variable rotating pool cleaning nozzle assembly 647 is depicted in FIGS. 41 and 42, it is contemplated that the locking tool 641 may be utilized with any of the variable rotating cleaning nozzle assemblies disclosed herein or previously known in the art with modifications apparent to one of ordinary skill in the art upon review of this disclosure. Moreover, unless otherwise noted, specific mechanisms and elements of the variable rotating pool cleaning nozzle assembly 647, such as but not limited to the nozzle head, stem, spring and cam assembly, may comprise any such mechanisms and elements of nozzle assemblies described elsewhere in this document or otherwise previously known in the art.

According to some embodiments, a variable rotating pool cleaning nozzle assembly 647 comprises a retainer 654. The retainer 654 may comprise features and elements similar to the retainer 4 described elsewhere in this document or otherwise known in the art. In one or more embodiments, the retainer 654 comprises a plurality of retainer installation lugs. In more particular embodiments, the plurality of lugs comprise one or more minor retainer installation lugs 655 and one or more major retainer installation lugs 656. Similar to the major and minor indexing lugs 615, 614 on the base 606, the major and minor retainer installation lugs 655, 656 are sized and configured to interface with specific body installation lugs of the body 661 mounted in the pool structure 16. For example, the major retainer installation lug 656 is typically sized and positioned to interface with the minor body installation lug 664 when the retainer 654 is inserted into the body 661, while the minor retainer installation lug 655 is sized and positioned to interface only with the major body installation lugs 665 and not the minor body installation lug 664 when the retainer 654 is inserted into the body 661.

In one or more embodiments, the retainer 654 further comprises a serrated portion positioned to interface and engage with a serrated bottom 31 of a lower section of a cam assembly utilized in the variable rotating pool cleaning nozzle assembly. Engagement between the serrated bottom 31 of the cam assembly and the similarly serrated portion of the retainer 654 helps prevent undesired rotation of the cam assembly in relation to the retainer 654.

The variable rotating pool cleaning nozzle assembly 647 typically further comprises a cap ring 650 similar to embodiments of the cap ring 3 described elsewhere in this document or previously known in the art. In some embodiments, the cap ring 650 a plurality of aiming tool ports. In more particular, non-limiting embodiments, the plurality of aiming tool ports comprises one or more minor aiming tool ports 652 and one or more major aiming tool ports 653. The one or more minor aiming tool ports 652 are positioned to align and engaged with a minor locking lug 644 on the locking tool 641, while the one or more major aiming tool ports 653 are positioned to align and engage with a major locking tab 651 on the locking tool 641. The major aiming tool port 653 is typically larger than the minor aiming tool port 652.

In one or more embodiments, the locking tool 641 comprises a plurality of locking lugs sized and positioned to engage with a plurality of aiming tool ports. In more particular non-limiting embodiments, the locking tool 641 comprises one or more minor locking lugs 644 sized and positioned to engage with one or more minor aiming tool ports 652 on the cap ring 650 of the variable rotating pool cleaning nozzle assembly 647. The locking tool 641 typically further comprises one or more major locking lugs 651 sized and positioned to engage with only one or more major aiming tool ports 653. Alignment of the minor and major locking lugs 644, 651 with the respective minor and major aiming tool ports 652, 653 allows for proper alignment of the locking tool 641 with the variable rotating nozzle assembly 647 for aligning the nozzle head 2 with the desired sweep pattern. The minor and major locking lugs 644, 651 typically extend from a bottom side of the locking tool 641. Other embodiments may comprise more or less locking lugs 644, 651 and aiming tool ports 652, 653.

One or more embodiments of the locking tool 641 further comprise a plurality of aiming symbols 642. The plurality of aiming symbols 642 may comprise a number, shape, letter, other symbol, or any combination thereof. For example, in the non-limiting embodiment shown in FIGS. 41 and 42, the aiming symbols comprise the numbers 4, 8, 12, 16, 20, 24, 28, 32, and 36. Three dots are positioned between each number to represent the numbers between the two shown numbers. The plurality of aiming symbols 642 are typically arranged around an opening or transparent portion of the locking tool 641 that allows the nozzle head 2 to be visible through the opening or transparent portion when the locking lugs 644 are engaged with the aiming tool ports 5. This allows a user to align the nozzle direction indicator 9 on the nozzle head 2 with one of the plurality of aiming symbols 642 based on the relative rotation orientation of the body 661 established with the aiming tool 600. For example, because the aiming reference marker 623 was aligned with the number 10 of the plurality of aiming reference figures 632, the nozzle direction indicator 9 should be aligned with an aiming symbol 642 representing 10.

One or more embodiments of a locking tool 641 further comprise a locking direction indicator 648 and a setting direction indicator 649. Rotation of the locking tool 641 in the direction of the setting direction indicator 640 when the locking tool is engaged with the cap ring 650 disengages the serrated portion of the cam assembly with the serrated bottom 31 of the retainer 654. This allows for rotation of the stem 11 to rotate the nozzle head 2 until the nozzle direction indicator 9 is aligned with the desired aiming symbol 642. In the examples shown in FIGS. 40-42, this includes rotating the locking tool 641 while engaged with the cap ring 3 until the nozzle direction indicator is aligned with the aiming symbol 642 number representing 10. Once the nozzle direction indicator 9 is so aligned, by rotating the locking tool 641 in the direction of the locking direction indicator 648 the serrated portion of the cam assembly reengages with the serrated bottom 31 of the retainer 654, thus locking the cam assembly in place relative to the retainer 654. This allows the clean arc of the variable pool cleaning nozzle assembly 647 to effectively cover the area of the selected sweep pattern.

In one or more embodiments, it is necessary to manually operate or otherwise position the nozzle direction indicator 9 to a rotational end point before setting and locking the cam assembly with the locking tool 641. For example, if a right hand or counterclockwise edge of a sweep pattern is used during alignment, the nozzle direction indicator 9 must be manually or otherwise positioned to the left most retracted position.

Also contemplated as part of this disclosure is a method of aiming a variable rotating pool cleaning nozzle assembly. According to one aspect, the method comprise determining, with an aiming tool 600, a relative rotation orientation of a body 661 of a variable rotating pool cleaning assembly 647 mounted in a pool structure 16. The method further comprises inserting the variable rotating pool cleaning assembly 647 into the body 661 mounted in the pool structure 16. The method further comprises engaging a locking tool 641 with a cap ring 3 of the variable rotating pool cleaning assembly 647. The method may further comprise aligning, with the locking tool 641, a nozzle of the variable rotating pool cleaning assembly 647 with a selected sweep pattern in the pool and locking, with the locking tool 647, the variable rotating pool cleaning assembly 647 to the body 661 mounted in the pool structure 16.

In one or more embodiments, determining the relative rotation orientation of the body 661 comprises aligning one or more indexing lugs 614, 615 between body installation lugs 664, 665 of the body 661, inserting a base 606 of the aiming tool 600 into the body 661, and rotating a tray 617 of the aiming tool 600 removably coupled to the base 606 to align an adjustable visual area visible on the tray 617 with the selected sweep pattern in the pool. In one or more embodiments, determining the rotation orientation of the body 661 further comprises determining which one aiming reference figure of a plurality of aiming reference figures 632 on the tray 617 that an aiming reference marker 623 on the base 606 aligns.

A method further comprises adjusting the adjustable visual area by sliding a first ring 608 of the cleaning arc indicator 598 interleaved with a second ring 609 to uncover more or less of the second ring 609, the adjustable visual area comprising the uncovered portion of the second ring 609. Rotating the tray of the aiming tool 600 removably coupled to the base 606 to align the adjustable visual area visible on the tray 617 with the selected sweep pattern in the pool may comprise rotating the tray 617 of the aiming tool 600 to align a start boss 620 extending from the second ring 609 with a first edge of the sweep pattern. Sliding the first ring 608 of the cleaning arc indicator 598 may comprise sliding the first ring 608 of the cleaning arc indicator 598 to align a terminating or first end 621 of the first ring 608 with a second edge of the sweep pattern.

In one or more embodiments, aligning, with the locking tool 641, the nozzle of the variable rotating pool cleaning nozzle assembly 647 comprises aligning the locking tool 641 with the cam assembly by engaging one or more minor locking lugs 644 with one or more minor aiming tool ports 652 and engaging one or more major locking lugs 651 with one or more major aiming tool ports 653. Aligning the nozzle of the variable rotating cleaning nozzle assembly 647 may further comprise rotating the locking tool 641 in a first direction while the locking tool 641 is engaged with the cap ring 650 to disengaged the cam assembly from the retainer 654. Aligning the nozzle of the variable rotating cleaning nozzle assembly 647 may further comprise rotating the stem 11 until the nozzle direction indicator 9 is aligned with one of the plurality of aiming symbols on the locking tool 641, the one of the plurality of aiming symbols corresponding to the one aiming reference figure of the plurality of aiming reference figures 632.

In one or more embodiments, locking, with the locking tool 641, the variable rotating pool cleaning nozzle assembly comprises rotating the locking tool 641 in a second direction while engaged with the cap ring 650 of the variable rotating pool cleaning nozzle assembly 647. In one or more embodiments, rotating a tray 617 of the aiming tool 600 removably coupled to the base 606 comprises rotating the tray 617 of the aiming tool 600 with a pole removably coupled to the tray 617.

In one or more embodiments, the direction of the cleaning arc may be adjusted after the cleaning head assembly is installed but prior to filling the pool with water. In this particular embodiment of FIGS. 4-7, a pin is inserted in the back of the cleaning head assembly to keep the cleaning head assembly in the extended position. The nozzle cover may then be loosened so the cleaning head assembly may be turned until the nozzle orifice 13 is pointed in the direction of the beginning of the cleaning arc. The pin may then be removed, thus allowing the cleaning head assembly to retract into the body 1.

Referring to FIG. 15, an illustration of the interior of a cam assembly (example as cam assembly 126 in FIG. 9) for a cleaning head assembly (example as cleaning head assembly 124 in FIG. 9) is shown with reference to the particular implementation of FIG. 9 as an example. As illustrated, the edges of the saw teeth 152, 154, 156, or other guides 152, 154, 156, of the upper section 128 and slidable section 131 of the cam assembly 126 form a plurality of channels 158, 160, 162 in which a pin 142 travels during operation of a cleaning head assembly 124. For ease of understanding, slidable section 131 has been marked in FIGS. 11 and 12 with right downwardly sloping hatch marks. The pin 142 has been marked with right upwardly sloping hatch marks. Although the FIGs. Show more than one pin 142, this is intended to be illustrative of the movement of the pin 142 from one end of a channel to another end and not necessarily that there are two pins 142 in the particular implementation.

During operation of the cleaning head assembly, water pressure force is intermittently exerted on the stem 140, forcing it to extend upwardly. As the stem 140 moves upwardly, the pin 142 also travels upwardly in a first channel 158 formed to a side of the edges of the saw teeth 152, 154. It should be understood that in its ordinary rest position, the pin 142 would not be in the upper position (as 142*a*) between tooth 152 of the upper cam 128 and the shifter 129, but would be resting within the lower cam section 130. When the water pressure force is removed, the bias of the spring element 148 withdraws the stem 140 into the housing 132 (see FIG. 9). As the stem 140 withdraws, the pin 142 travels downwardly through the first channel 158 (as indicated by the arrow 164). In the process, the rotational position of the stem 140 may travel incrementally clockwise (or counterclockwise depending upon the direction of movement for the stem). When the intermittent water pressure force is once again exerted on the stem 140, the pin 142 travels upwardly between the saw teeth 154, 156 into the second channel 160, as indicated by the arrow 168. Once again, the rotational position of the stem 140 may continue to move incrementally clockwise (or counterclockwise) until it rests in the position illustrated in FIG. 12 as pin 142*d*. It should be noted that when the pin 142*d* initially comes to rest in the position illustrated in FIG. 12, the slidable section 131 (and integral shifter 129) is still in its position to the left illustrated in FIG. 12.

Figure 12:
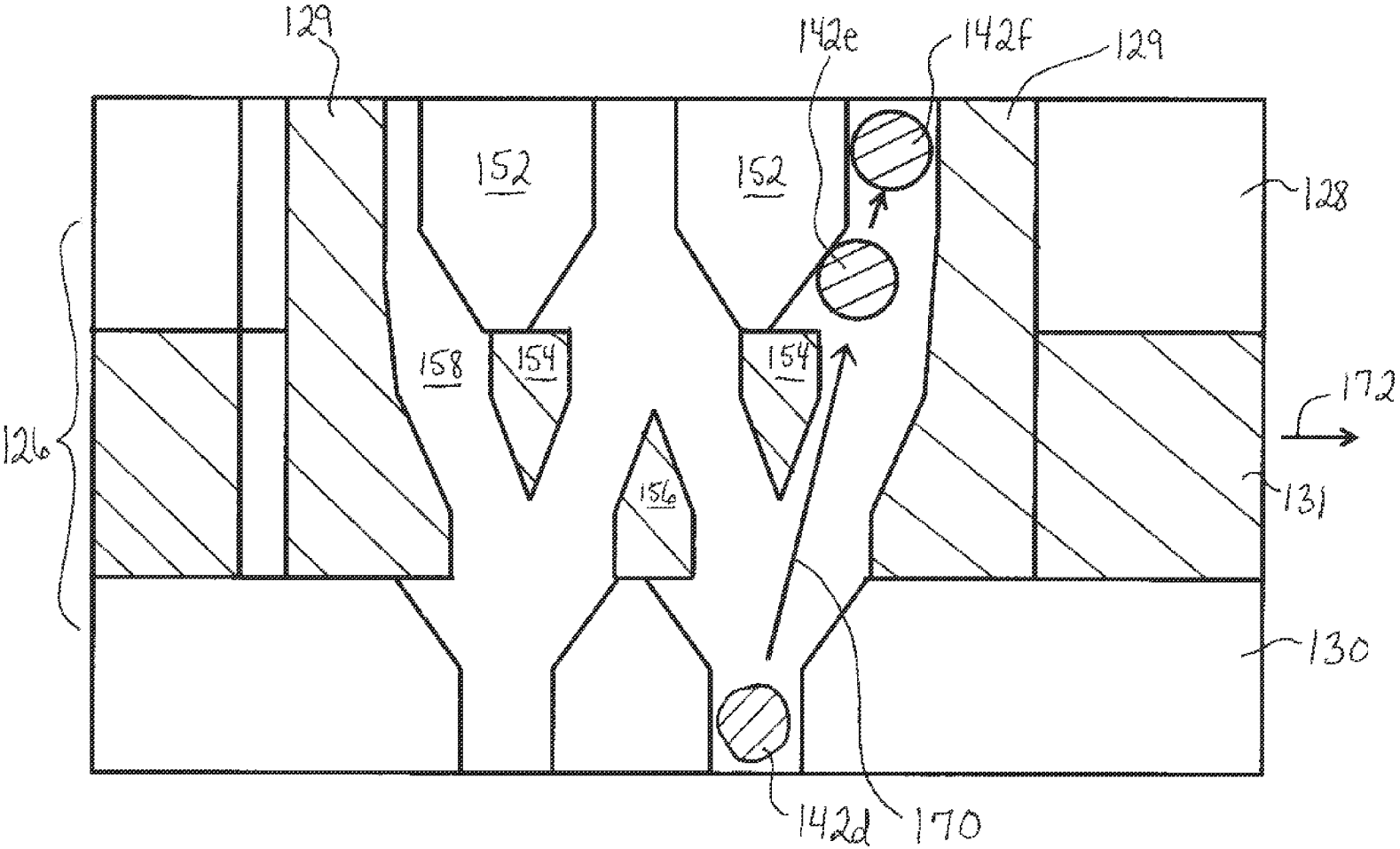
FIG. 12 illustrates the travel path of a pin through the cam of an implementation of a nozzle assembly indicating the movement of the slidable section of the cam followed by intermittent rotation counterclockwise.
Figure 13:
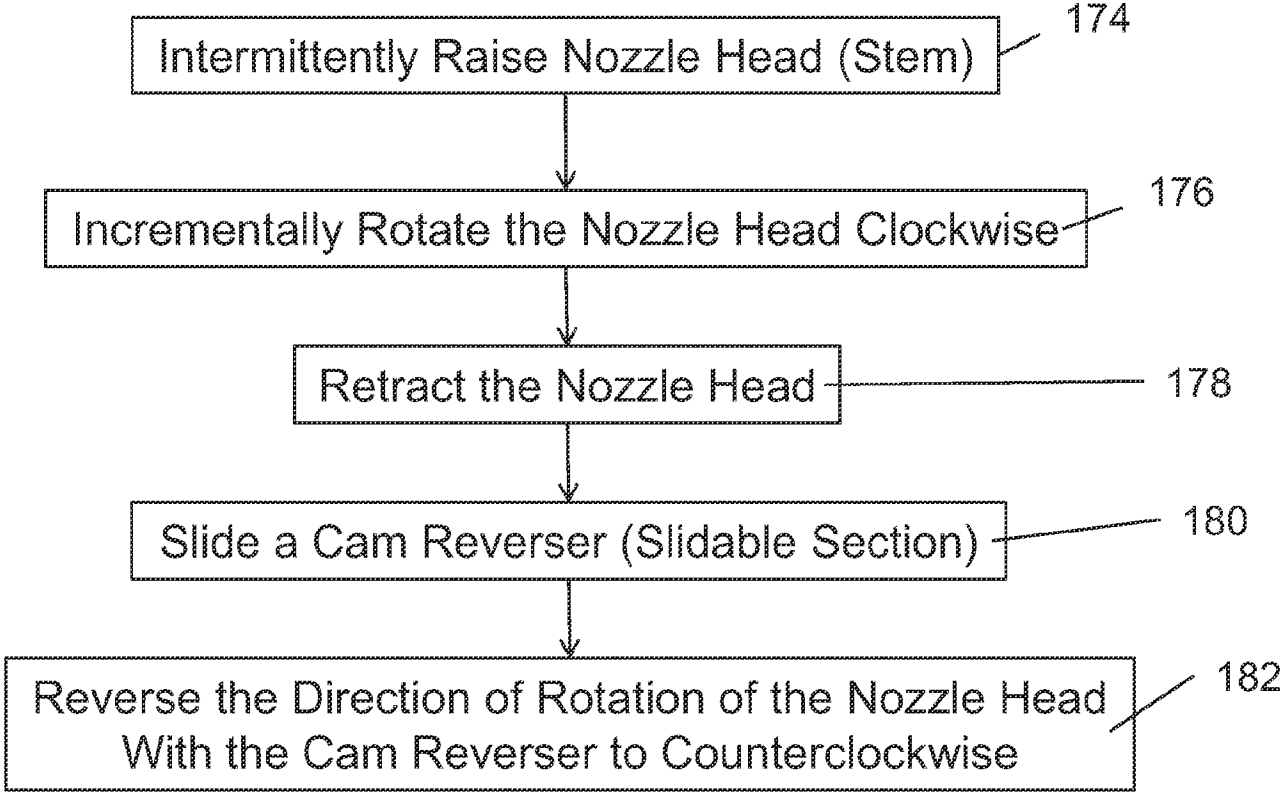
FIG. 13 is a flow diagram of the steps of a method of cleaning a swimming pool utilized by particular implementations of swimming pool cleaning heads.

Referring to FIG. 12, as the water pressure force is again removed from the stem 140, the bias of the spring element 148 draws the stem 140 (see FIG. 9) downward again, causing the pin 142 to travel between saw teeth 156, 154, further moving the rotational position of the stem 140 incrementally clockwise (or counterclockwise). By repeating the intermittent application and removal of water pressure force, stem 140 rotate until the pin 142 enters the third channel 162, as indicated by arrow 170 (FIG. 12 in a first slidable section position and FIG. 13 illustrating a second slidable section position) for as many channels the cam assembly includes until it reaches the limits of the cam rotation. For the implementation shown in FIGS. 12 and 13, the implementation includes only four channels 158, 230, 160 and 162.

After the pin 142*d* is positioned at the start of the final channel 162, with the shifter 129 in its position illustrated in FIG. 12, water pressure force is exerted on the stem 140 and the pin 142 enters the final channel 162 as indicated by the arrows. When the pin 142 reaches its position as pin 142*e* in FIG. 12, the interference of the pin 142*e* with the shifter 129 to its right pushes the shifter 129 (and integral slidable section 131) to the right so that the pin 142 can move to its end position as pin 142*f*.

Figure 11:
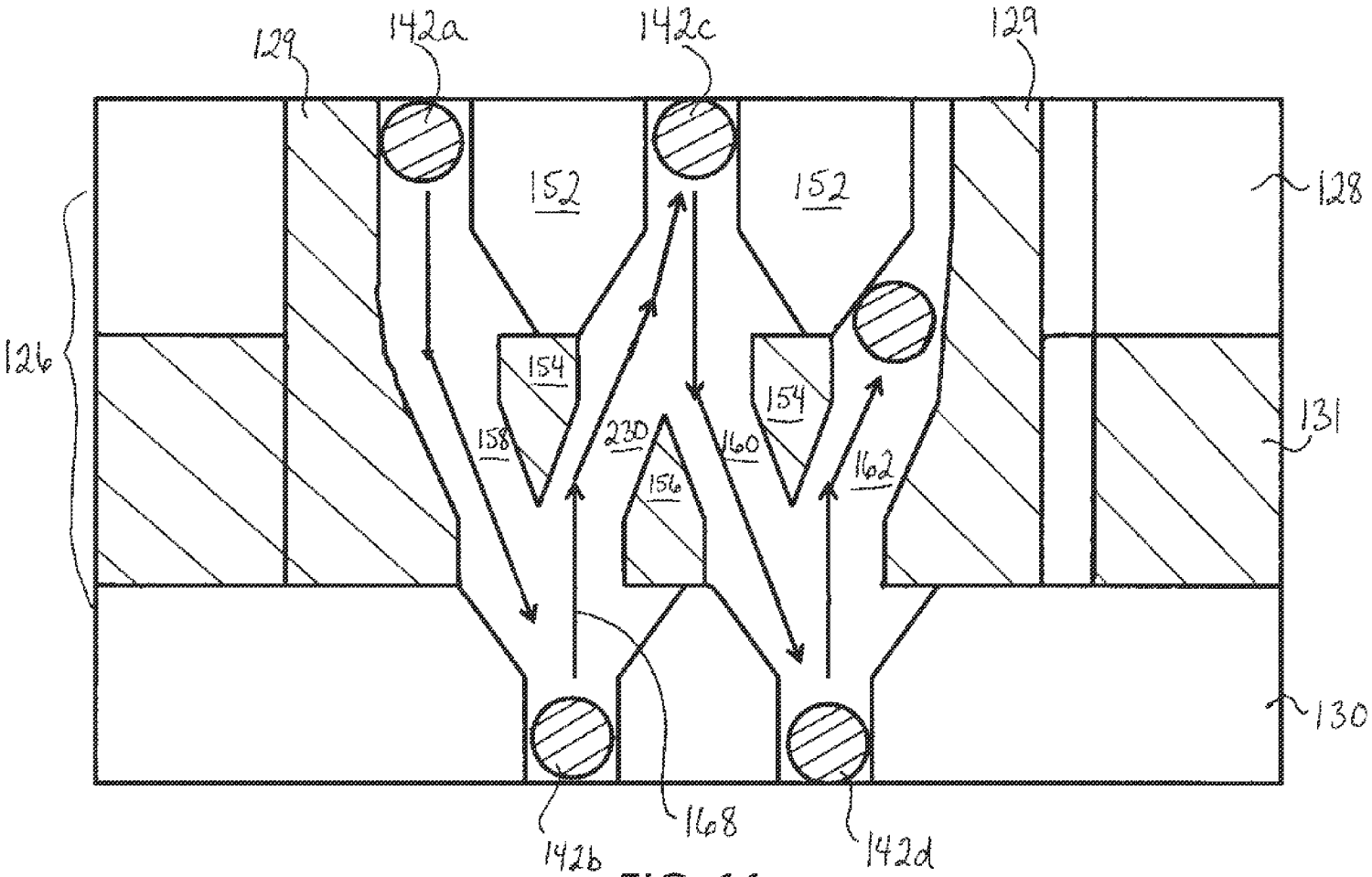
FIG. 11 illustrates the travel path of a pin through the cam of an implementation of a nozzle assembly during intermittent rotation clockwise.

The top of channel 162 is originally narrower than the diameter of the pin 142 (see FIG. 11 for its earlier position). As the pin 142 enters channel 162 under water pressure force as indicated by arrow 170, the pin 142 presses against the edge of saw tooth 152 and against shifter 129, moving the shifter 129 and inducing slidable rotation of the slidable section 131 in relation to the upper and lower cam sections 128 and 130, and a widening of channel 162 to allow the pin 142 to fully enter channel 162. Arrow 172 in FIG. 12 shows the direction of rotation of the slidable section 131 in relation to the remainder of the cam assembly 126. As channel 162 widens through rotational movement of the shifter 129 coupled to the slidable section 131 of the cam assembly, the width of channel 158 is reduced (see FIG. 12 as compared with FIG. 11). When the pin 142 reaches channel 162 and completes widening it, the cleaning head assembly 124 (FIG. 9) has reached a first limit position or a predetermined limit after completing a predetermined number of rotational steps and is no longer able to rotate further in the clockwise direction.

When the water pressure force is removed from the stem 140, the pin 142 travels back down channel 162. As the pin 142 does so, the angular position of the stem 140 begins to be incrementally and/or automatically adjusted in the counterclockwise direction just like it was previously in the clockwise direction. Under the influence of the intermittent water pressure force, and through the action of the engagement of the pin 142 within the cam assembly 126, the angular position of the stem 140 continues to incrementally travel in the counterclockwise direction until the pin 142 slidably rotates the slidable section 131 back by entering and widening channel 158, or through reaching a second limit position or predetermined limit. Through automatic positioning and reversal of the pin movement within the predetermined limits of the cam assembly, the cleaning head assembly automatically begins another cycle of movement in the clockwise direction after completion of a predetermined number of rotational steps. The ability of the slidable section 131 to slidably rotate with respect to the lower and upper sections 130, 128 enables the automatic reversal of the direction of rotation of particular implementations of cleaning head assemblies 124.

While the implementation of a cam assembly 126 illustrated in FIGS. 11 and 12 comprise only a few saw teeth 152, 154, 156, and three channels 158, 160 and 162, in other particular implementations, any number of saw teeth and corresponding channels may be employed. Such implementations may, therefore, incorporate smaller or larger rotational increments (steps), be evenly spaced or unevenly spaced, and/or incorporate a wider or shorter range of rotational movement before automatically reversing direction. For example, the saw teeth 152, 154, 156 may be spaced any distance apart to increase or decrease the stepwise rotational distance the stem 140 turns as water pressure force is intermittently applied. In addition, the degree of rotation of the stem 140 allowed by the number of saw teeth 152, 154, 156 employed may range in particular implementations from substantially 360 degrees to substantially 0 degrees, depending upon the desired location and function of the cleaning head assembly 124. The rotation range to which particular implementations may be designed is limited only by the space needed for the left and right edges of the shifter 129 and the stops provided on the left and right of the upper and/or lower cam sections 128, 130. It will be understood, however, that the actual dimensions of the stops and edges may vary greatly by the particular materials used to create the cam assembly 216 and the pressures to which the cam assembly is exposed. It is anticipated, however, that in most cases the rotation range needed will be sufficiently below 360 degrees and sufficiently above 0 degrees that the stops and shifter edges widths will not be a concern.

Also, in particular implementations, the relative sizes of the saw teeth 152, 154, 156 and/or angles of the channels 158, 160, 162 may be varied to allow the stem 140 to rotate a greater angular distance during certain rotational cycles than in others. Implementations employing regularly sized and spaced saw teeth 152, 154, 156 may employ a method of cleaning a pool floor that includes rotating the position of the stem 140 a certain predetermined distance within a predetermined or irregular interval of time. In implementations employing irregularly sized and/or spaced saw teeth 152, 154, 156, the method may employ rotating the position of the stem 140 according to a predefined pattern during a predetermined or irregular interval of time.

Referring to FIG. 13, a flowchart of method steps is illustrated. Implementations of a pool cleaning head may include a method of use that may include the steps of intermittently raising the nozzle head (stem, step 174), incrementally rotating the nozzle head clockwise (step 176), and retracting the nozzle head (step 178). In particular implementations, steps 174, 176, and 178 may be repeated multiple times, or may occur only once. Also, during the step of retracting the nozzle head (step 178), the nozzle head may also be incrementally rotated clockwise (step 176). As illustrated, method may also include the step of sliding a cam reverser (slidable section, step 180) and reversing the direction of rotation of the nozzle head with the cam reverser to counterclockwise (step 182). In particular implementations, these two steps may occur after a predetermined number of repetitions (cycles, or steps) of steps 174, 176 and 178, or may occur after just one occurrence of each of steps 174, 176, and 178. In implementations of a pool cleaning head, the sliding of the cam reverser (step 180) and the reversing of the direction of rotation of the nozzle head (step 182) may be repeated automatically (along with the repetitions of steps 174, 176, and 178) a predetermined number of times or according to a predefined pattern, allowing the pool cleaning head to incrementally and intermittently rotate through a particular arc of rotation or a fully 360 degrees for a desired period of time.

Implementations of cleaning head assemblies 216 employing removable and replaceable cam assemblies 222 may also enable adjustment of the overall orientation of the direction of total rotation (whether the rotation of the stem 140 is directed toward or away from a wall, for example) through exchanging of cam assemblies 222. In a conventional cleaning head assembly, the pattern of intermittent spray is fixed and the cam teeth of the cleaning head are built into the cleaning head assembly. Replacement of the cam teeth for a different cam configuration or to replace a broken cam tooth requires replacement of the entire cleaning head assembly. An exchange or a replacement of a cam assembly 222 in particular implementations disclosed herein may be facilitated by decoupling the cap ring 136, removing the locking ring 134, removal of the cam assembly 126 and then replacement of the cam assembly 126 with another cam assembly that is either the same as the first (if repairing), or has different characteristics than the first (such as a degree of total rotation different from the first cam assembly). The locking ring 134 may be reapplied, the cleaning head oriented and its extents tested, and the cap ring 136 reapplied.

This ability to change the overall orientation of the direction of total rotation of the cleaning head assembly 124 also allows for directional adjustment after the cleaning head assembly 124 is installed in a pool floor, step, or sidewall to ensure more optimal routing of contaminants regardless of the initial installation of the cleaning head assembly 124. The foregoing may allow an installer to tune the cleaning area covered by particular implementations of a cleaning head assembly 124 and perform adjustments without requiring specialized tools or lengthy disassembly or replacement.

Figure 14:
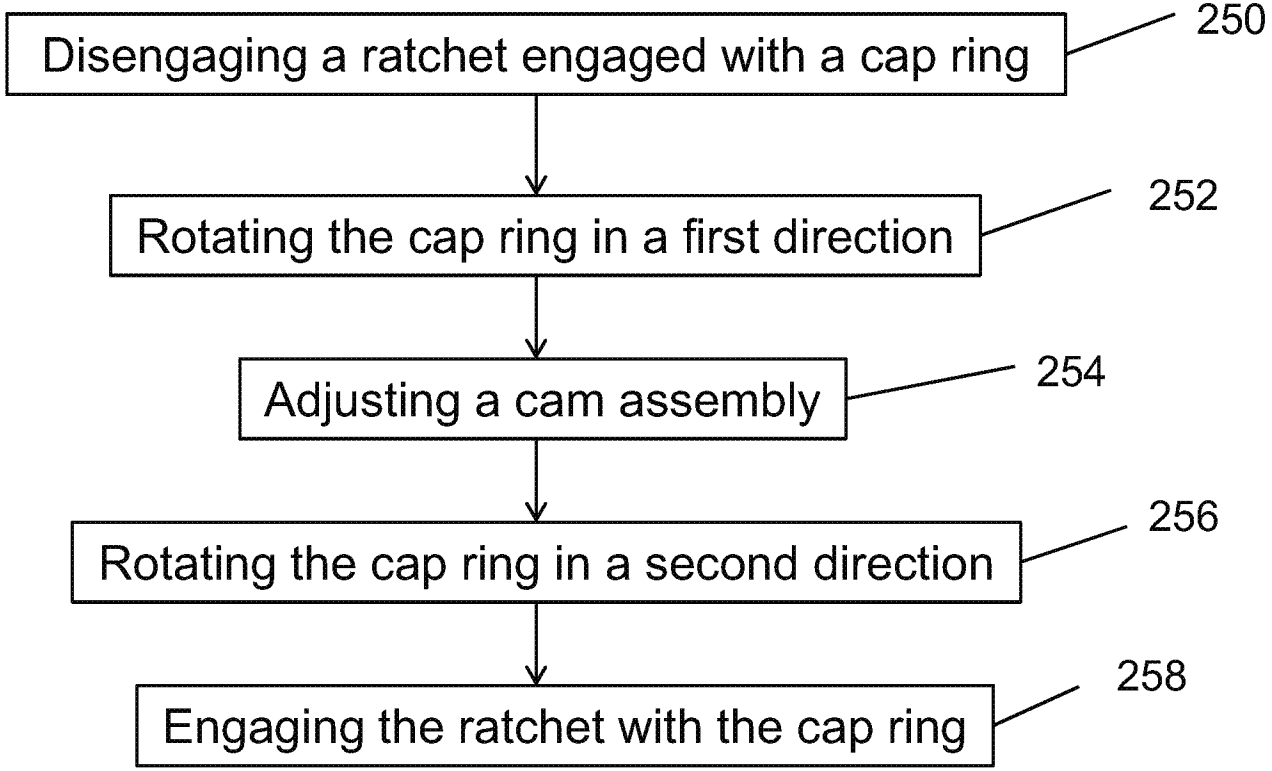
FIG. 14 is a flow diagram of an implementation of a method of adjusting a swimming pool cleaning head.

In addition, implementations of cleaning head assemblies 124 may utilize a method of adjusting the orientation of the cleaning head assembly 124 after the cleaning head assembly 124 has been installed. Referring to FIG. 14, an implementation of the method is illustrated. The method includes the steps of disengaging a locking arm 204 engaged with a cap ring 136 (step 250), rotating the cap ring 136 in a first direction (step 252), adjusting a cam assembly 126 (step 254), rotating the cap ring 136 in a second direction (step 256), and engaging the locking arm 204 with the cap ring 126 (step 258). The method may further include pressing on the locking arm 204 through an opening 206 in the cap ring 136. Rotating the cap ring 136 in a first direction (step 252) may further include disengaging a plurality of ridges 208 on a housing 132 with a plurality of grooves 210 on a lower section 130 of a cam assembly 126 and rotating the cap ring 136 in a second direction (step 256) may further include engaging the plurality of ridges 208 on the housing 132 with a plurality of grooves 210 on a lower section 130 of a cam assembly 126. Rotating the cap ring 136 in a first direction (step 252) may also include disengaging projections 214 of the cap ring 136 from ramp members 212 of a locking ring 134. Rotating the cap ring 136 in a second direction (step 256) may also include engaging projections 214 of the cap ring 136 with ramp members 212 of the locking ring 134. The first direction may be either clockwise or counterclockwise and the second direction will always be in a direction opposite the first direction. Adjusting the cam assembly 126 may include rotatably adjusting the position of the cam assembly 126 so that the path of travel of the stem 140 during automatic cleaning operation covers a desired area of the pool.

Figure 16:
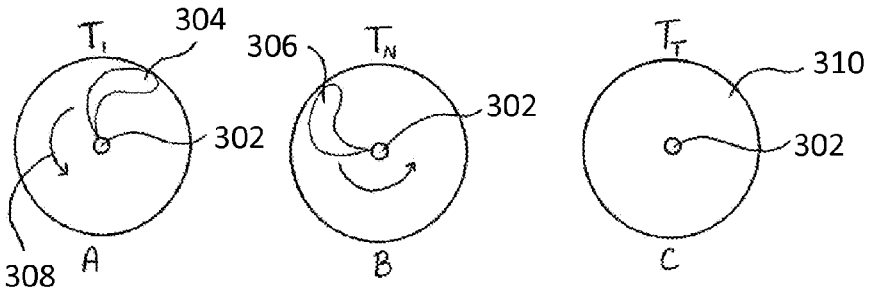
FIG. 16 (prior art)
FIG. 16 is an illustration of the flow emanating from a conventional continuous rotation cleaning head.
Figure 17:
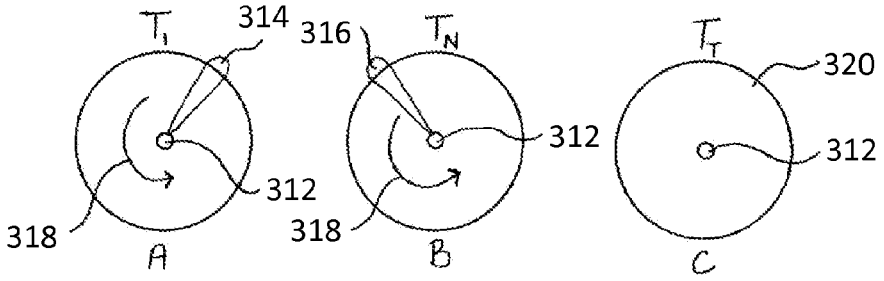
FIG. 17 (prior art)
FIG. 17 is an illustration of the flow emanating from a conventional incremental rotation cleaning head.

Any of the above described heads or cam assemblies may be placed in various locations and in any combination throughout a pool to facilitate cleaning Swimming pool cleaning heads, as described above or as otherwise known in the art, may be utilized and/or adapted to be utilized with the various implementations disclosed herein in accordance with the principles discussed and taught. Two examples of conventional swimming pool cleaning head designs particularly useful in swimming pool floors are illustrated in FIGS. 16 and 17. FIG. 16 represents the water flow pattern of a swimming pool cleaning head having a continuously rotating water stream. An example of one particular implementation of this type of cleaning head is shown and described in U.S. Pat. No. 3,675,252 to Ghiz, issued Jul. 11, 1972, the relevant disclosure of the general operation, structure, manufacture and function of a continuously rotating cleaning head is hereby incorporated herein by reference. When water is supplied to the cleaning head, the head rotates slowly for a time period until the water supply is shut off. As shown in FIG. 16, a cleaning head 302 of a continuously rotating water stream is shown with an effective water stream 304. Note that the effective water streams 304 and 306 are shown curved for the continuously rotating cleaning heads at each of times T(1) and T(N) due to the spiraling effect of the cleaning head 302 rotating in the direction 308 while spraying the water streams 304 and 306. Throughout its 360 degree rotation for total time T(T), the conventional cleaning head 302 affects an effective area 310 of the cleaning head 302. The effective area 310 of a cleaning head 302 is affected by the water pressure provided to the cleaning head 302 and the angle and size of the cleaning head nozzle. Those of ordinary skill in the art will readily be able to adapt an appropriate cleaning head effective area to a given implementation and cleaning head layout for a particular pool. One example of a continuously rotating swimming pool cleaning head is shown in U.S. Pat. No. 3,449,772 to Werner (issued Jun. 17, 1969). Continuously rotating swimming pool cleaning heads are not used in modern pool cleaning system designs for many reasons, some of which are described in U.S. Pat. No. 3,506,489 to Baker (issued Apr., 14, 1970). Instead, incrementally rotating swimming pool cleaning heads are preferred.

Incrementally rotating in-floor swimming pool cleaning heads are conventionally associated with a circuit having one to six cleaning heads. When water pressure is applied to the circuit, each of the heads in the circuit extends and begins to spray water in whatever direction the cleaning head jet nozzle happens to be pointing when the head extends. The cleaning heads each spray the water in its respective direction until the water pressure is released and then retracts back into the pool floor until the next cycle when water pressure is applied to the circuit. At the next cycle, each cleaning head is incrementally rotated from its previous position, thus spraying water in a different direction than before. This process continues each time water pressure is applied to the cleaning heads. For conventional systems where the in-floor cleaning heads rotate 360 degrees through a number of cycles, there is a high likelihood that a first cleaning head and a second head, whether on the same circuit or different circuit within the pool, will not spray in the same direction during a particular cycle. In fact, in many cases, the first and second heads may be pointed in exactly opposite directions essentially cancelling the benefit of each other in the pool cleaning system. If, for example, the first cleaning head in a first circuit was spraying debris toward the drain for a time and then a second cleaning head extended and sprayed debris away from the drain for a time, the benefit of the work the first cleaning head did would be considerably diminished. When the cleaning heads cycle through 360 degrees with equal jet force in all directions so that the net jet force for the cleaning head is zero, the cleaning heads essentially just stir up the debris with the hope that some of it will find its way to the drain.

FIG. 17 represents the flow pattern of a swimming pool cleaning head having an incrementally rotating water stream. An example of one particular implementation of this type of cleaning head is shown and described in U.S. Pat. No. 5,135,579 to Goettl (issued Aug. 4, 1992) and U.S. Pat. No. 6,848,124 to Goettl (issued Feb. 1, 2005), the relevant disclosures of the general operation, structure, manufacture and function of an incrementally rotating cleaning head is hereby incorporated herein by reference. Incrementally rotating cleaning heads are conventionally configured to incrementally rotate in response to the start and stop of water pressure controlled by a sequence valve. For each incremental location, the flow path is stationary.

As shown in FIG. 17, a cleaning head 312 of an incrementally rotating water stream is shown with an effective water stream 314. Note that the effective water streams 314 and 316, distinct from that of a continuously rotating water stream, are shown straight for the incrementally rotating cleaning heads at each of times T(1) and T(N) due to the fixed flow path for each flow location of the cleaning head 312 as it incrementally rotates in the direction 318. Throughout its 360 degree rotation for total time T(T), the conventional cleaning head 312 affects an effective area 320 of the cleaning head 312. The effective area 320 of a cleaning head 312 is affected by the water pressure provided to the cleaning head 312 and the angle and size of the cleaning head nozzle. Those of ordinary skill in the art will readily be able to adapt an appropriate cleaning head effective area to a given implementation and cleaning head layout for a particular pool. Typically, however, for a given water pressure and nozzle size, an incrementally rotating cleaning head will have a larger effective area than that of a continuously rotating cleaning head with the same pressure and nozzle size.

Figure 18:
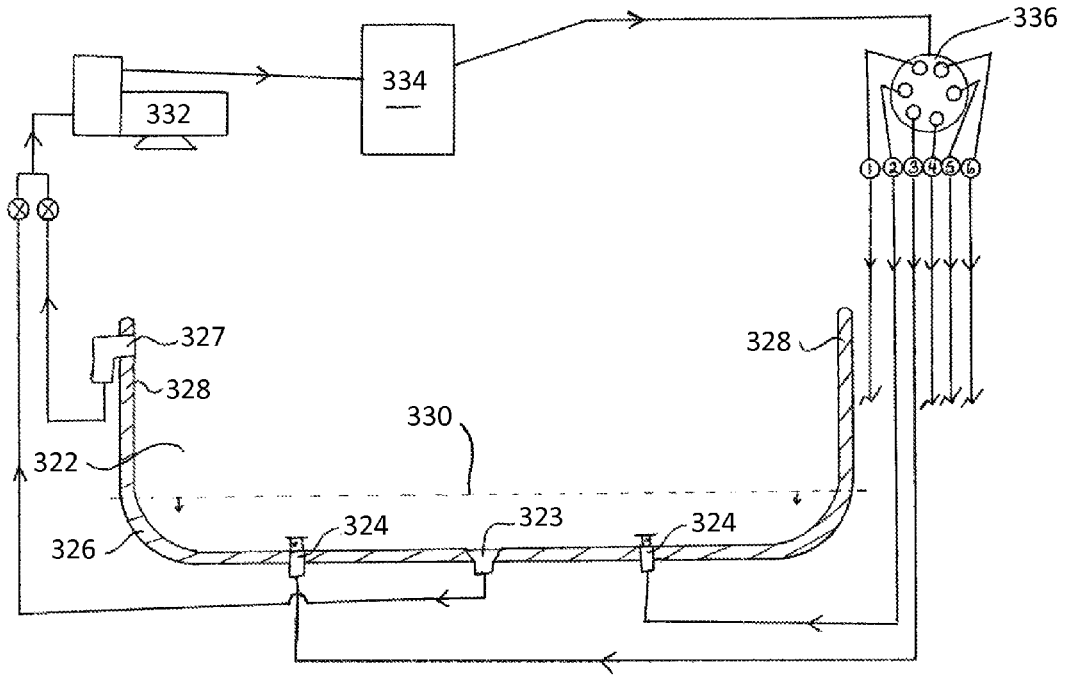
FIG. 18 (prior art)
FIG. 18 is a cross sectional view of a conventional pool with a cleaning system block diagram comprising cycling cleaning head circuits.

FIG. 18 is an example of a cross section of a conventional swimming pool. In this design, the swimming pool 322 includes pop-up cleaning heads 324 and a drain 323 in the floor 326 of the pool 322 and a skimmer opening 327 on a wall 328 of the pool. As used herein, a "wall" of a pool is any surface that is substantially vertical, and a "floor" of a pool is everything else. The floor 326 surfaces are the surfaces on which dirt and debris settle. In FIG. 18, the division between the wall 328 and the floor 326 is approximately indicated by line 330, the floor 326 being the surface below the line 330 and the wall 328 being the surface above the line 330. In conventional pool design, this line is commonly known as the "spring line."

The example of FIG. 18 also includes a swimming pool pump 332 and filter 334, and a sequencing valve 336 coupled to individual cleaning circuits 1-6. The circuits 1-6 which feed individual cleaning heads in the swimming pool in the pool floor 326. Conventional systems have a typical flow of 55-60 gallons per minute. Some pool cleaning hydraulic systems use a single pump coupled to the filter to operate the cleaning heads through the sequencing valve like that shown in FIG. 18, other systems use separate pumps for the filter and cleaning heads. Sequencing valves are used for systems having incrementally rotating cleaning heads.

Figure 19:
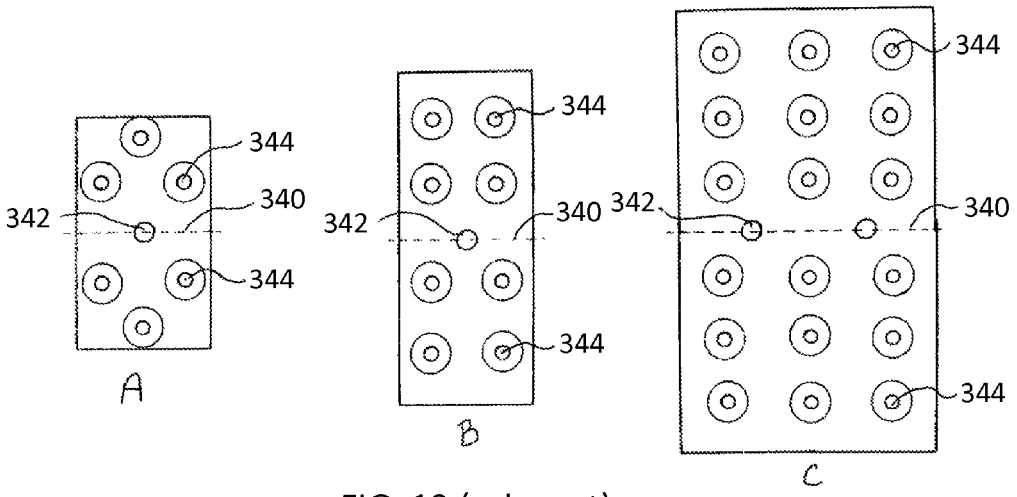
FIG. 19 (prior art)
FIG. 19 is a plan view of three differently sized conventional pools illustrating cleaning head placement and conventional operation.

FIG. 19 illustrates three examples of differently sized conventional play pools where the center line 340 of the pool is the deepest part of the pool and is the line along which the drain 342 is placed. In a conventional pool, a plurality of 360 degree rotating cleaning heads 344 are placed in the floor of the pool to stir up the dirt and debris into entrainment in the pool water. After a time, the dirt and debris will settle again to the pool floor. The hope of pool cleaning system designers using this approach is that the dirt and other debris will be stirred up into suspension in the pool water and eventually be moved to the drain or the skimmer. It is commonly known in the pool industry that for large pools, in-floor cleaning systems cannot completely clean the pool. Rather, in-floor cleaning head systems used in large pools serve to gather debris in a plurality of localized areas so that a maintenance person can vacuum the debris by hand. If the debris in the pool is not the type of debris that settles to the ground (like dirt and leaves) but can remain entrained in the water, then the entrained debris can be filtered with the water through the skimmer and drain. However, if the debris is of the type that settles to the pool floor, conventional in-floor pool cleaning heads push the debris around to different locations around the pool floor as the incrementally rotating cleaning heads jet in their uncoordinated jet directions throughout their cleaning cycles. Once the debris either finds a "dead space" where a cleaning head cannot move the debris or the cleaning system stops, the localized debris areas may be hand-cleaned by a worker with a pool vacuum cleaner.

Figure 20:
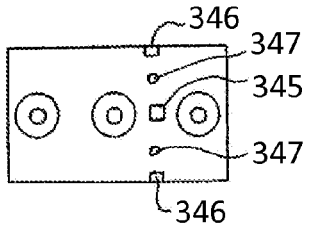
FIG. 20 (prior art)
FIG. 20 is a plan view of a conventional diving pool illustrating conventional cleaning head placement and operation.
Figure 21:
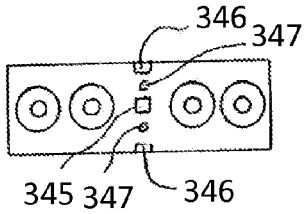
FIG. 21 (prior art)
FIG. 21 is a plan view of a conventional lap pool illustrating conventional cleaning head placement and operation.

In occasional swimming pool designs, cleaning heads are placed in the wall of a swimming pool near the surface of the water to jet down the side of the pool wall, but wall-placed cleaning heads are less effective at cleaning the floor of the pool, are suitable only for small pools without steps or benches unless floor cleaning heads are also used, and are better suited for other purposes. One example of a swimming pool design using wall-placed cleaning heads is shown in U.S. Pat. No. 4,114,206 to Franc (issued Sep. 19, 1978). FIG. 20 illustrates pool cleaning head placement for a conventional diving pool design with the drain near the deepest part of the swimming pool. FIG. 21 illustrates pool cleaning head placement for a conventional lap pool design with the drain near the center of the pool, the pool having a fairly even depth throughout its length. The conventional lap pool example of FIG. 21 also includes fixed, non-rotating wall-mounted cleaning heads 346 near the drain 345 configured to create a water curtain across the pool near the drain to catch debris moved across the plane of the water curtain and direct it toward the drain. Additional fixed direction, pop-up, non-rotating floor-mounted cleaning heads 347 may be included and directed toward the drain to further enhance the water curtain across the pool. U.S. Pat. No. 5,135,579 to Goettl (issued Aug. 4, 1992), the disclosure of which is hereby incorporated herein by reference, discloses a fixed directional cleaning head to capture debris stirred up by turbulence. An example of a swimming pool design, although it is for a diving pool design, using wall-placed and floor-placed cleaning heads is shown in U.S. Pat. No. 3,506,489 to Baker (issued Apr. 14, 1970). Baker includes floor-mounted cleaning heads with 360 degree rotation and wall-mounted cleaning heads mounted near the surface of the pool with partially rotating heads so that the water does not spray out of the pool.

Figure 22:
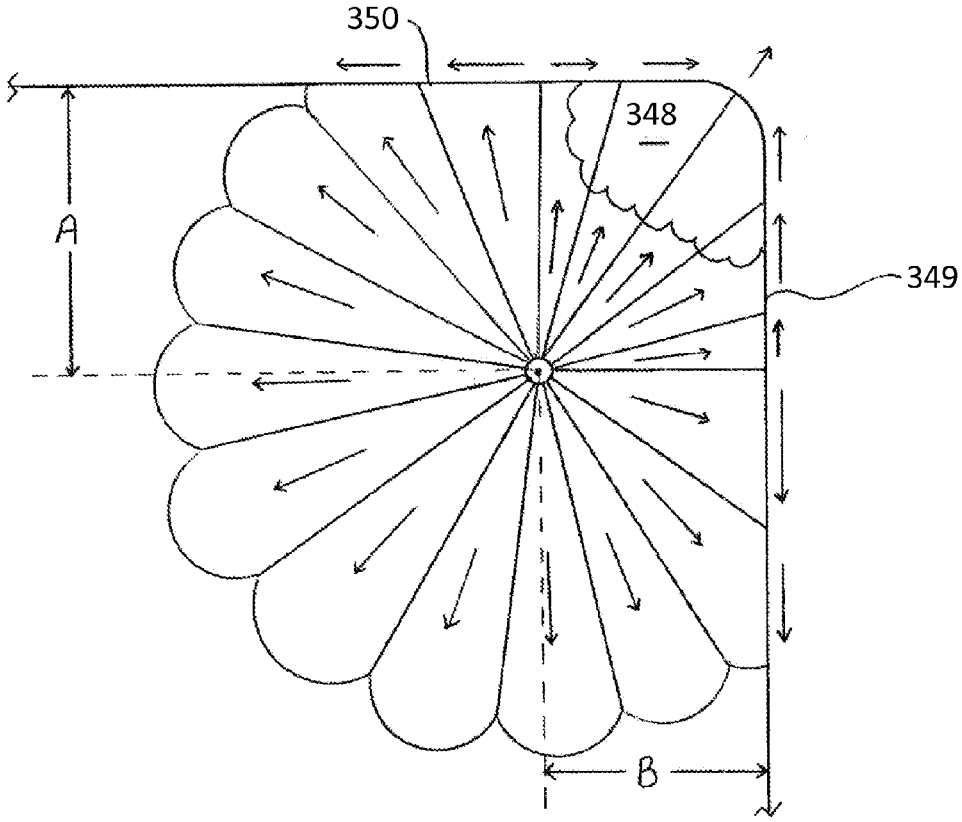
FIG. 22 (prior art)
FIG. 22 is a plan view of a conventional floor cleaning head placed near a corner of a pool illustrating conventional cleaning head placement and operation in relation to debris movement.

FIG. 22 illustrates placement of a conventional floor cleaning head in relation to a corner of a pool near an inside corner to describe operation of the cleaning head in relation to dirt and debris movement. The cleaning head of FIG. 22 is a sequentially rotating head having a jet direction radially from the cleaning head in each sequential direction. The arrows illustrate water flow movement near the edge of the effective area of the cleaning head. Debris and dirt 348 typically becomes trapped in inside corners of a pool. Distances A and B are the respective distances the floor-mounted cleaning head is placed from the first wall 349 and second wall 350 of the swimming pool. If a cleaning head is spaced equally from adjacent pool walls 349 and 350, the dirt tends to build up on the corner and is not effectively removed. Instead, however, if A and B are different distances, the cleaning head more effectively removes the dirt and debris 348 from the corner through water flow being greater in one direction than in another as the cleaning head cycles through its sequential positions. As further illustrated by FIG. 22, water flow directed toward a wall travels along the wall, thereby carrying the debris along the wall. The substantially vertical walls of a pool can affect water flow in a beneficial way if used in coordination with a water flow plan for the pool using floor-mounted cleaning heads. For small pools, 360 degree rotating cleaning heads may be effective because of the effect the side walls have on the water and debris flow. In larger pools, however, 360 degree rotating heads are well known to create piles of debris that must be hand vacuumed by a maintenance person.

Figure 23:
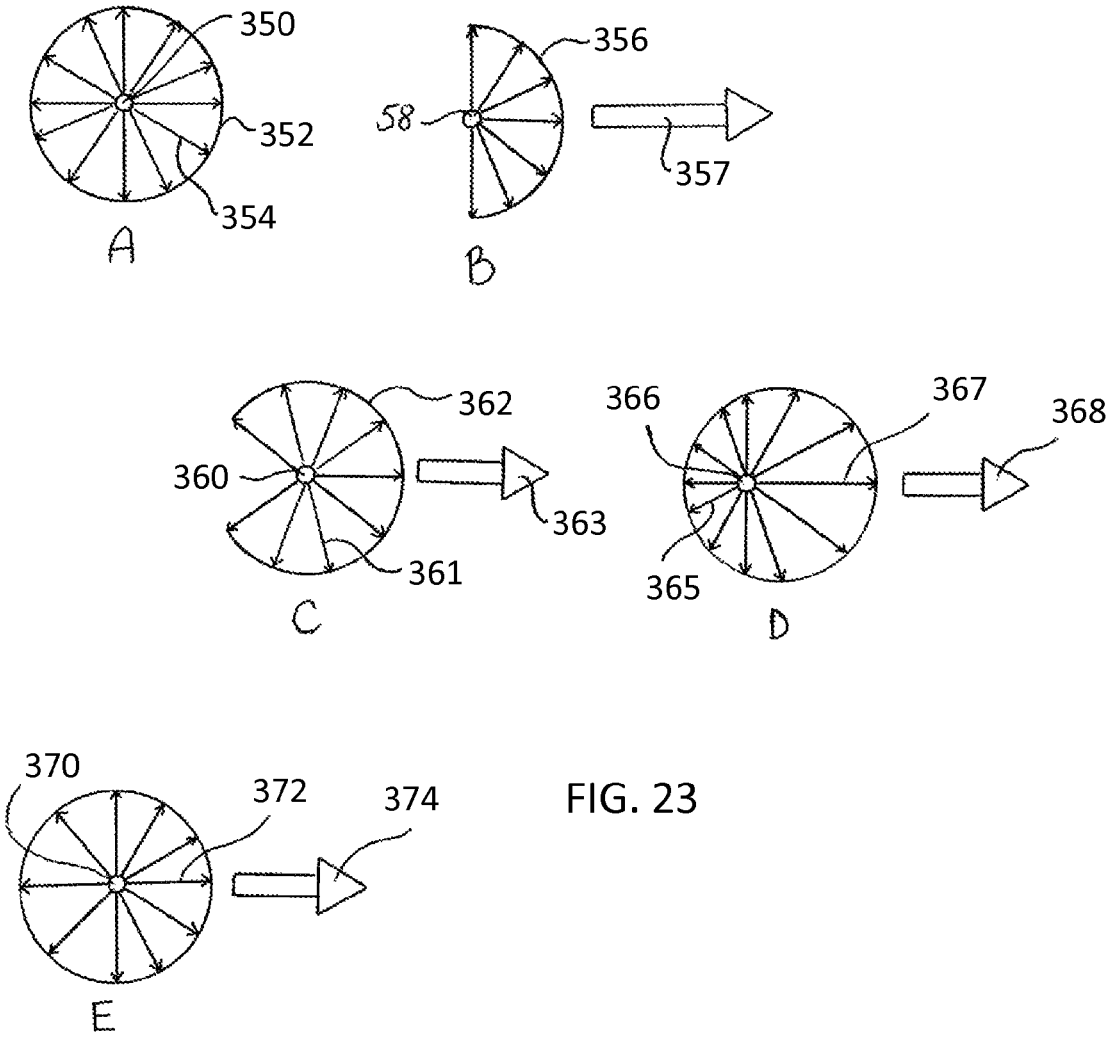
FIG. 23 illustrates different configurations of flow vectors for a pool cleaning head.

FIG. 23 illustrates a plurality of different possible jet configurations for in-floor mounted cleaning heads. Example A of FIG. 23 illustrates a conventional cleaning head configuration where the effective area 352 of the cleaning head 350 is equal around all 360 degrees and through all of its cycles. The cleaning head 350 of this example sprays with equal force and volume in each of its evenly spaced directions 354 so that the net flow direction of the water emanating from the cleaning head 350 within one cycle at each jet position is zero. The net flow vector of a cleaning head is the sum of the water flow vectors for the cleaning head for each jet direction and cycle of the cleaning head.

Example B of FIG. 23 illustrates an in-floor mounted cleaning head configuration where the effective area 356 exists in only about 180 degrees of the cleaning head 358 rotation. As a result, the net water flow 357 of the cleaning head 358 is clearly to the right of this cleaning head 358. The effective area of a cleaning head in this and other examples provided herein may be altered in any of many different ways designed to create a net water flow in a particular direction. Some non-limiting examples of how the net water flow of a particular cleaning head may be altered include, but are not limited to: 1) altering the rotation of the cleaning head to only rotate between two angular extents (such as within a 180 degree range) and either cycle back to the beginning of the rotation or flip back to the beginning; 2) allowing the cleaning head to continue its 360 rotation but disallowing water jet from the cleaning head during a portion of its rotation; 3) allowing the cleaning head to continue its 360 rotation but spending less time in particular cycles or restricting a portion of the flow during particular cycles; 4) allowing the cleaning head to continue its 360 rotation but making greater jumps in its cycle during a portion of its rotation; 5) having decreased water flow volume or pressure during a portion of the cleaning head rotation to reduce the effective water stream strength at that part of the cycle; 6) combinations of any of these or other ways of creating a net water flow in a particular desired direction; 7) deflecting the jet away from the floor in a particular section of the cleaning head rotation; and 8) using a smaller hole on one side of the head and a larger hole on another side of the head to create differential net water flow on different sides of the cleaning head.

Examples C, D and E of FIG. 23 illustrate some non-limiting examples of how differing in-floor mounted cleaning head jet configurations may allow for an in-floor mounted cleaning head with a net water flow in a particular direction. Example C illustrates a cleaning head 360 with jet directions 361 having effective jet area throughout approximately 270 degrees of the cleaning head rotation resulting in an effective area 362 for the cleaning head 360 only throughout those 270 degrees and a net water flow direction 363 for the cleaning head 360 to the right. Example D of FIG. 23 illustrates an equal number of cleaning cycle directions 365 and 367 on all sides of the cleaning head 366, but the cleaning cycles 365 on the left side of the cleaning head 366 have a smaller effective spray area than the cleaning cycles 367 on the right of the cleaning head 366. This results in a net water flow direction 368 for the cleaning head 366 to the right. Example E of FIG. 23 illustrates a fewer number of cleaning cycle directions 372 on the left side of the cleaning head 370 than on the right side resulting in a net water flow direction 374 for the cleaning head 370 to the right. These and many other examples are possible using any combination of techniques for creating a net water flow direction in a particular direction. Many other examples and how to implement the examples for use with in-floor cleaning head designs will become apparent from this disclosure. Two particular, non-limiting examples of pool cleaning heads capable of creating a net water flow direction are shown and described in U.S. Pat. No. 6,848,124 (for flush pop-up) to Goettl and U.S. Pat. No. 6,899,285 (for above surface) to Goettl et al.

Figure 24:
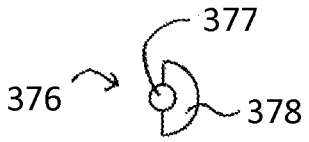
FIG. 24 illustrates a symbol for a pool cleaning head used to emphasize that the net flow vector for the cleaning head is not neutral.

FIG. 24 illustrates a symbol 376 for a pool cleaning head used to emphasize that the net flow vector for the cleaning head 377 is not neutral but is generally in the direction toward which the effective area 378 of the cleaning head 377 is facing. This symbol, or variations of it, is used throughout FIGS. 25-31 to indicate that an in-floor cleaning head is used that has a non-neutral net water flow generally in the direction of the effective area markings for the particular cleaning head illustrated.

Figure 25:
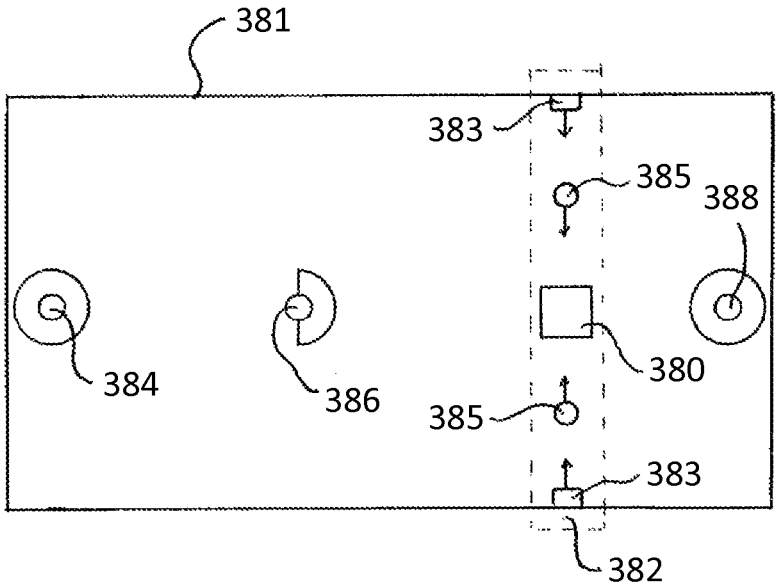
FIG. 25 is a plan view of a small diving pool illustrating cleaning head placement and operation according to a basic implementation of a pool cleaning system.

FIG. 25 illustrates an example of a basic implementation of a pool cleaning system using an in-floor cleaning head with a non-neutral net water flow direction. The example of FIG. 25, which may, for example, be implemented as a diving pool 381, includes a debris collection point 380, such as a drain, a debris capture zone 382 around the debris collection point 380, and a plurality of pool cleaning heads on the floor of the pool 381, the cleaning heads comprising at least one origin head 384 and at least one transition head 386 between the origin head 384 and the debris capture zone 382. The origin head 384 or the transition head 386 shown in FIG. 25 may comprise a recessed incrementally rotating nozzle assembly 10 or cleaning head assembly 124. The recessed incrementally rotating nozzle assembly 10 or cleaning head assembly 124 may be configured to establish various net vector flows during the incremental use. The recessed incrementally rotating nozzle assembly 10 or cleaning head assembly 124 may be further used in any combination or location described in FIGS. 24-34. The pool cleaning systems described with regard to FIGS. 23-34 are not limited to the specific incremental partially rotating cleaning heads shown and described with reference to FIGS. 1-15, but any of these particular implementations may be used in the pool cleaning systems therein described. This particular implementation also includes a second origin head 388 on the opposite side of the debris capture zone 382 from the first origin head 384.

In operation, the pool cleaning system of FIG. 25 may be coupled to a hydraulic system such as that shown in FIG. 18 to have one or more pumps, a filter and sequencing valves to operate the cleaning head circuits for the pool 381. Distinct from conventional in-floor cleaning head systems, the transition head 386 has a net flow vector toward the debris capture zone 382. It has been found that establishing a jet from a sequencing nozzle for approximately 1 minute or more establishes a flow path in the direction of the jet within the pool water. In particular implementations of this and other implementations provided herein, the transition head may be configured so that it does not have any flow in a direction away from the debris capture zone. For this example shown in FIG. 25, this means that the effective area for transition head 386 would be less than or equal to 180 degrees so that it does not spray back toward origin head 384.

In particular implementations of a pool cleaning system, such as is illustrated in FIG. 25, an opposing head 388 may be included on the other side of the debris capture zone. By having an origin head 384 at a first end of the pool in the example of FIG. 25, the effective area for the cleaning head is throughout 360 degrees and will clean out the corners of the first end of the pool to stir up the dirt and debris in that area. Cleaning heads with an effective cleaning area throughout 360 degrees of its rotation can be effective near the vertical walls of the pool. Because the origin head 384 is near the walls, as illustrated in FIG. 22, the dirt and debris is sprayed out of the corner and along the walls of the pool toward the transition head 386. Because the transition head 386 of this example has a net flow vector toward the debris capture zone 382, and particularly for this example does not emanate any water flow back toward the origin head 384, dirt and debris is only pushed toward the capture zone 382. The opposing head 388 similarly stirs up the dirt and debris from the second end of the pool and cleans out the corners of the second end of the pool which will push the dirt and debris toward the capture zone 382.

The capture zone 382 for this non-limiting example comprises a drain 380, a pair of fixed, non-rotating wall-mounted jets 383, and a pair of fixed direction, pop-up, non-rotating floor-mounted jets 385. The arrows associated with the wall-mounted jets 383 and the floor-mounted jets 385 indicate the spray direction for the jets; toward the drain 380. By having an opposing head 388 on the side of the debris capture zone 382 opposite the transition head 386, debris that flows beyond the debris capture zone 382 can be pushed back to the debris capture zone 382. This helps to keep debris within the boundary between transition head 386 and opposing head 388 to be captured in the debris capture zone 382. The water curtain generated within the capture zone by the wall-mounted jets 383 and the floor-mounted jets 385 may be cycled on and off like the other floor-mounted jets or may be turned off for portions of a cleaning cycle, but in almost all implementations will remain on throughout the cleaning cycles of the pool.

Figure 26:
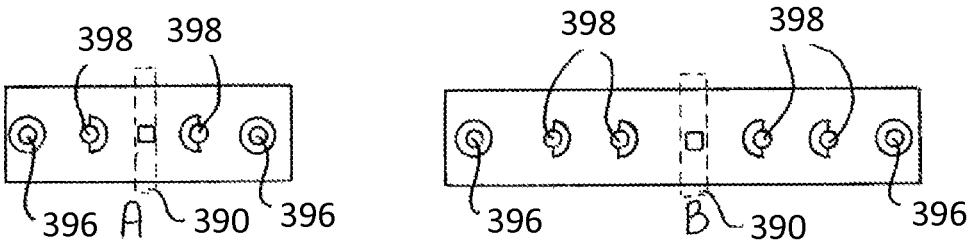
FIG. 26 is a plan view of implementations of a small play pool (A), a lap pool (B), and a larger play pool (C) illustrating cleaning head placement and operation according to particular implementations of a pool cleaning system.
Figure 26:
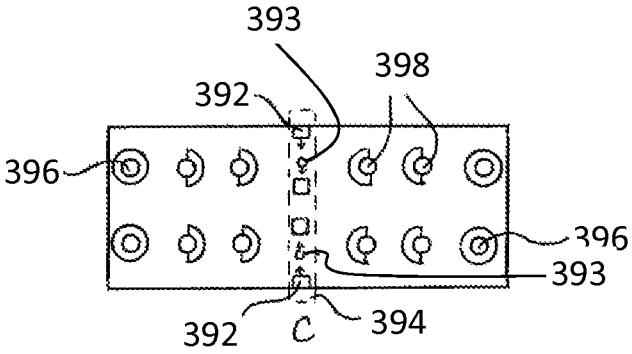

FIG. 26 illustrates three examples of how the principle of using transition cleaning heads may be applied to differently sized and configured pools where the capture zone 390 and 394 is near the center of the pool. Example A illustrates a play pool and example B illustrates a lap pool which is longer than the play pool and has two more transition cleaning heads. Each pool example comprises an origin head 396 at each end and at least one transition head 398 between the origin heads 396 and the capture zone 390. As illustrated in these two examples, the principle of placing an in-floor origin head 396 near an end of the pool and an in-floor transition head 398 between the origin head 396 and the capture zone may be expanded for longer pools by simply adding more transition heads 398 between the origin heads 396 and the capture zone. By creating a net flow vector toward the capture zone 390, and having cleaning heads with overlapping effective areas, the origin heads 396 can clean out the ends of the pool and the transition heads 398 can clean the middle portions of the pool and relay the dirt and debris toward the capture zone 390. Example C applies the principle of transition heads 398 to a wider pool with the same effect. Example C is a wider pool with a longer capture zone 394 with two drains, and pairs of side wall-mounted jets 392 and floor-mounted jets 393 creating water flow toward the drains and a water curtain to capture debris. The principle of the water flow, however, works in this pool design similar to that of the smaller examples. Wall-mounted spray jets alone are incapable of cleaning wide or large pools because the water jet effective jet area is too small. Floor-mounted spray jets with a net zero flow vector alone are incapable of cleaning wide or large pools because they randomly spray water and stir up debris. The origin head 396 or the transition head 398 shown in FIG. 25 may comprise a recessed incrementally rotating nozzle assembly 10 or one or more of cleaning head assemblies 124, 216. The recessed incrementally rotating nozzle assembly 10 or one or more of cleaning head assemblies 124, 126 may be configured to establish various net vector flows during the incremental use.

FIG. 34 illustrates a directional vector flow of water in a swimming pool resulting from pool cleaning head placement and configuration according to a particular implementation of principles disclosed herein. The arrows in the illustration represent net water flow directions. The dashed lines surrounding each cleaning head 520, 522, 524 and 526 represent the effective area of the respective cleaning heads 520, 522, 524 and 526. Note that by using origin heads 520 and 522 near the back walls of the pool, like with the example discussed in reference to FIG. 22, the resulting net water flow from the cleaning heads is along the back walls of the pool and then toward the center drain and water curtain within the debris capture zone 528. The adjacent sets of transition heads 524 and 526, which jet water toward the debris capture zone 528, adjacent walls and adjacent transition heads but not back toward the origin heads, generate an additional combined net force toward the debris capture zone 528 when the jets from a transition head set 524 or 526 cross with each other.

Figure 27:
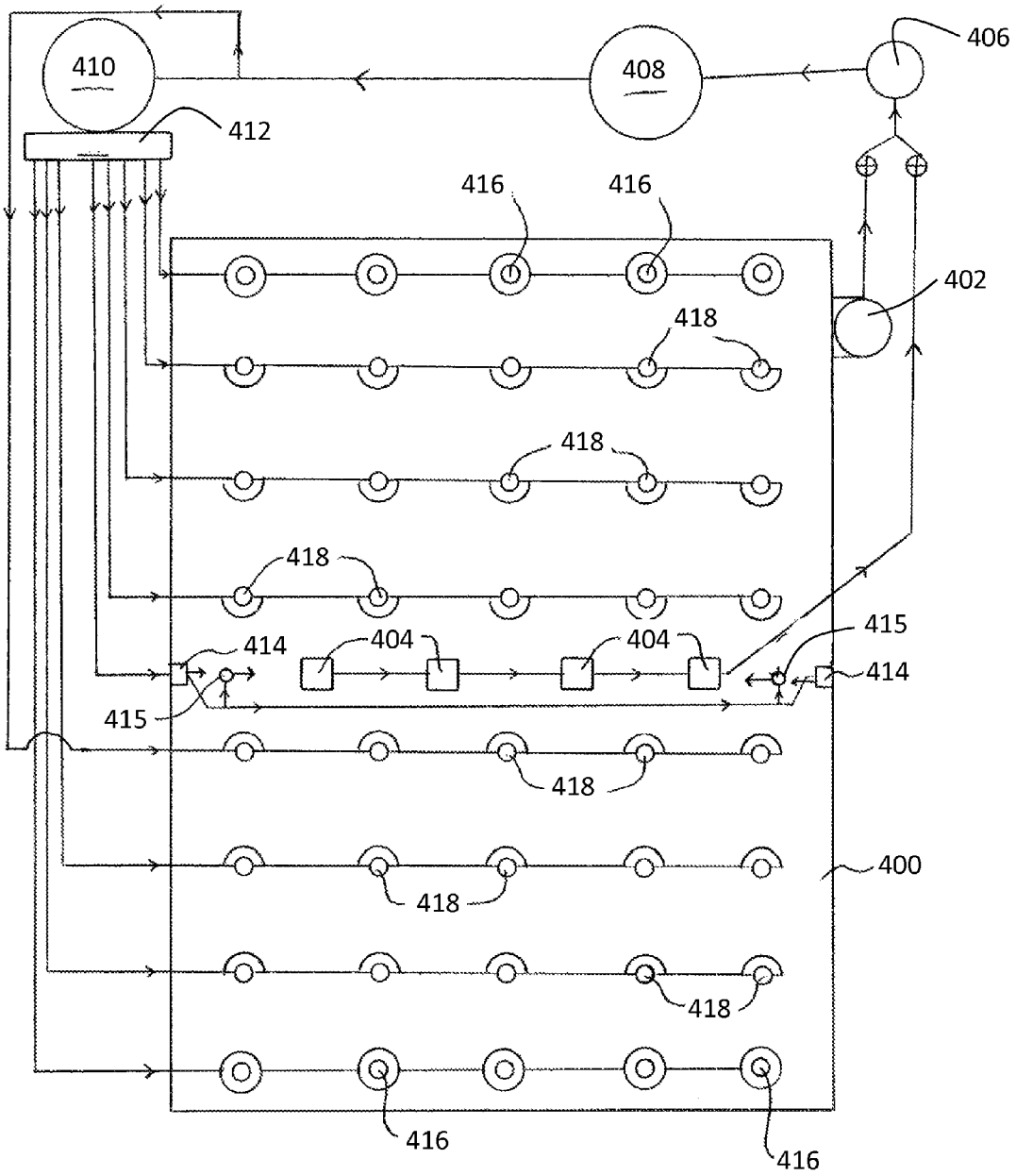
FIG. 27 is a plan view of a very large pool implementation illustrating cleaning head placement and operation according to a particular implementation of a pool cleaning system.

FIG. 27 is a plan view of a very large pool implementation illustrating cleaning head placement and operation according to a particular implementation of a pool cleaning system. In this particular implementation of a swimming pool cleaning system comprises a swimming pool 400 having a skimmer 402 and a plurality of drains 404 coupled to a pump 406. The pump 406 pumps water from the pool 400 to a filter 408 which is subsequently pumped through a sequencing valve 410 coupled to a plurality of water circuits through a circuit controller 412. The circuit controller 412 may be a conventional mechanical or electrical system configured for regulating flow of water through the sequencing circuit. Furthermore, one or more of the water circuits may be configured to be continuously on, such as the circuit supplying the side jets 414 and floor jets 415 for the capture zone, by either bypassing the sequencing portion of the system or otherwise configuring the system for the desired flow. Each of the circuits may have one or more cleaning heads 414, 415, 416 and 418. Given the principles discussed herein, those of ordinary skill in the art will readily be able to configure a conventional water circuit system for operation with an implementation of a swimming pool cleaning system disclosed. One problem commonly experienced in cleaning large pools using conventional methods is that not all of the cleaning heads on a particular row may be able to be on the same circuit. This means that the cleaning heads on part of a particular row may come on at a different time than the cleaning heads on another part of the row. This further complicates getting debris to the drains when net zero flow vector cleaning heads are used.

The example of FIG. 27, like that of FIGS. 25 and 26, includes both origin heads 416 and transition heads 418 between the origin heads and the capture zone defined about the drains 404 between the wall-mount side jets 414 and the floor-mount jets 415. Although in this example each row of cleaning heads is shown as being coupled to a different water circuit, any of the cleaning heads may be coupled with any of the other cleaning heads in the same circuits or different circuits. It has been found that cycling through the circuits by starting with the region farthest from the capture zone first (i.e. the origin heads row) followed by sequentially cycling through rows closer to the capture zone to relay the debris and dirt toward the capture zone works best. The sequencing, by non-limiting example, could begin with the outer two origin head rows first, then move to the second outer row, then the second closest row, then the closest row last. Alternatively, by non-limiting example, the sequencing could alter beginning with the first pool end origin head row then the second pool end origin row, and then alter in toward the center in a similar fashion. Virtually any combination is possible and those of ordinary skill in the art will quickly determine the cycle order that works best for a particular swimming pool configuration from the examples and principles disclosed herein without undue experimentation. While some sequencing methods may provide better results than others, beneficial results from this system is not sequencing method dependent.

Contrary to conventional systems which rotate 360 degrees and merely stir up the debris with the hope that it will settle closer to the drain even when it is sprayed back toward the ends of the pool, the use of a transition heads increases the likelihood that the dirt and debris will settle closer to the drain because the transition heads have a greater tendency to not spray the dirt and debris back toward the origin head it came from. In essence, the use of transition heads helps to create a dirt and debris flow within the pool from a dirt and debris origin toward the capture zone rather than randomly stirring up the dirt and debris with the hope that it will settle in a better place.

A study was performed in which three pool cleaning systems were compared to determine the effectiveness of using transition heads for cleaning a swimming pool. All three pool cleaning systems used the same swimming pool with the heads located in the pool according to different cleaning head layout theories. All of the cleaning heads were incrementally cycling pop-up heads. For each test demonstration, approximately 400 synthetic leaves cut into 1½ inch triangles of vinyl sheeting were placed in the swimming pool prior to the cleaning system being turned on. The cleaning system was left on for one hour in each test demonstration and each test demonstration used the same pumping systems, but with a different cleaning head layout. Three separate test demonstrations were performed for each pool cleaning system. The first pool cleaning system used no water curtain and rows of adjacent cleaning heads in the pool; the second pool cleaning system used fewer but larger cleaning heads and a water curtain; and the third pool cleaning system used a water curtain and cleaning heads like the second pool cleaning system, but some of the cleaning heads were substituted to include transition heads and arranged as explained in relation to the principles discussed for the examples of FIGS. 25 through 27.

For the first pool cleaning system with no water curtain and two rows of cleaning heads, the three test demonstrations resulted in, respectively, 18, 19 and 48 leaves being collected with an average of 28 leaves per test. For the second pool cleaning system with a water curtain and incrementally rotating heads each rotating through 360 degrees, the three test demonstrations resulted in, respectively, 239, 138 and 143 leaves being collected with an average of 173 leaves per test. For the third pool cleaning system with the water curtain and incrementally rotating heads where some were transition heads, the three test demonstrations resulted in, respectively, 382, 356 and 326 leaves being collected with an average of 355 leaves per test. These tests indicate a significant increase (greater than 100%) in effectiveness through the use of transition heads over a conventional system having no in-floor transition heads.

Figure 32:
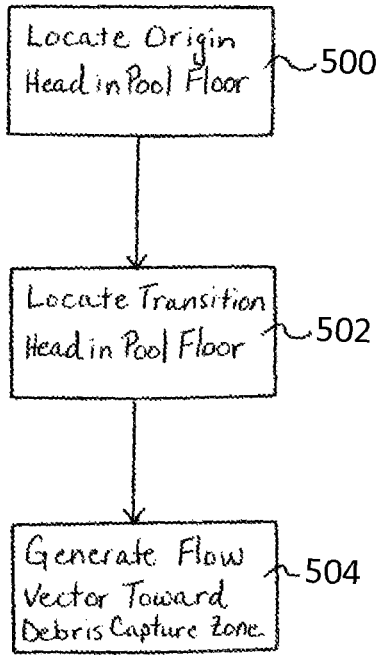
FIG. 32 is a flow diagram of a first method of designing a pool cleaning system.

Now referring to FIG. 32, a first method of designing and/or building a pool cleaning system with a predictable cleaning result is illustrated. Once a pool shape is designed, a pool cleaning system designer determines a location for one or more debris capture zones for the pool around debris capture points. In a pool configuration with a shape and one or more debris capture points, at least one debris origin point is identified and an origin head is located in the pool floor near the debris origin point (Step 500). Once the origin head is located, one or more transition head points are identified between each origin head and the debris capture point and at least one transition head is located between each origin head and the debris capture point (Step 502). The transition heads are each configured to generate a net water flow vector in the direction of the debris capture zone. Accordingly, the cleaning head system generally creates a flow vector toward the debris capture zone when in use (Step 504). This process, as demonstrated in this disclosure, is applicable to pools of any size and shape.

Figure 33:
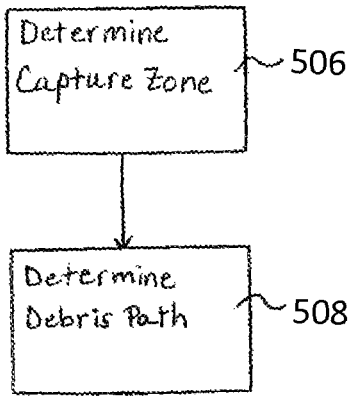
FIG. 33 is a flow diagram of a second method of designing a pool cleaning system.

Now referring to FIG. 33, a second method of designing and/or building a pool cleaning system with a predictable cleaning result is illustrated. Once a pool shape is designed, a pool cleaning system designer determines a location for one or more debris capture zones (Step 506) for the pool around debris capture points. After the debris capture zone(s) is determined for the pool, the pool cleaning system designer determines a debris path (Step 508) for debris within the pool to the debris capture zone(s). Once the debris path is determined, the method of FIG. 32 may be performed to generate a flow vector toward the debris capture zone.

Figure 30:
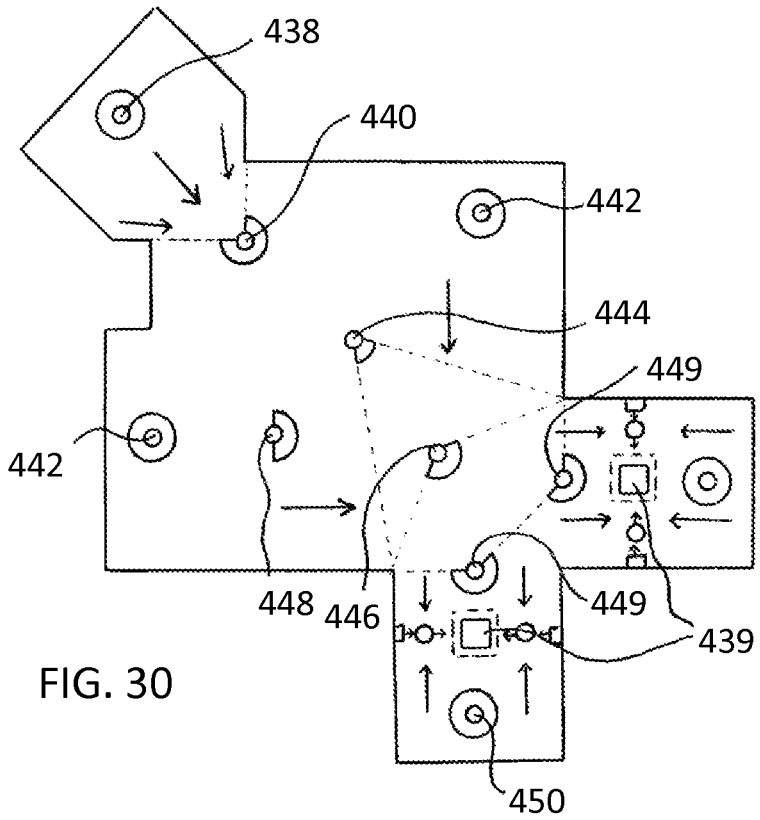
FIG. 30 is a plan view of another complicated pool implementation illustrating cleaning head placement and operation according to a particular implementation of a pool cleaning system.
Figure 31:
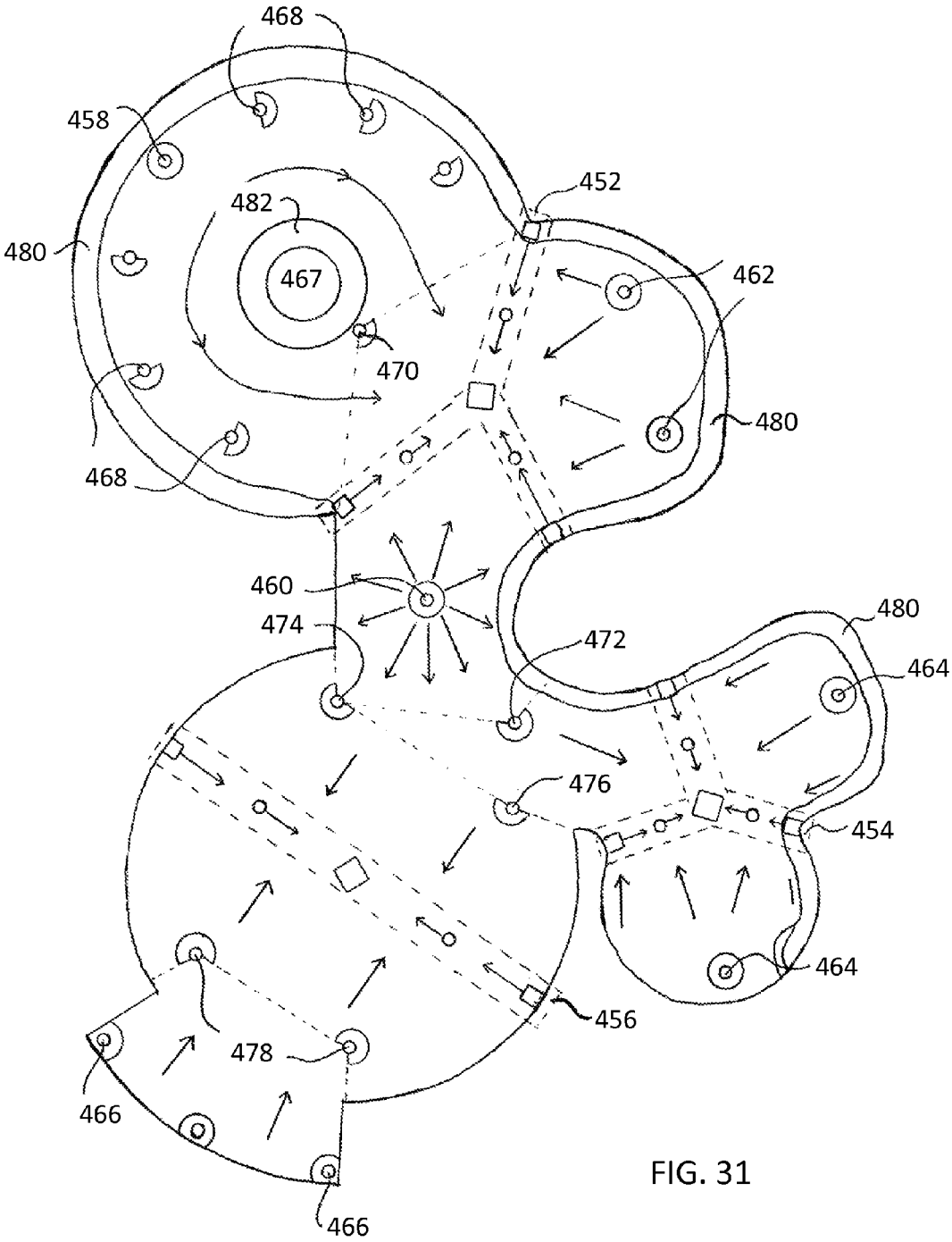
FIG. 31 is a plan view of yet another complicated pool implementation illustrating cleaning head placement and operation according to a particular implementation of a pool cleaning system.

As shown with specific regard to FIGS. 30 and 31, use of these principles enables a pool cleaning system designer to design a pool cleaning system capable of more effectively cleaning pools that it was not possible to effectively under prior art systems using conventional cleaning head arrangements. By applying additional water flow vector modules, each comprising at least one origin head and at least one transition head, to a swimming pool design, and expanding each water flow vector module to the necessary length by adding additional transition heads between the origin head and the debris capture zone, a swimming pool designer can pre-determine net water flow paths for the pool cleaning system and more effectively channel debris to the debris collection point within the pool.

Using conventional pool cleaning system design techniques, a pool was considered "cleaned" if the effective area of the cleaning heads in the pool were enough to cover the area so that all of the surfaces in the pool were sprayed. Using this type of design technique, however, there was no way to predict where the dirt would go. The result was that after the pool was designed and built, if the pool was not effectively cleaned and piles of dirt and debris was left on the pool floor, the contractor would need to come out and redo the cleaning system. Redoing a pool cleaning system can be a very expensive and time consuming process because many times parts of the pool must be demolished to replace the cleaning heads. In a particular method of designing and/or making a pool cleaning system, the pool cleaning system is configured so that the cleaning heads associated with a first circuit are farthest away from a debris capture zone, the cleaning heads associated with a second circuit are next closest to the debris capture zone, and the cleaning heads associated with a third circuit are closest to the debris capture zone. In this particular implementation, the circuits are supplied water and sequentially activated in the order farthest away from the debris capture zone to closest to the debris capture zone. In this way, debris farthest from the debris capture zone is stirred up toward the capture zone and is then transitioned to the next circuit's cleaning heads which are closer to the debris capture zone, etc. If the implementation uses transition heads in one or more intermediate circuits, the debris will more consistently be pushed toward the debris capture zone than if conventional 360 degree rotating, zero net flow value heads are used for all circuits.

Figure 28:
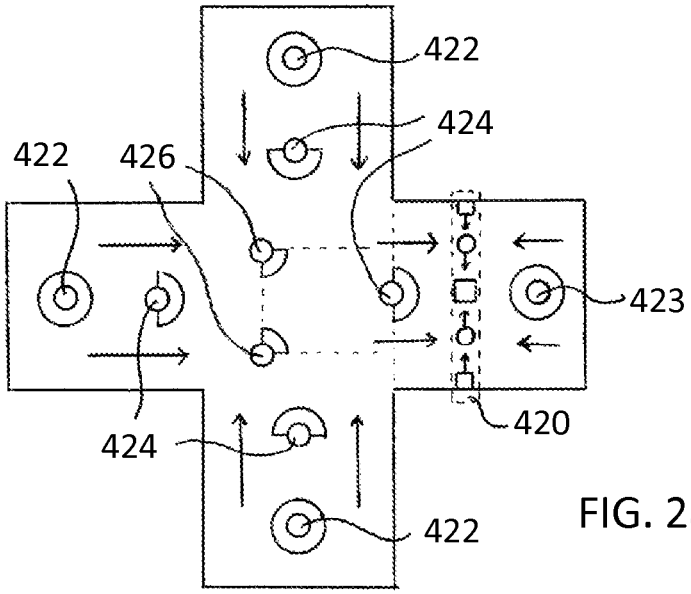
FIG. 28 is a plan view of a pool implementation having outside corners illustrating cleaning head placement and operation according to a particular implementation of a pool cleaning system.

The example illustrated in FIG. 28 is an implementation of a principle of pool cleaning system design applied to a swimming pool of substantially uniform shape having outside corners. The swimming pool comprises a debris capture zone 420, at least one origin head 422 in each leg of the swimming pool, at least one transition head 424 between each origin head and the debris capture zone 420, and an opposing head 423 in an opposing side of the debris capture zone 420 from the origin heads 422. The effective area of each cleaning head for this particular implementation is approximately 15 feet in diameter. For this particular implementation, the transition heads 424 have an effective area not greater than 180 degrees so that they do not generate any flow back toward the origin head 422 for the respective leg in which the transition head 424 is placed. This particular implementation also comprises two additional transition heads 426 configured with an effective flow area adjusted to generate flow into the leg of the pool having the debris capture zone and not toward any of the other legs of the pool.

Figure 29:
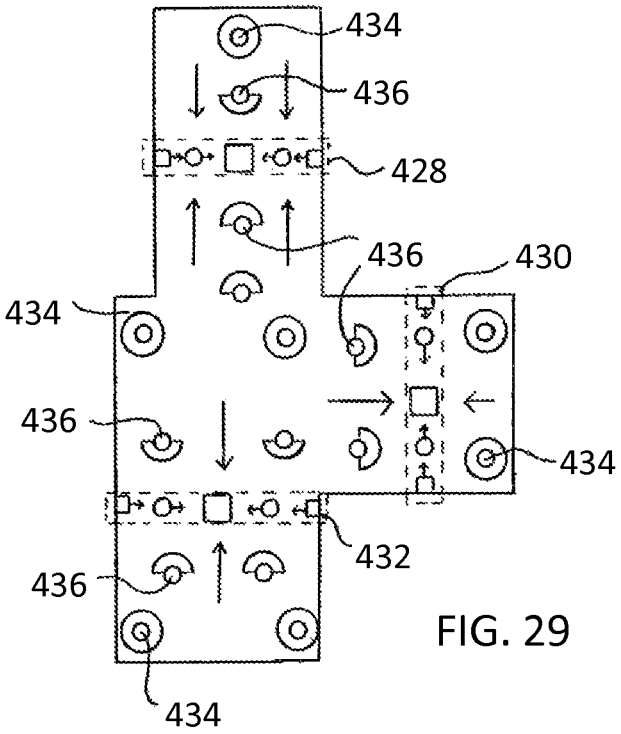
FIG. 29 is a plan view of a more complicated pool implementation having multiple capture zones illustrating cleaning head placement and operation according to a particular implementation of a pool cleaning system.

The example illustrated in FIG. 29 is an implementation of a principle of pool cleaning system design applied to a swimming pool having outside corners but a non-uniform pool shape and multiple capture zones. In this pool design there are three debris capture zones 428, 430 and 432. Each of the debris capture zones 428, 430 and 432 for this implementation comprises at least one drain in the pool floor and fixed directional cleaning heads on opposing side walls and the floor adjacent the drain, the fixed directional cleaning heads spraying toward their respective drain.

The origin and transition pool cleaning heads are configured a little differently for each debris capture zone due to the shape of the pool. For this particular pool shape, it was determined that a debris origin point near a center of the largest open space for the pool was appropriate. Accordingly, an origin head 434 was placed there, one near the outside corner between the first and second capture zones 428 and 430 and one near the corners between the first and third capture zones 428 and 432. Transition heads 436 were placed between these central origin heads 434 and each debris capture zone 428, 430 and 432. Each of the transition heads is configured to generate a net water flow vector toward a particular debris capture zone. For the first debris capture zone 428, a net flow vector module comprising an origin head 434 and a transition head 436 are placed between the end of the pool and the debris capture zone. In this way, the transition head 436 acts as an opposing head for the net flow vector module on the opposite side of the debris capture zone. There is no requirement implied for any implementation of a pool cleaning system that the opposing head be a cleaning head configured for 360 degree rotation. The effective area of each cleaning head for this particular implementation is approximately 14 feet in diameter. Various implementations will use cleaning heads suitable for the particular implementation. Effective areas for cleaning heads typically vary from a 2 to a 10 foot radius depending on the cleaning head and the associated pumping system. For the second debris capture zone 430, two origin heads 434 were used as the opposing heads for the capture zone 430. For the third debris capture zone 432, like the first one 428, origin heads 434 and transition heads 436 were used. As is illustrated by this implementation, whether to use transition heads and how many transition heads are needed depends upon the specific pool shape and size and the effective area of each origin and transition head. Once the basic principles of implementing a pool cleaning system using net flow vector modules is understood, one of ordinary skill in the art will readily be able to design and implement a pool cleaning system for any pool shape using the basic principles. Two particular, non-limiting examples of pool cleaning heads capable of creating a net water flow direction are shown and described in U.S. Pat. No. 6,848,124 (for flush pop-up) to Goettl and U.S. Pat. No. 6,899,285 (for above surface) to Goettl et al.

The swimming pool implementation shown in FIG. 30 is an implementation that cannot be effectively cleaned using conventional swimming pool cleaning system design principles. However, using net flow vector module principles, an effective pool cleaning implementation was designed. This particular implementation comprises a plurality of differently configured cleaning heads, each configured for its particular position in the pool. A first origin head 438 is included in the floor of the pool. This origin head 438, although it is configured for 360 degree rotation, may be configured with a net flow vector toward the opening to the main body of the pool to better channel debris toward the debris collection points 439. While this implementation illustrates only a drain within the debris capture zone, it should be understood that fixed directional cleaning heads (see FIG. 27) may be implemented in the wall and floor of the pool adjacent the drains 439 to create wider debris capture zones. It should also be understood that for any of the implementations disclosed herein, a debris capture zone may comprise a plurality of transition cleaning heads having net flow vectors toward and surrounding the drain to enlarge the debris capture zone. This approach may be particularly useful for a drain that is not near a wall, such as in a large public pool.

At the edge of the main body of the pool in FIG. 30, a transition head 440 is configured for an effective area covering approximately 270 degrees with a net flow vector toward the two debris collection points 439. Note that in this implementation, the transition head 440 is configured so that it does not spray water back toward the origin head 438. The dashed lines indicate the boundaries of the effective areas of the transition heads in this implementation. Two origin heads 442 are included near the inside corners for the pool. Between the two origin heads 442, two more narrowly configured transition heads 444 and 446 are configured to direct water flow toward the debris capture points 439. Due to the space between the left side origin head 442 and the debris capture zones, an additional transition head 448 is included. One transition head 449 is included at the opening to each of the debris capture legs of the pool and the effective area for each transition head 449 is directed only within the openings to the debris capture legs of the pool so that debris is not blown out to the main body of the pool by these transition heads. The debris capture zones 439 may further be enhanced by adding side wall and floor fixed directional heads. Finally, two opposing heads 450 are included on the opposite side of the debris capture point from the transition cleaning heads 449.

Using conventional in-floor cleaning heads with a zero net flow vector in this pool cannot effectively clean the pool due to the shape of the pool. Debris is repeatedly stirred up, the shape of the pool does not allow for effective settling near a debris collection point. Implementation of net flow vector modules in this pool enabled effective cleaning where it was previously not possible. In particular implementations of a transition head, the transition head is alignable during installation to allow for adjustment of the net water flow vector for the cleaning head. Two particular, non-limiting examples of alignable pool cleaning heads are shown and described in U.S. Pat. No. 6,848,124 (for flush pop-up) to Goettl and U.S. Pat. No. 6,899,285 (for above surface) to Goettl et al.

Like the implementation of FIG. 30, the swimming pool implementation of FIG. 31 is one that cannot be effectively cleaned using conventional swimming pool cleaning system design principles. Using net flow vector design principles, however, each of the various features of this swimming pool may be effectively cleaned. Three debris capture points are selected for this pool at each of three remote locations. Each of the debris capture points comprises at least two fixed directional jet heads in a wall of the pool and at least two fixed directional jet heads in the floor of the pool directing water jets toward the debris capture point. These groupings each form respective debris capture zones 452, 454 and 456 for the pool. The positioning of the directional jet heads is determined based on the pool shape and debris capture point location.

Once the debris capture zones were identified, debris origin points are identified and origin heads 458, 460, 462, 464 and 466 are placed in the design near the debris origin points. For the island water feature 467, a first origin head 458 is placed at a point around the island 467. Note that a bench 480 surrounds a portion of the outer edge of the pool and a bench 482 surrounds the island feature 467, thus making wall surface mount cleaning heads such as those disclosed in U.S. Pat. No. 4,114,206 to Franc (issued Sep. 19, 1978) unusable for these locations. Transition heads 468 are placed around the island, each having a net water flow vector away from the previous transition head to create a net water flow vector for the group away from the origin head 458 and toward the debris capture zone 452. Thus, although a particular transition head 468 may not have a net flow vector directly pointing to the debris capture zone, it should be considered as having a net flow vector in the direction of the debris capture zone due to the shape of the pool, the influence of the vertical pool walls on the water flow, and the surrounding transition heads because the transition head 468 assists in generating a net water flow vector toward the debris capture zone. A transition head 470 is included at the opening of the island feature 467 to further reinforce the net water flow vector created by the transition heads 468 toward the debris capture zone 452.

Central to the overall pool configuration, an origin head 460 is placed. It is determined that flow from the origin head 460 will go directly to debris capture zone 452, and to transition head 472 to debris capture zones 454 and 456 and to transition heads 474 and 476 to debris capture zone 456. Transition heads 472, 474 and 476 are placed accordingly in the design. In remote locations of the pool opposite the debris capture zones 452 and 454, origin heads 462 and 464 are included and also serve as opposing heads to the respective debris capture zones 452 and 454. Finally, origin heads 466 are placed for the beach entry and transition heads 478 are included between the origin heads 466 and the debris capture zone 456.

It will be understood that implementations are not limited to the specific components disclosed herein, as virtually any components consistent with the intended operation of a method and/or system implementation for a nozzle assembly may be utilized. Accordingly, for example, although particular nozzle assemblies may be disclosed, such components may comprise any shape, size, style, type, model, version, class, grade, measurement, concentration, material, weight, quantity, and/or the like consistent with the intended operation of a method and/or system implementation for a nozzle assembly may be used.

In places where the description above refers to particular implementations of nozzle assemblies, it should be readily apparent that a number of modifications may be made without departing from the spirit thereof and that these implementations may be applied to other nozzle assemblies. The accompanying claims are intended to cover such modifications as would fall within the true spirit and scope of the disclosure set forth in this document. The presently disclosed implementations are, therefore, to be considered in all respects as illustrative and not restrictive, the scope of the disclosure being indicated by the appended claims rather than the foregoing description. All changes that come within the meaning of and range of equivalency of the claims are intended to be embraced therein.

The invention claimed is:

1. An aiming tool for a variable rotating pool cleaning nozzle assembly, comprising:

a tray comprising a plurality of aiming reference figures;

a cleaning arc indicator coupled to the tray and comprising an adjustable visual area representing a cleaning arc of a variable rotating pool cleaning nozzle assembly; and a base rotatably coupled to the tray and comprising an aiming reference marker adjacent the tray and one or more indexing lugs positioned to fit between and engage with body installation lugs of a body mounted within a pool structure and corresponding to the variable rotating pool cleaning nozzle assembly to removably and positionally couple the base to the body, wherein the aiming reference marker aligns with one of the plurality of aiming reference figures to establish a relative rotational orientation of the body when the tray is rotated to align the cleaning arc indicator with a selected sweep pattern.

2. The aiming tool of claim 1, wherein the cleaning arc indicator comprises a first ring and a second ring interleaved together and the adjustable visual area comprises an area of the second ring not covered by the first ring, the first ring being rotatable relative to the second ring to increase or decrease the adjustable visual area.

3. The aiming tool of claim 2, further comprising:

a start boss protruding from the second ring;

one or more minimum rotation bosses protruding from the second ring and positioned to prevent the first ring from covering the second ring between the one or more minimum rotation bosses and the start boss; and a finger boss protruding from the first ring.

4. The aiming tool of claim 3, wherein the start boss is positioned between a stop boss and a retainer boss on the tray to positionally couple the second ring to the tray, and wherein the adjustable visual area is adjustable between approximately 23 degrees and 338 degrees.

5. The aiming tool of claim 4, further comprising:

a channel in the tray formed between an inner wall and an outer wall of the tray, wherein the cleaning arc indicator is seated within the channel;

a pole adapter coupled to the tray opposite the base;

a friction ring positioned between and in direct contact with the tray; and a plurality of sweep pattern indicators on the tray positioned to indicate a radial degree of the adjustable visible area.

6. The aiming tool of claim 5, wherein the one or more indexing lugs comprise a first lug and a second lug smaller than the first lug, the first lug being positioned to interface with a minor body installation lug on the body and the second lug being positioned to interface with only major body installation lugs on the body when the base is inserted into the body.

7. The aiming tool of claim 1, further comprising a locking tool, the locking tool comprising:

a plurality of aiming symbols, wherein aligning a nozzle direction indicator on a nozzle head of the variable rotating pool cleaning nozzle assembly with one of the plurality of aiming symbols based upon the relative rotational position of the body aligns variable rotating pool cleaning nozzle assembly with the selected sweep pattern; and one or more locking lugs positioned to align and engage with one or more aiming tool ports on a cap ring of the variable rotating pool cleaning nozzle assembly, wherein rotating the locking tool in a first direction when the one or more locking lugs are engaged with the one or more aiming tool ports aligns the nozzle direction indicator within one of the plurality of aiming symbols and rotating the locking tool in a second direction when the one or more locking lugs are engaged with the one or more aiming tool ports locks the variable rotating pool cleaning nozzle assembly in the selected sweep pattern.

8. The aiming tool of claim 7, wherein the one or more locking lugs comprise one or more minor locking lugs and one or more major locking lugs, the one or more minor locking lugs being positioned to align and engage with one or more minor aiming tool ports on the cap ring and the one or more major locking lugs being positioned to align and engage with one or more major aiming tool ports on the cap ring.

9. A method of aiming a variable rotating pool cleaning nozzle assembly, comprising:

determining, with an aiming tool, a relative rotation orientation of a body corresponding to a variable rotating pool cleaning nozzle assembly mounted in pool structure;

inserting the variable rotating pool cleaning nozzle assembly into the body mounted in an interior finish of the pool;

engaging a locking tool with a cap ring of the variable rotating pool cleaning nozzle assembly;

aligning a nozzle of the variable rotating pool cleaning nozzle assembly with a selected sweep pattern in the pool; and locking, with the locking tool, the variable rotating pool cleaning nozzle assembly to the body mounted in the pool structure.

10. The method of claim 9, wherein determining the relative rotation orientation of the body comprises:

aligning one or more indexing lugs between body installation lugs of the body;

inserting a base of the aiming tool into the body;

rotating a tray of the aiming tool removably coupled to the base to align an adjustable visual area visible on the tray with the selected sweep pattern in the pool.

11. The method of claim 10, wherein determining the rotation orientation of the body further comprises determining which one aiming reference figure of a plurality of aiming reference figures on the tray that an aiming reference marker on the base aligns.

12. The method of claim 11, further comprising adjusting the adjustable visual area by sliding a first ring of a cleaning arc indicator interleaved with a second ring to uncover more or less of the second ring, the adjustable visual area comprising an uncovered portion of the second ring.

13. The method of claim 12, wherein:

rotating the tray of the aiming tool removably coupled to the base to align the adjustable visual area visible on the tray with the selected sweep pattern in the pool comprises rotating the tray of the aiming tool to align a start boss extending from the second ring with a first edge of the sweep pattern; and sliding the first ring of the cleaning arc indicator comprises sliding the first ring of the cleaning arc indicator to align terminating end of the first ring with a second edge of the sweep pattern.

14. The method of claim 12, wherein aligning the nozzle of the variable rotating pool cleaning nozzle assembly comprises aligning a nozzle direction indicator with one of a plurality of aiming symbols on the locking tool by rotating a stem of the variable rotating pool cleaning nozzle assembly until the nozzle direction indicator is aligned with the one of the plurality of aiming symbols after rotating the locking tool in a first direction while engaged with the cap ring of the variable rotating pool cleaning assembly, the one of the plurality of aiming symbols corresponding to the one aiming reference figure of the plurality of aiming reference figures.

15. The method of claim 14, wherein locking, with the locking tool, the variable rotating pool cleaning nozzle assembly comprises rotating the locking toll tool in a second direction while engaged with the cap ring of the variable rotating pool cleaning nozzle assembly.

16. The method of claim 10, wherein rotating the tray of the aiming tool removably coupled to the base comprises rotating the tray of the aiming tool with a pole removably coupled to the tray.

17. An alignment kit for aiming a variable rotating pool cleaning nozzle assembly in a pool, comprising:

an aiming tool comprising a tray comprising a plurality of aiming reference figures, a cleaning arc indicator coupled to the tray and comprising an adjustable visual area representing a cleaning arc of a variably rotating pool cleaning nozzle assembly, and a base rotatably coupled to the tray and comprising an aiming reference marker adjacent the tray and one or more indexing lugs; and a locking tool comprising a plurality of aiming symbols and one or more locking lugs.

18. The alignment kit of claim 17, wherein the cleaning arc indicator comprises a first ring and a second ring interleaved together and the adjustable visual area comprises an area of the second ring not covered by the first ring, the first ring being rotatable relative to the second ring to increase or decrease the adjustable visual area and the adjustable visual area being adjustable between approximately 23 degrees and 338 degrees.

19. The alignment kit of claim 18, further comprising:

a start boss protruding from the second ring and positioned between a stop boss and a retainer boss on the tray to positionally couple the second ring to the tray;

one or more minimum rotation bosses protruding from the second ring and positioned to prevent the first ring from covering the second ring between the one or more minimum rotation bosses and the start boss; and a finger boss protruding from the first ring.

20. The alignment kit of claim 19, further comprising:

a channel in the tray formed between an inner wall and an outer wall of the tray, wherein the cleaning arc indicator is seated within the channel;

a pole adapter coupled to the tray opposite the base;

a friction ring positioned between and in direct contact with the tray and the base;

a plurality of sweep pattern indicators on the tray positioned to indicate a radial degree of the adjustable visible area; and wherein the one or more indexing lugs comprise a first lug and a second lug smaller than the first lug.

* * * * *